US007832238B2

(12) United States Patent
Misner et al.

(10) Patent No.: US 7,832,238 B2
(45) **Date of Patent: *Nov. 16, 2010**

(54) COMBINATION AND KEY OPERATED LOCKS WITH INDICATORS

(75) Inventors: Michael O. Misner, Lake Villa, IL (US); Jian-Bing Lu, Shanghai (CN)

(73) Assignee: The Eastern Company, Wheeling, IL (US)

( * ) Notice: Subject to any disclaimer, the term of this patent is extended or adjusted under 35 U.S.C. 154(b) by 524 days.

This patent is subject to a terminal disclaimer.

(21) Appl. No.: 11/978,238

(22) Filed: Oct. 27, 2007

(65) Prior Publication Data

US 2008/0295548 A1 Dec. 4, 2008

Related U.S. Application Data

(63) Continuation-in-part of application No. 11/519,753, filed on Sep. 12, 2006, now Pat. No. 7,363,782, which is a continuation of application No. 11/317,545, filed on Dec. 23, 2005, now Pat. No. 7,159,422, which is a continuation of application No. 11/098,205, filed on Apr. 4, 2005, now Pat. No. 7,007,521, which is a continuation of application No. 10/634,201, filed on Aug. 5, 2003, now Pat. No. 6,877,345.

(51) Int. Cl.
*E05B 37/06* (2006.01)

(52) U.S. Cl. ..... 70/21; 25/432

(58) Field of Classification Search ..... 70/21, 70/25–30, 38 A, 284, 285, 432
See application file for complete search history.

(56) References Cited

U.S. PATENT DOCUMENTS

| | | | | |
|---|---|---|---|---|
| 718,359 | A | 1/1903 | Koerber | 70/432 |
| 771,092 | A | 9/1904 | Ramey | 70/435 |
| 941,028 | A | 11/1909 | Murphy | 70/285 |
| 972,171 | A | 10/1910 | Dupont | 70/21 |
| 999,044 | A | 7/1911 | Kuster | 70/145 |
| 1,161,158 | A | 11/1915 | Rennert | 70/432 |
| 1,755,521 | A | 4/1930 | Smith | 70/21 |
| 1,937,523 | A | 12/1933 | Machinest | 70/53 |
| 1,981,163 | A | 11/1934 | Carlson | 70/53 |
| 2,049,416 | A | 8/1936 | Aldeen | 70/113 |

(Continued)

OTHER PUBLICATIONS

Japan Application No. SHOWA 5 No. 11247 dated Apr. 19, 1931 Disclosure Dated Mar. 31, 1932 Inventor & Applicant: Unpei Oka Disclosure Gazette No. 3441 Entitled: Padlock (Accompanied By 3-Page English Translation).

(Continued)

*Primary Examiner*—Suzanne D Barrett
(74) *Attorney, Agent, or Firm*—David A. Burge

(57) ABSTRACT

Locks for luggage, travelcases, briefcases and the like that can be operated by setting a combination or by using a key include an indicator to provide a signal in response to use of the key. The locks retain relatively movable components in latched engagement when locked, and permit relative movement of the components when unlocked. In some embodiments, the indicator provides a visual signal if an associated travelcase has been opened for inspection by unlocking the associated lock using a key; and, in some embodiments, the indicator can be reset upon entry of a proper combination.

21 Claims, 28 Drawing Sheets

U.S. PATENT DOCUMENTS

| | | | | |
|---|---|---|---|---|
| 2,110,094 | A | 3/1938 | Pauloski et al. | 70/284 |
| 2,163,852 | A | 6/1939 | Pond | 70/21 |
| 2,315,102 | A | 3/1943 | Adams | 70/432 |
| 2,487,608 | A | 11/1949 | Soref et al. | 70/21 |
| 2,546,182 | A | 3/1951 | Fenari | 70/312 |
| 2,725,739 | A | 12/1955 | Check | 70/285 |
| 2,839,322 | A | 6/1958 | Kirk | 292/251 |
| 2,923,928 | A | 2/1960 | McLaughlin | 340/274 |
| 2,926,514 | A | 3/1960 | Junkune | 70/21 |
| 2,931,203 | A | 4/1960 | Check | 70/21 |
| 2,931,204 | A | 4/1960 | Check | 70/21 |
| 2,995,025 | A | 8/1961 | Toepfer | 70/58 |
| 3,009,345 | A | 11/1961 | Check | 70/21 |
| 3,050,977 | A | 8/1962 | Foote et al. | 70/332 |
| 3,349,584 | A | 10/1967 | Russell et al. | 70/21 |
| 3,472,049 | A | 10/1969 | Sewell | 70/21 |
| 3,720,082 | A | 3/1973 | Feinberg et al. | 70/25 |
| 3,750,431 | A | 8/1973 | Atkinson | 70/21 |
| 3,800,571 | A | 4/1974 | Heine | 70/71 |
| 3,823,584 | A | 7/1974 | Gill | 70/21 |
| 3,824,819 | A | 7/1974 | Neary | 70/432 |
| 3,894,415 | A | 7/1975 | Bako | 70/21 |
| 3,952,561 | A | 4/1976 | Bako | 70/70 |
| 4,055,972 | A | 11/1977 | Calegan | 70/21 |
| 4,170,884 | A | 10/1979 | Calegan | 70/21 |
| 4,308,731 | A | 1/1982 | Remington | 70/74 |
| 4,341,101 | A | 7/1982 | Bako | 70/284 |
| 4,343,164 | A | 8/1982 | Bako | 70/312 |
| 4,343,165 | A | 8/1982 | Bako | 70/312 |
| 4,354,366 | A | 10/1982 | Bako | 70/312 |
| 4,355,524 | A | 10/1982 | Bako | 70/312 |
| 4,444,029 | A | 4/1984 | Remington | 70/25 |
| 4,450,698 | A | 5/1984 | Scelba | 70/312 |
| 4,453,390 | A | 6/1984 | Moritz et al. | 70/434 |
| 4,462,231 | A | 7/1984 | Zabel | 70/21 |
| 4,490,999 | A | 1/1985 | Castle et al. | 70/432 |
| 4,559,796 | A | 12/1985 | Deforrest, Sr. | 70/432 |
| 4,583,775 | A | 4/1986 | Bisbing | 292/64 |
| 4,651,544 | A | 3/1987 | Hungerford | 70/63 |
| 4,730,467 | A | 3/1988 | LeBrecht | 70/25 |
| 4,733,548 | A | 3/1988 | Ling | 70/25 |
| 4,770,013 | A | 9/1988 | Nakai | 70/285 |
| 4,829,794 | A | 5/1989 | Crown | 70/25 |
| 4,829,795 | A | 5/1989 | Taylor | 70/54 |
| 4,885,923 | A | 12/1989 | Nakai | 70/284 |
| 4,914,732 | A | 4/1990 | Henderson et al. | 340/825.17 |
| D321,824 | S | 11/1991 | Appelbaum | D8/334 |
| 5,082,169 | A | 1/1992 | Aurness et al. | 232/17 |
| 5,125,248 | A | 6/1992 | Ling | 70/25 |
| D331,908 | S | 12/1992 | Hollander et al. | D13/133 |
| 5,408,212 | A | 4/1995 | Meyers et al. | 340/427 |
| 5,460,020 | A | 10/1995 | Hungerford | 70/63 |
| 5,520,032 | A | 5/1996 | Ling | 70/25 |
| D372,187 | S | 7/1996 | Ling | D8/334 |
| 5,588,877 | A | 12/1996 | Davis et al. | 439/660 |
| 5,595,080 | A | 1/1997 | Whinton | 70/432 |
| 5,791,172 | A | 8/1998 | Deighton et al. | 70/63 |
| 5,794,466 | A | 8/1998 | Hungerford et al. | 70/63 |
| D400,170 | S | 10/1998 | Asai et al. | D13/133 |
| D406,522 | S | 3/1999 | Ling | D8/334 |
| 5,881,582 | A | 3/1999 | Monaco | 70/14 |
| 5,911,764 | A | 6/1999 | Wei-Kong | 70/160 |
| 6,035,672 | A | 3/2000 | Lai | 70/25 |
| 6,047,575 | A | 4/2000 | Larson et al. | 70/278 |
| 6,047,577 | A | 4/2000 | Klimas | 70/340 |
| D424,016 | S | 5/2000 | Gipson et al. | D13/133 |
| 6,070,442 | A | 6/2000 | Neeley et al. | 70/175 |
| 6,146,181 | A | 11/2000 | Plaza | 439/357 |
| D434,966 | S | 12/2000 | Ling | D8/334 |
| D444,768 | S | 7/2001 | Kishi | D13/133 |
| D450,232 | S | 11/2001 | Taylor et al. | D8/335 |
| D451,002 | S | 11/2001 | Lai | D8/334 |
| 6,315,485 | B1 | 11/2001 | Speck et al. | 403/7 |
| 6,474,116 | B1 | 11/2002 | Lai | 70/25 |
| 6,513,356 | B1 | 2/2003 | Yang | 70/213 |
| 6,516,643 | B1 | 2/2003 | Olshausen | 70/337 |
| D471,872 | S | 3/2003 | Kawase | D13/147 |
| D472,877 | S | 4/2003 | Jaag | D13/133 |
| 6,539,761 | B2 | 4/2003 | Yang | 70/284 |
| 6,553,795 | B1 | 4/2003 | Trempala | 70/167 |
| D474,674 | S | 5/2003 | Ling | D8/343 |
| 6,575,005 | B1 | 6/2003 | Hunter | 70/432 |
| 6,615,626 | B2 | 9/2003 | Yu et al. | 70/301 |
| D486,720 | S | 2/2004 | Ling | D8/334 |
| 6,708,532 | B2 | 3/2004 | Winland | 70/2 |
| 6,708,534 | B1 | 3/2004 | Ruan | 70/38 |
| 6,732,664 | B2 | 5/2004 | Worrall | 109/68 |
| 6,799,445 | B1 | 10/2004 | Tsai | 70/30 |
| 6,848,283 | B1 | 2/2005 | Lin | 70/21 |
| 6,860,125 | B1 | 3/2005 | Yu | 70/25 |
| 6,877,345 | B1 | 4/2005 | Misner et al. | 70/21 |
| 6,880,370 | B2 | 4/2005 | Yu | 70/25 |
| 6,883,354 | B1 | 4/2005 | Yu | 70/18 |
| 6,904,776 | B1 | 6/2005 | Lin | 70/25 |
| 6,912,879 | B1 | 7/2005 | Yu | 70/58 |
| 6,938,445 | B2 | 9/2005 | Huang | 70/107 |
| 7,007,521 | B1 | 3/2006 | Misner et al. | 70/21 |
| 7,021,092 | B2 | 4/2006 | Loughlin et al. | 70/56 |
| 7,021,537 | B2 | 4/2006 | Tropp | 235/384 |
| 7,036,728 | B2 | 5/2006 | Tropp | 235/384 |
| 7,100,401 | B2 | 9/2006 | Yu | 70/21 |
| 7,117,698 | B2 | 10/2006 | Lai | 70/21 |
| 7,121,123 | B2 | 10/2006 | Yu | 70/21 |
| 7,131,299 | B1 | 11/2006 | Huang | 70/21 |
| 7,140,209 | B2 | 11/2006 | Lai | 70/25 |
| 7,155,943 | B1 | 1/2007 | Lin | 70/21 |
| 7,155,944 | B1 | 1/2007 | Lin | 70/21 |
| 7,159,422 | B1 | 1/2007 | Misner et al. | 70/21 |
| 7,201,026 | B2 | 4/2007 | Yu | 70/21 |
| 7,204,108 | B2 | 4/2007 | Yu | 70/21 |
| 7,216,517 | B2 | 5/2007 | Ling et al. | 70/21 |
| 7,225,648 | B2 | 6/2007 | Lai et al. | 70/21 |
| 7,290,417 | B1 | 11/2007 | Huang | 70/285 |
| 7,331,204 | B1 | 2/2008 | Hsieh | 70/69 |
| 7,340,927 | B2 | 3/2008 | Yu et al. | 70/21 |
| 7,357,007 | B2 | 4/2008 | Lin | 70/21 |
| 7,357,008 | B2 | 4/2008 | Yu | 70/58 |
| 7,363,782 | B1 * | 4/2008 | Misner et al. | 70/21 |
| 7,370,497 | B2 | 5/2008 | Yu | 70/21 |
| 7,370,498 | B1 | 5/2008 | Miao | 70/21 |
| 7,370,499 | B1 | 5/2008 | Lee | 70/58 |
| 7,380,427 | B2 | 6/2008 | Elles et al. | 70/285 |
| 7,415,853 | B2 | 8/2008 | Yu | 70/68 |
| 7,424,813 | B2 | 9/2008 | Wu | 70/58 |
| 7,467,531 | B2 | 12/2008 | Lai et al. | 70/38 |
| 7,493,785 | B2 | 2/2009 | Yu et al. | 70/21 |
| 7,497,102 | B2 | 3/2009 | Yu | 70/58 |
| 7,520,150 | B2 | 4/2009 | Yu | 70/31 |
| 7,523,628 | B2 | 4/2009 | Yu | 70/21 |
| 7,552,607 | B2 | 6/2009 | Yang | 70/21 |
| 7,562,545 | B2 | 7/2009 | Lai et al. | 70/21 |
| 7,568,367 | B2 | 8/2009 | Huang | 70/58 |
| 7,571,627 | B2 | 8/2009 | Yu | 70/21 |
| 7,628,045 | B2 | 12/2009 | Yu | 70/21 |
| 7,631,524 | B2 | 12/2009 | Araujo | 70/25 |
| 7,698,913 | B2 | 4/2010 | Lee | 70/21 |
| 2002/0088256 | A1 | 7/2002 | Taylor et al. | 70/38 |
| 2003/0089147 | A1 | 5/2003 | Yang | 70/284 |
| 2004/0226323 | A1 | 11/2004 | Ling et al. | 70/25 |
| 2004/0226324 | A1 | 11/2004 | Loughlin et al. | 70/25 |
| 2004/0255624 | A1 | 12/2004 | Loughlin et al. | 70/56 |
| 2005/0034492 | A1 | 2/2005 | Yu | 70/25 |
| 2005/0039500 | A1 | 2/2005 | Yu | 70/25 |
| 2005/0044902 | A1 | 3/2005 | Yu | 70/25 |

| | | | | |
|---|---|---|---|---|
| 2005/0072196 | A1 | 4/2005 | Ling et al. | 70/284 |
| 2005/0092036 | A1 | 5/2005 | Lai | 70/23 |
| 2005/0098629 | A1 | 5/2005 | Tropp | 235/384 |
| 2005/0154605 | A1 | 7/2005 | Tropp | 705/1 |
| 2005/0155397 | A1 | 7/2005 | Yu | 70/58 |
| 2005/0167494 | A1 | 8/2005 | Tropp | 235/384 |
| 2005/0223758 | A1 | 10/2005 | Yu | 70/63 |
| 2005/0229655 | A1 | 10/2005 | Yu | 70/63 |
| 2005/0235705 | A1 | 10/2005 | Ling et al. | 70/25 |
| 2005/0235706 | A1 | 10/2005 | Ling et al. | 70/29 |
| 2005/0262902 | A1 | 12/2005 | Ling et al. | 70/21 |
| 2005/0262903 | A1 | 12/2005 | Ling et al. | 70/21 |
| 2006/0032274 | A1 | 2/2006 | Yu | 70/25 |
| 2006/0107708 | A1 | 5/2006 | Yu | 70/21 |
| 2006/0107709 | A1 | 5/2006 | Yu | 70/21 |
| 2006/0107710 | A1 | 5/2006 | Yu | 70/25 |
| 2006/0150690 | A1 | 7/2006 | Lai et al. | 70/21 |
| 2006/0218980 | A1 | 10/2006 | Yu | 870/21 |
| 2006/0260369 | A1 | 11/2006 | Lai et al. | 70/38 |
| 2006/0266084 | A1 | 11/2006 | Kuo et al. | 70/21 |
| 2007/0175247 | A1 | 8/2007 | Yu | 70/58 |
| 2007/0227202 | A1 | 10/2007 | Yen et al. | 70/21 |
| 2008/0110216 | A1 | 5/2008 | Dalton et al. | 70/21 |
| 2008/0307839 | A1 | 12/2008 | Yu | 70/330 |

OTHER PUBLICATIONS

Prestolock By CCL Security Products, New Britain, CT 06051 (2-Page Brochure #PL994-01, Believed to Date Back to 1994).

Lock-In Loyalty, Prestolock Keyless Security, New Britain CT 06051 (2-Page Brochure Depicting #2430 & #2400 Padlocks, Believed to Date Back to 1994).

3 Pages of Information About Samsonite "Travel Sentry Products/ Stamps" (E & B Giftware LLC, Yonkers, NY 10701 Dated 2005).

* cited by examiner

COMBINATION AND KEY OPERATED LOCKS WITH INDICATORS

REFERENCE TO RELATED APPLICATIONS

The present application is a continuation-in-part of application Ser. No. 11/519,753 filed Sep. 12, 2006 now U.S. Pat. No. 7,363,782 by Michael O. Misner and Jian-Bing Lu entitled Combination and Key Operated Padlock With Indicator which, in turn was a continuation of application Ser. No. 11/317,545 filed Dec. 23, 2005 by Michael O. Misner and Jian-Bing Lu entitled Combination and Key Operated Padlock With Indicator (issued Jan. 9, 2007 as U.S. Pat. No. 7,159,422) which, in turn, was a continuation of application Ser. No. 11/098,205 filed Apr. 4, 2005 by Michael O. Misner and Jian-Bing Lu entitled Combination and Key Operated Padlock With Indicator (issued Mar. 7, 2006 as U.S. Pat. No. 7,007,521) which, in turn, was a continuation of application Ser. No. 10/634,201 filed Aug. 5, 2003 by Michael O. Misner and Jian-Bing Lu entitled Combination and Key Operated Padlock With Indicator (issued Apr. 12, 2005 as U.S. Pat. No. 6,877,345). These several applications and all patents issued and issuing therefrom are referred to collectively as the "Key/Combo/Indicator Cases," and all the disclosures thereof are incorporated herein by reference.

BACKGROUND OF THE INVENTION

The Key/Combo/Indicator Cases referenced above relate to combination operated locks of the type typically used to secure luggage, travelcases, briefcases and the like during travel and transport—to combination operated locks that also may be operated by a key to facilitate inspection of the contents of the cases or containers on which the locks are installed and/or that are secured by the locks—to combination and key operated locks that are provided with indicators capable of signalling that a key has been used in the associated lock.

Combination operated locks including combination operated padlocks and combination operated locks installed on hardcases such as luggage, travelcases, briefcases and the like are widely used by travelers who appreciate the convenience of dialing a simple combination to open their luggage without having to carry, find and use a proper key each time a travel bag is to be opened and relocked.

When the Transportation Security Administration took over the handling of airport security in accordance with the Homeland Security Act, an intensified effort made to inspect the locked travel bags of airline passengers often resulted in the destruction of the combination locks used to secure luggage, travelcases, briefcases and the like when these locks were forcibly opened to permit inspection of contents. The forcible opening and/or removal of combination operated locks for inspection of the contents of luggage, travelcases, briefcases and the like usually renders the locks unsuitable for reuse, and unfortunately leaves the inspected bags unlocked, with their contents subject to pilfer and theft during travel and transport.

To accommodate the need of travelers for post-inspection luggage security while also accommodating the need of government personnel to quickly and easily open and inspect selected and suspect bags that are secured by combination operated locks, a proposal was advanced by an entity known as Travel Sentry for providing government personnel with so-called "override keys" for nondestructively opening consumer owned, combination operated locks that have built-in "key override" features.

In accordance with the proposal of Travel Sentry, combination operated locks having a "key override" capability have been sold by a number of lock manufacturers. These locks may be purchased by consumers for locking their luggage, travelcases, briefcases and the like, or may be installed on luggage, travelcases, briefcases and the like by the manufacturers thereof. If the locked travel bags, briefcases and the like are inspected by government personnel, the locks are opened for inspection of contents using keys that are made available to and controlled by government authorized inspectors (but not to the owners of the locks), and then are relocked by the inspectors. Bags inspected and relocked in this manner are intended to have their contents secured by relocking them using the same combination operated locks that were used initially by the owners thereof.

What the Key/Combo/Indicator Cases address are combination and key operated locks of the general type just described that also are provided with some form of indicator to signal the owners of the locks when a key has been used with a particular lock—which may indicate that the lock has been opened for inspection of the contents of an associated travelcase.

SUMMARY OF THE INVENTION

Lock embodiments for use with travel bags, luggage and the like are disclosed that each can be opened in a simple way known to the owner of the lock, typically by setting a combination, and that each can be opened by a key, typically a key controlled by government authorized inspectors. To signal that keys have been used, each lock has an indicator that responds to key usage.

Some locks that use inventive features disclosed herein take the form of padlocks having relatively movable components such as a shackle that can move relative to a housing when unlocked either by use of a key or by setting a combination. However, the concept of providing a combination operated padlock with an indicator that responds to use of a key is not limited to use with padlocks of the type disclosed, but also can be used with combination operated locks of a wide variety of types that are designed to also be unlocked by use of a key, typically to facilitate inspection of travelcase contents.

Some of the disclosed lock embodiments include separable components suited for installation on relatively movable elements of hardcase structures including luggage, travelcases, briefcases and the like—for example, the opposite halves of a suitcase that need to be latched and locked together when the suitcase is closed for transport. However, the concept of providing separable components of a combination lock with an indicator that signals use of a key is not limited to use with hardcase elements of the type mentioned herein, but also can be used with combination controlled lock components of a variety of types that may be suited for installation on a variety of types of relatively movable members such as the closures and their surrounding framework as found on shipping containers, industrial cabinets, truck body cabinets, furniture and the like that may need to be opened for inspection when moving in commerce, or on relatively movable flexible structures such as spaced portions of duffel bags, or at spaced locations along the lengths of straps extensible about transportable articles of many types. For example, lockable, variable length luggage straps that have pairs of latchable components can have one component of each latchable pair provided with an indicator that signals key usage.

Some of the lock embodiments disclosed herein have indicators that can be reset for reuse. In some embodiments, a safeguard resides in the provision of an indicator reset mechanism that prevents the indicator from being reset while the lock is unlocked after being opened by means of a key—an arrangement intended to prevent government inspectors from resetting the lock's indicator. Some of these indicators are resettable only after an appropriate combination has been entered—typically the same combination that is known to the owner of the associated lock and that also is used by the lock owner to unlock the associated lock.

Some of the disclosed lock embodiments are unlockable by setting combinations that can be changed by their owners, usually only at times after an appropriate initial combination has been entered—typically the same combination that is known to the owner of the associated lock and that also is used by the lock owner to unlock the associated lock.

Some of the disclosed lock embodiments have indicators that display a visual signal in response to use of a key—visual signals that may alter the exterior appearance of the associated lock, for example by displaying a surface portion that normally is hidden from view.

In some disclosed embodiments, locks are provided with indicators that normally display a first state, such as the color "green," when the locks have not been opened by keys, and that display a second state, such as the color "red" once a key has been used with an associated lock. In some embodiments, the second state continues to be displayed until the indicator is deliberately reset by the owner of the associated lock, typically at a time after the owner opens the lock using a procedure or technique known only by or available only to the lock owner, not to those who open the lock by use of a key.

In some embodiments, a housing-defined window is provided through which an indicator protected by the housing can be viewed—typically an indicator that is movable within the confines of the housing between first and second positions wherein a first surface portion of the indicator is displayed for viewing through the window when the indicator is in the first position, with a second surface portion being displayed for viewing through the window when the indicator is in the second position. Electrically lighted bulbs or LEDs can provide color signals that are fixed, or movable, to display through a window.

In some embodiments, the housing-carried indicator 1) is protectively enclosed by a housing portion of the lock, 2) is movable relative to the housing portion between a first position and a second position, 3) is biased by an over-center spring toward the first position as the indicator nears the first position and toward the second position as the indicator nears the second position so as to retain the indicator in one or the other of the first and second positions unless deliberately moved from one of these positions to the other, 4) is configured to be moved from its normal first position to its second position in response to the turning of a correctly configured key that has been inserted through a keyhole of the lock to unlock the lock, and 5) can only be reset (i.e., moved from the second position back to the normal first position) after the lock has been relocked and after a combination known to the owner has been set.

BRIEF DESCRIPTION OF THE DRAWINGS

These and other features, and a fuller understanding may be had by referring to the following description and claims taken in conjunction with the accompanying drawings, wherein:

DETAILED DESCRIPTION

Figure 1:
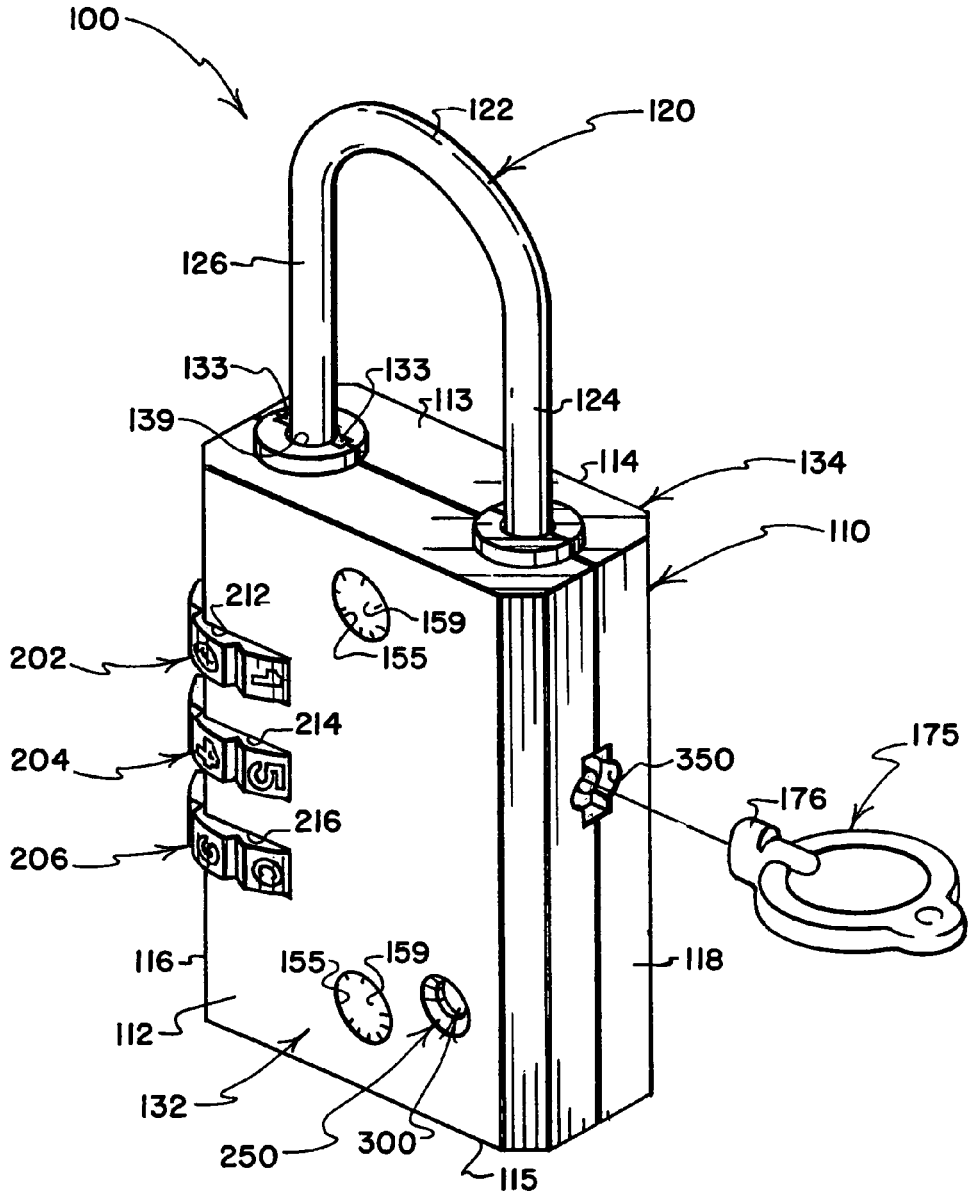
FIG. 1 is a perspective view showing a combination and key operated padlock having an indicator surface that is visible through an indicator window defined by a front wall of the padlock, with the shackle of the padlock in it locked position, and with a key positioned for insertion into a keyhole defined by a right side wall of the padlock.

Referring to FIG. 1, a padlock that may be operated either by entering a combination or by using a key 175 is indicated generally by the numeral 100. The padlock 100 has a housing 110 that, for purposes of illustration, takes a generally rectangular form; and a shackle 120 that, for purposes of illustration, takes a relatively short, generally U-shaped form. While the housing 110 is depicted as being of generally rectangular shape, and while the shackle 120 is depicted as being of relatively short, generally U-shaped configuration, those who are skilled in the art will readily understand that the housing need not take the relatively conventional, substantially rectangular shape that is shown, and that the shackle 120 may be substantially longer, or shorter, or may take other than a U-shaped configuration while still providing a padlock that incorporates indicator features such as are disclosed herein.

The housing 110 has opposed front and rear walls 112, 114; opposed top and bottom walls 113, 115; and opposed left and right side walls 116, 118. The shackle 120 has a U-shaped bend 122 that joins a relatively short leg 124 and a relatively long leg 126 that extends parallel to the shorter leg 124. The relatively longer nature of the leg 126 and the relatively shorter nature of the leg 124 of the shackle 120 are well illustrated in FIG. 2, where internal features of components of the padlock 100 also are shown.

Figure 2:
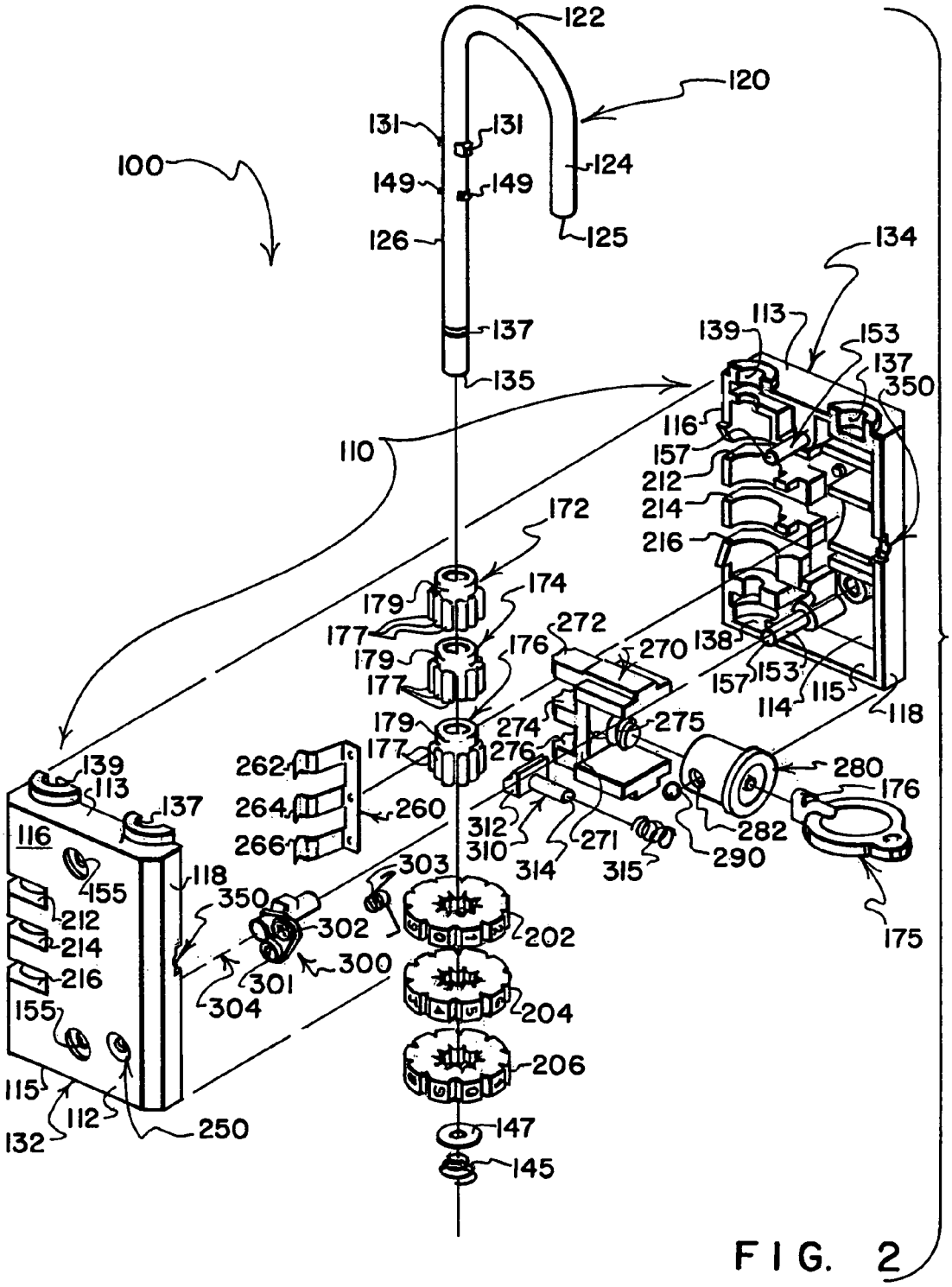
FIG. 2 is an exploded perspective view showing the two halves or shells of the housing separated, and showing internal components of the padlock, and the key.
Figure 3:
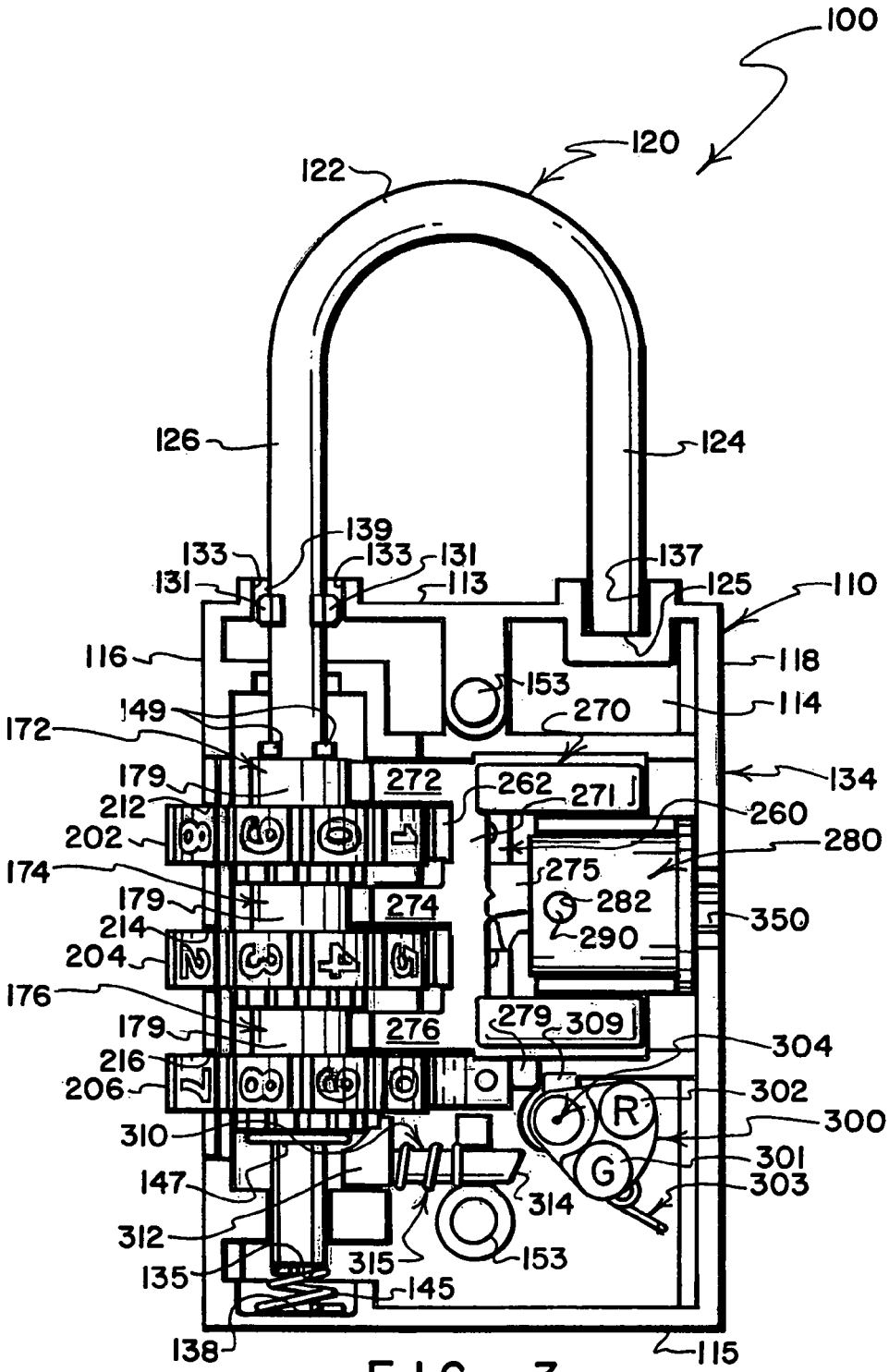
FIG. 3 is a front elevational view of components of the padlock with the front shell of the housing removed, with the shackle locked, and with the indicator positioned to display a first state, namely the color green.
Figure 5:
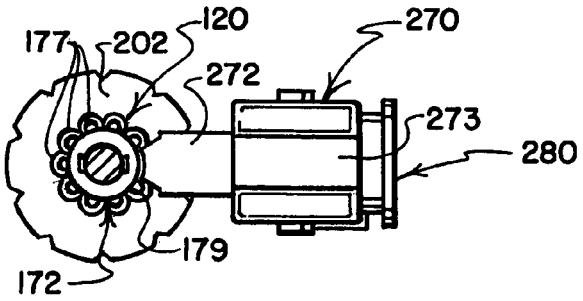
FIG. 5 is a sectional view as seen from a plane indicated by a line 5-5 in FIG. 4.
Figure 6:
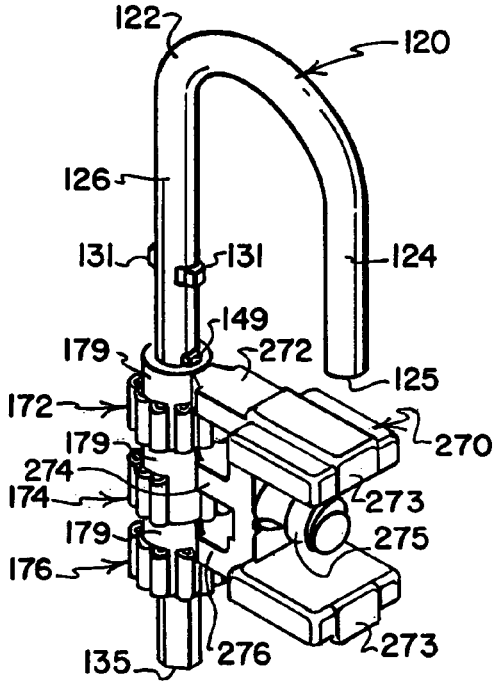
FIG. 6 is a perspective view of selected components of the padlock positioned as in FIGS. 3-5.
Figure 4:
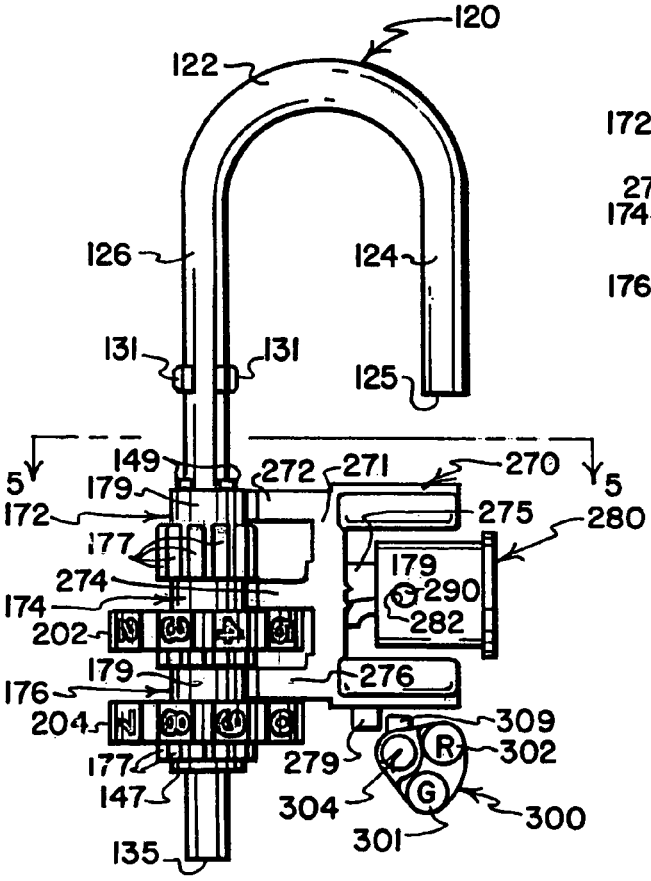
FIG. 4 is a front elevational view showing selected components of the padlock positioned as in FIG. 3.

Referring to FIGS. 2 and 3, the shorter leg 124 of the shackle 120 has a relatively flat bottom end region 125 that is configured to seat, when the padlock 100 is locked, within a shallow, upwardly facing recess 137 defined by the top wall 113 of the housing 110. The longer leg 126 of the shackle 120 extends through an opening 139 formed through the top wall 113 of the housing 110, and has a relatively flat bottom end region 135 that extends to a location relatively near, but spaced from, an inner surface portion 138 of the bottom wall 115 of the housing 110. A compression coil spring 145 is interposed between the bottom end region 135 of the longer leg 126 and the inner surface portion 138 of the bottom wall 115 of the housing so as to cause the shackle 120 to "pop up" (when the padlock is unlocked) to an unlocked position shown in FIG. 7 wherein the flat bottom end region 125 of the shorter leg 124 disengages the upwardly facing recess 137. When the shackle 120 has "popped up" from the locked position to the unlocked position of FIG. 3, the shackle 120 can be rotated about the axis of the longer leg 126 relative to the housing 110, for example to the half-turn unlocked position shown in FIG. 15.

Referring to FIGS. 1 and 2, externally viewable components of the padlock 100 include the front and rear shells 112, 114 of the housing; the U-shaped shackle 120; three identically configured, wheel-like dials 202, 204, 206 carried in spaced parallel-extending slots 212, 214, 216 that are defined by left side regions of the housing 110; a beveled indicator display window 250 formed through the front side wall 112 of the housing 110; and a keyhole 350 that extends through the right side wall 118 of the housing 110 at a location about mid-way along a vertical line of juncture of portions of the front and rear shells 132, 134 that cooperate to define the right side wall 118. The keyhole 350 is configured to receive an end region 176 of the key 175. After the end region 176 of the key 175 is inserted into the keyhole 350, the key 175 can be turned to unlock the shackle 120 of the padlock 100 for movement from the locked position of FIGS. 1 and 3 to the unlocked position of FIG. 7.

In preferred practice, the padlock 100 preferably is comprised of only about twenty separately formed parts. Referring principally to FIG. 2, these twenty parts include the front and rear shells 132, 134 of the housing 110; the shackle 120; the compression coil spring 145 that engages the lower end region of the longer leg 126 of the shackle 120 when the shackle 120 is locked, so as to bias the shackle 120 upwardly to "pop up" to an unlocked position whenever such movement is permitted by other components of the lock 100 either by setting a correct combination using the dials 202, 204, 206 or by inserting and turning the key 175; three identically configured sleeves 172, 174, 176 that have external teeth 177 that normally engage internal teeth 187 of the three identically configured dials 202, 204, 206; a leaf spring 260 which has three arms 262, 264, 266 that press against the peripheries of the dials 202, 204, 206 to assist in retaining the dials 202, 204, 206 in their current positions; a retaining washer or spring steel retaining clip 147 that resides in a groove 137 formed in the longer leg 126 of the shackle 120; a slide member 270 that has three leftwardly projecting fingers 272, 274, 276 configured to normally overlie at least some of the teeth 177 of the toothed sleeves 172, 174, 176, and to engage hub portions 179 of the sleeves 172, 174, 176 when the lock 100 is locked, with the slide member 270 also having a vertically extending formation 271 that interconnects the fingers 272, 274, 276 and a pair of vertically spaced slide portions 273 configured to engage suitably configured internal portions of the housing shells 132, 134 to enable the slide member 270 to slide leftward and rightly so the fingers 272, 274, 276 can move into and out of engagement with the smooth hub portions 179 of the externally toothed sleeves 172, 174, 176, and with the slide member 270 also having a centrally located formation that projects rightwardly from the vertically extending formation 271 to define a spiral groove or spirally grooved surface 275 (best seen in FIG. 12) that is surrounded by a hollow left portion of a cylinder 280 (as is best seen in FIG. 12); a steel ball 290 that is carried in a hole 282 formed through hollow left portions of the cylinder 280 (as is best seen in FIG. 12) and which drivingly engages the spirally grooved surface 275 of the slide 270 to establish a one-way driving connection between the cylinder 280 and the slide 270 that permits rotation of the cylinder 280 to move the slide 270 rightwardly and leftwardly relative to the housing 110 (between a normal position of the slide 270 shown in FIGS. 3-5, 7-10, 16 and 17, and a key-unlocked position of the slide 270 shown in FIGS. 11-14) as the ball 290 moves along the spirally grooved surface 275 of the slide 270, but which does not permit the slide 270 to move rightwardly and leftwardly on its own so as to cause rotation of the cylinder 280; an indicator 300 that is supported internally within the housing 110 for pivotal movement about an axis 304 between first state and second state positions wherein the indicator 300 presents one or the other of a first state surface 301 (which typically displays the color "green") and a second state surface 302 (which typically displays the color "red") to the indicator window 250 of the housing 110; a torsion spring 303 that is interposed between the housing 110 and the indicator 300 for biasing the indicator toward one or the other of its first state or second state positions; and, a reset member 310 that is supported internally within the housing 110 for leftward and rightwardly movement, and that is biased leftwardly by a compression coil spring 315.

Referring to FIG. 2, the front and rear housing shells 132, 134 are held together by pin-like projections 153 of the rear shell 134 that extend through holes 155 formed in the front shell 132. Outer end regions 157 of the pin-like projections 153 are riveted or clenched (as is indicated by the numerals 159 in FIG. 1) after the front and rear shells 132, 134 have been assembled with internal components of the padlock 100 protectively housed therebetween, to permanently clamp the front and rear housing shells 132, 134 together.

Interior features of the front housing shell 132 substantially mirror the interior features of the rear housing shell 134 that are depicted in FIGS. 2, 3, 7, 11 and 15-17, except for the pin-like projections 153 of the rear shell 134 that are received in the openings 155 of the front shell 132. Protectively enclosed within passages, chambers or compartments that are cooperatively defined by interior portions of the front and rear housing shells 132, 134 are the majority of the parts that comprise the padlock 100, several of which are movable relative to the housing 110 as described herein.

Figure 16:
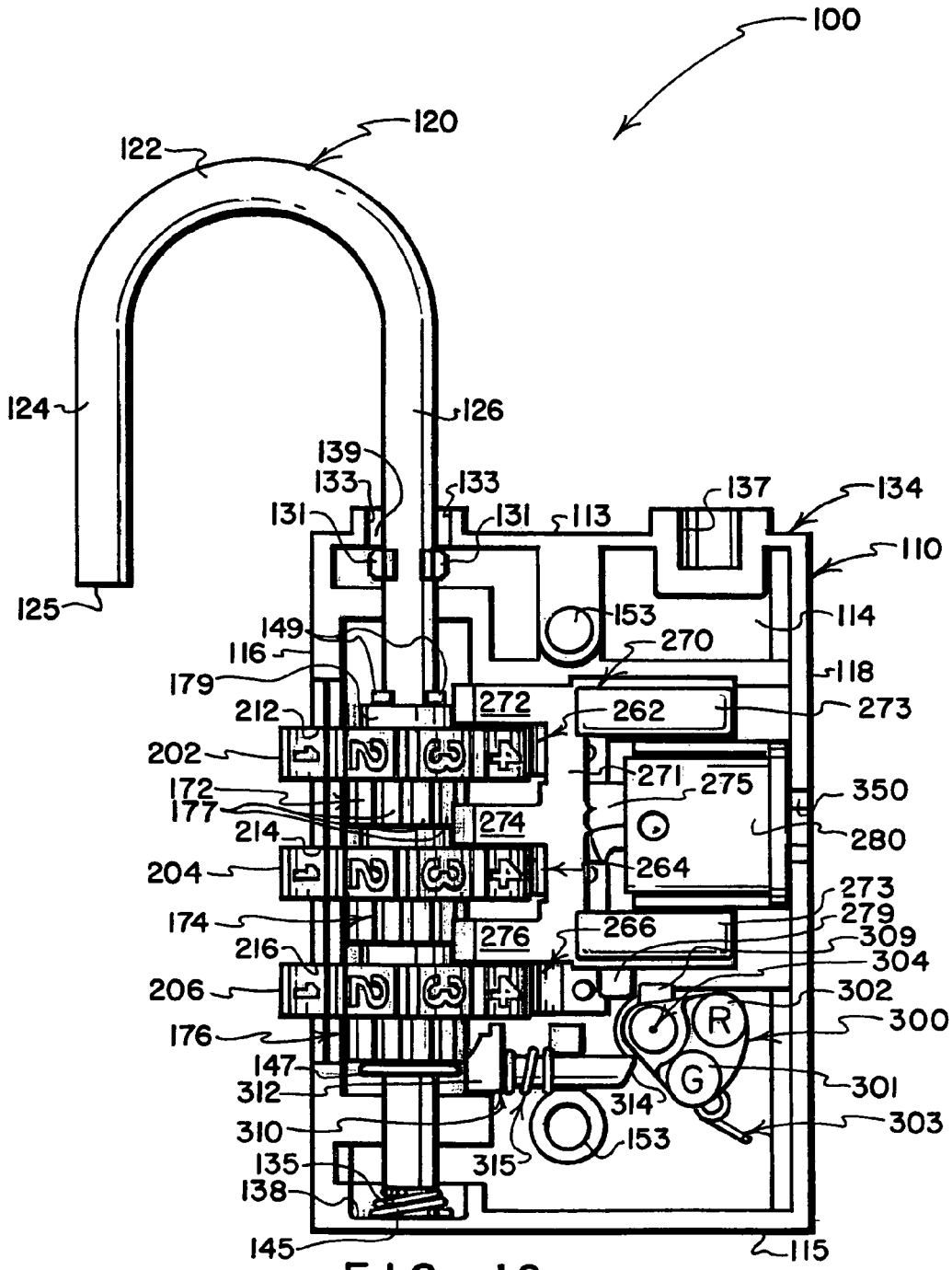
FIG. 16 is a front elevational view showing selected components of the padlock with the front shell of the housing removed, with the components as they appear near the completion of a shackle manipulation procedure that is employed by the owner of the padlock to reset the indicator, more specifically with the shackle depressed while in the half-turn orientation of FIG. 15, and with the indicator having been reset due to the depression of the shackle so as to display the first state (typically the color "green")
Figure 17:
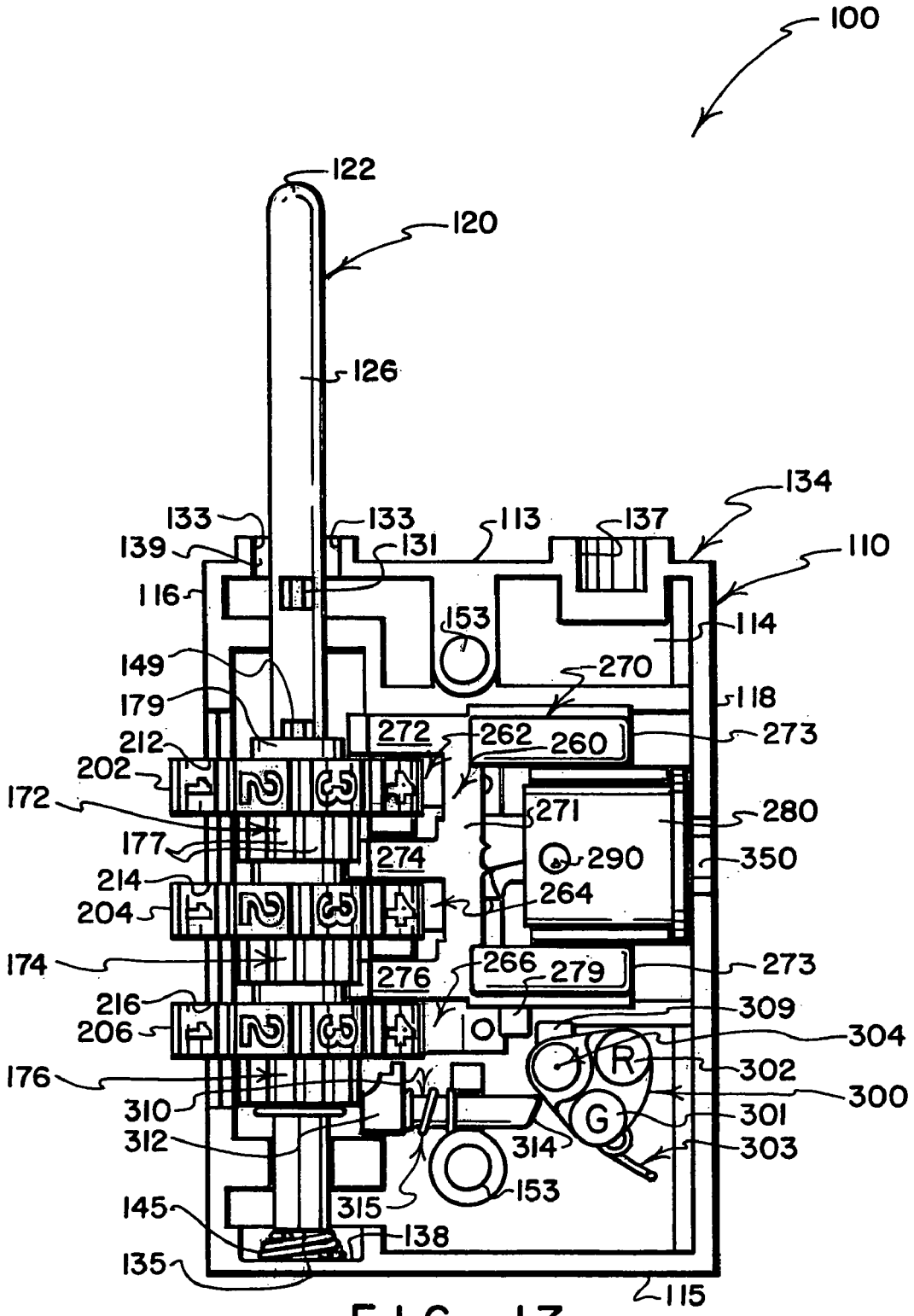
FIG. 17 is a front elevational view showing selected components of the padlock with the front shell of the housing removed, with the components as they are positioned for permitting the combination of the padlock to be changed, with the shackle having been turned a quarter turn after first having been turned to the half-turn position of FIG. 15 and after second having been depressed to the indicator reset position of FIG. 16.
Figure 18:
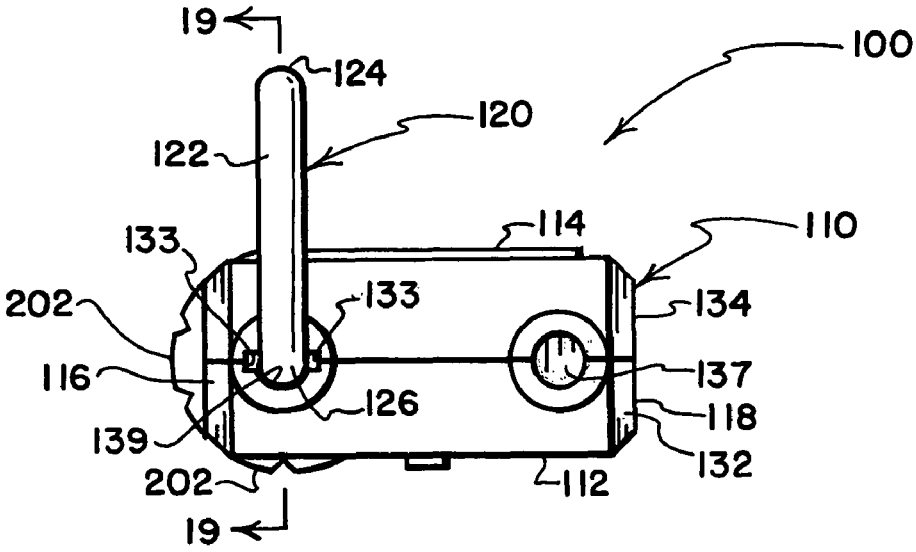
FIG. 18 is a top plan view of the padlock with the components thereof positioned as in FIG. 17.
Figure 19:
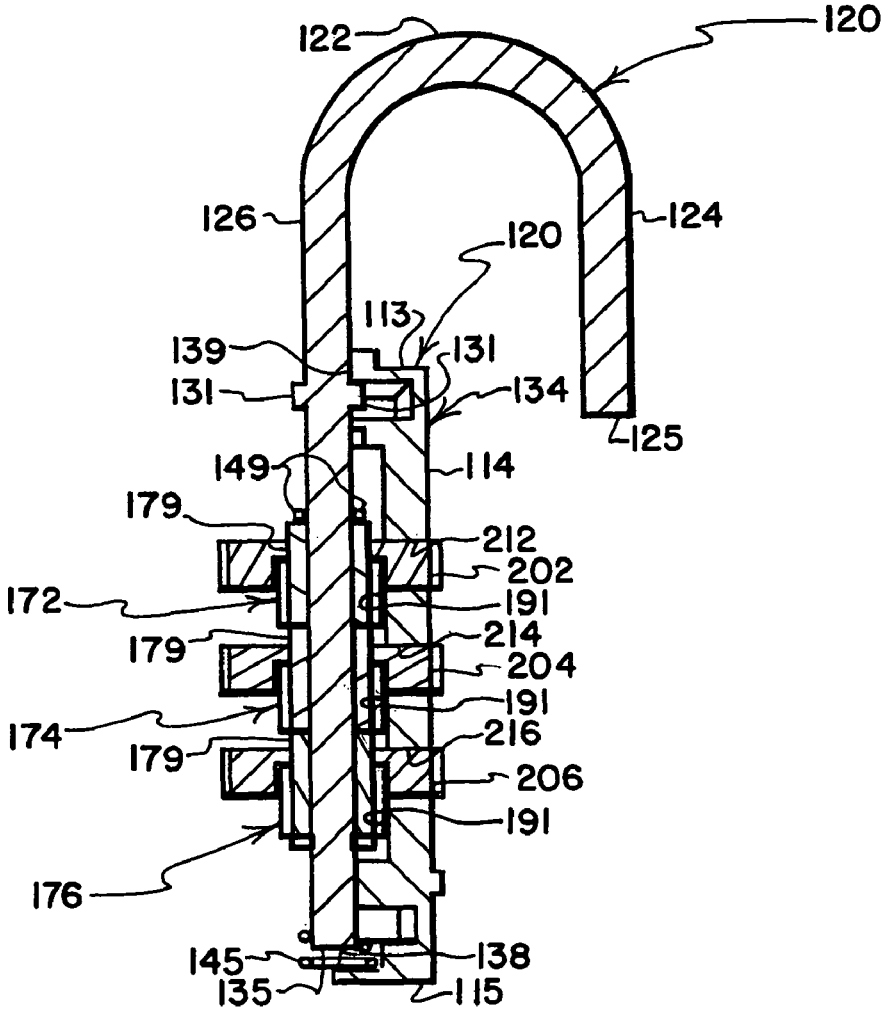
FIG. 19 is a cross-sectional view of selected components of the padlock as seen from a plane indicated by a line 19-19 in FIG. 18.

Except when the shackle 120 of the lock 100 is depressed for purposes either of resetting the indicator 300 of the lock 100, or resetting the combination of the lock 100, the teeth 187 of the internally toothed regions 203, 205, 207 of the dials 202, 204, 206 always drivingly engage the teeth 177 of the toothed sleeves 172, 174, 176. Disengagement of the teeth 187 from the teeth 177 occurs only when the longer leg 126 of the shackle 120 is depressed, as depicted in FIGS. 16, 17 and 19 sufficiently to 1) bring reduced diameter hub portions 179 of the sleeves 172, 174, 176 into a region surrounded by the internally projecting teeth 187 of the dials 202, 204, 206, and sufficiently to 2) bring enlarged, downwardly facing cavities 191 of the dials 202, 204, 206 into surrounding relationship with the radially outwardly projecting teeth 177 of the sleeves 172, 174, 176. Disengagement of the teeth 187 from the teeth 177 suspends the driving connection that normally exists between the dials 202, 204, 206 and the toothed sleeves 172, 174, 176. When the driving connection between the teeth 177, 187 is suspended, this permits the dials 202, 204, 206 to be rotated relative to the toothed sleeves 172, 174, 176 so that a new combination for operating the lock 100 can be set.

Figure 9:
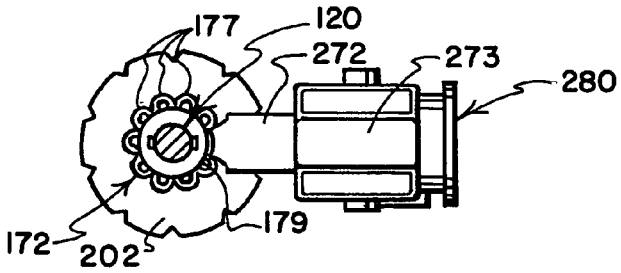
FIG. 9 is a sectional view as seen from a plane indicated by a line 9-9 in FIG. 8.

Each of the toothed sleeves 172, 174, 176 has positions for ten equally spaced teeth 177, but only nine of these ten positions carry tooth formations 177. The fingers 272, 274, 276 of the slide 270 are configured to normally overlie one or more of the teeth 177 of the externally toothed sleeves 172, 174, 176; however, when the dials 202, 204, 206 are turned to set a correct combination for unlocking the lock 100, the fingers 272, 274, 276 are aligned with the unoccupied tooth positions of the toothed sleeves 172, 174, 176 (as depicted in FIG. 9) which permits the shackle 120 (and the toothed sleeves 172, 174, 176 which are carried by the longer shackle leg 126 at a location between the retaining washer or clip 147 and a crimped region 149 of the shackle) to be raised so that the flat bottom end region 125 of the shorter leg 124 of the shackle 120 no longer resides in the housing recess 137 (which is where the bottom end region 125 resides when the shackle 120 is closed—i.e., when the lock 100 is locked).

The externally toothed sleeves 172, 174, 176 are journaled for rotation at spaced locations along the longer leg 126 of the U-shaped shackle 120. Also journaled for rotation at spaced locations along the longer leg 126 are the dials 202, 204, 206. While the toothed sleeves 172, 174, 176 move upwardly and downwardly as the longer leg 126 of the shackle 120 moves upwardly and downwardly to unlock and lock the lock 100, the dials 202, 204, 206 do not move upwardly and downwardly, for the dials project through the slots 212, 214, 216 of the housing 110 and therefore cannot move vertically with respect to the housing 110.

Figure 15:
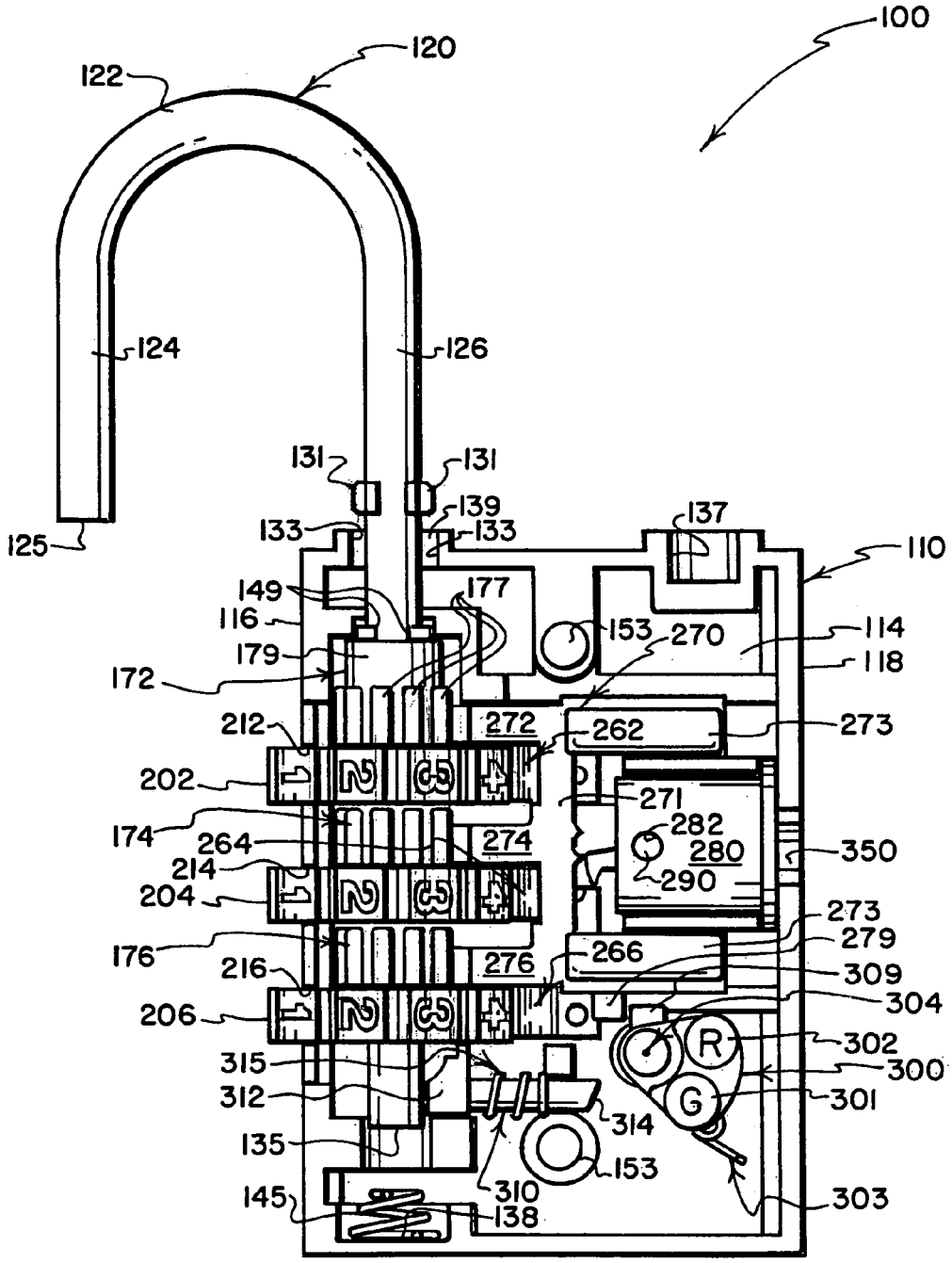
FIG. 15 is a front elevational view showing selected components of the padlock with the front shell of the housing removed, with the components as they appear mid-way through a shackle manipulation procedure that is employed by the owner of the padlock to reset the indicator from displaying the second state (typically the color "red") to displaying the first state (typically the color "green"), more specifically with the shackle having been unlocked (by entering a correct combination using the three dials of the padlock at a time after the indicator has been moved to display its second state color "red" as the result of the padlock's previously having been opened using a key), and with the shackle turned a half turn relative to the housing.

The longer leg 126 of the shackle 120 is crimped not only at a location (discussed previously and identified by the numeral 149) but also at a slightly higher location where opposed projections 131 are formed on the longer leg 126 by pinching or crimping the material of the longer leg 126. The opposed projections 131 align with widened portions 133 of a top wall opening 139 (of the housing 110 through which the longer leg 126 of the shackle 120 extends) when the shorter leg 124 of the shackle 120 is in either of two positions, namely 1) when the shorter leg 124 of the shackle 120 is aligned with the recess 137 (as depicted in FIGS. 3, 7 and 11, or 2) when shackle 120 is half-turned around (as depicted in FIGS. 15 and 16) such that the shorter leg 124 of the shackle 120 is as far away as it can get from the recess 137. At all other orientations of the shackle 120 relative to the housing 110, for example in the quarter-turned orientation depicted in FIG. 17) the opposed projections 131 are out of alignment with the widened portions 133 of the top wall opening 139.

The alignment and non-alignment of the projections 131 with the widened portions 133 of the top wall opening 139 determine whether and when the shackle 120 can be raised or depressed relative to the housing 110. In the locked position of the shackle 120 shown in FIG. 3, it will be seen that the projections 131 have moved into the widened portions 133 of the top wall opening 139 when the shackle 120 was depressed to its locked position (i.e., a position wherein the bottom end region 125 of the shorter leg 124 of the shackle 120 is seated within the recess 137 formed in the top wall 113 of the housing 110). When the shackle 120 moves from the locked position shown in FIG. 3 to the unlocked position shown in FIG. 7, it will be seen that the projections 131 move back out of the widened regions 133 of the top wall opening 139 to a position above the top wall 113—which permits the shackle 120 to be pivoted about the axis of the longer leg 126.

When the shackle 120 has been pivoted to the half-turn position illustrated in FIG. 15, it will be seen that the projections 131 again align with the widened regions 133 of the top wall opening 139, which means that the shackle 120 can be depressed to a position illustrated in FIG. 16 wherein the projections 131 have moved completely through the top wall opening 139 and into a space located just beneath the top wall 113—a space wherein the projections 131 do not inhibit turning of the shackle 120, hence the shackle 120 can again be pivoted about the axis of the longer leg 126, for example to the quarter turn position illustrated in FIG. 17. As will be explained in greater detail shortly, the half-turn, shackle depressed position illustrated in FIG. 16 is what is required to reset the indicator 300 from displaying its second state surface 302 (typically of the color "red") to displaying through the indicator window 250 the first state surface 301 (typically of the color "green"). And, as will be explained in greater detail shortly, the quarter-turn, shackle depressed position illustrated in FIG. 17 is an appropriately safe position for the shackle 120 to assume when the combination of the padlock 100 is to be reset.

Referring to FIG. 12, the cylinder 280 has a hollow left end region that surrounds the spirally grooved surface 275 of the slide 270, and has a hollow right end region that defines a suitably configured formation or formations, indicated generally by the numeral 285, configured to be drivingly engaged by the left end region 176 of the key 175 (after the left end region 176 of the key 175 has been inserted through the keyhole 350 of the housing 110) so that the key 175 can be turned to effect a corresponding, concurrent turning movement of the cylinder 280 to move the ball 190 around the spiral groove 275 of the slide 270 to move the slide 270 rightwardly, away from the normal position of the slide 270 wherein the fingers 272, 274, 276 of the slide 270 overlie some of the tooth formations 177 of the externally toothed sleeves 172, 172, 174. When the slide 270 is moved rightwardly from its normal position wherein its fingers 272, 274, 276 overlie some of the teeth 177 (as depicted in FIGS. 4-10) to a key-unlocked position (as depicted in FIGS. 11-14), the fingers 272, 274, 276 no longer overlie any of the teeth 177 and therefore no longer obstruct upward unlocking movement of the shackle 120 (which causes the toothed sleeves 172, 174, 176 to move upwardly with the shackle 120) when the shackle 120 is popped up to the unlocked position of FIG. 11 under the influence of the spring 145 which acts on the flat lower end region 135 of the longer leg 126 of the shackle 120.

The series of movements described just above (which is initiated by inserting and turning the key 175 in the housing 110 to cause the cylinder 280 to rotate to rightwardly move the slide 270 so that the fingers 272, 274, 276 no longer overlie the teeth 177 hence the shackle 120 is caused to pop up to the unlocked position under the influence of the spring 145) describes how the padlock 100 is unlocked by using the key 175. A reverse procedure is followed to relock the shackle 120 after the lock 100 has been opened by the key 175. To carry out the relocking of the lock 100 after the lock 100 has been opened by the key 175, the shackle 120 is depressed while the key 175 still is in the turned position (i.e., while the key 175 still is inserted into the keyhole 350 and still is turned as is required to cause the slide 270 to move rightwardly so that the fingers 272, 274, 276 no longer obstruct downward or upward movement of the longer leg 126 of the shackle 120 which carries the toothed sleeves 172, 174, 176) to bring the shackle to the locked position wherein the bottom end region 125 of the shorter leg 124 of the shackle 120 is seated in the top wall recess 137. The key 175 is then reverse-turned to move the slide 270 leftwardly to the normal position of the slide 270 wherein the fingers 272, 274, 276 overlie some of the teeth 177 of the toothed sleeves 172, 174, 176, and the key 175 then is removed from the keyhole 350.

Because the steel ball 290 establishes a one-way driving connection between the cylinder 280 and the slide 270 (that permits rotation of the cylinder 280 by the key 175 to move the slide 270 leftwardly and rightwardly within the confines of the housing 110, but does not permit the slide 270 to move leftwardly or rightwardly on its own so as to rotate the cylinder 280), the cylinder 280 does not rotate out of the position it normally occupies (wherein its formation 285 is ready to be drivingly engaged by the key's end region 176 anytime the end region 176 is inserted through the keyhole 350), and the slide 270 does not move rightwardly out of its normal position wherein its fingers 272, 274, 276 overlie some of the teeth 177 so as to obstruct the upward movement of the shackle 120, thus the lock 100 remains locked until either a correct combination is entered on the dials 202, 204, 206, or the key 175 is inserted and turned so as to rotate the cylinder 280 to move the slide 270 rightwardly to unlock the shackle 120.

The indicator member 300 can pivot relative to the housing 110 to selectively expose either the first state surface 301 (that preferably is colored "green") or the second state surface 302 (that preferably is colored "red") to be viewed through the indicator window 250 of the housing 110. The torsion coil spring 303 is arranged to serve what is well known to those skilled in the art as an "over center" function, meaning that the spring 303 either biases the indicator 300 toward its first state position (typically displaying the color "green" through the indicator window or opening 250 defined by the housing 110) as shown in FIGS. 3, 4, 7 and 8, or toward its second state position (typically displaying the color "red" through the indicator window or opening 250) as shown in FIGS. 11 and 12.

Figure 7:
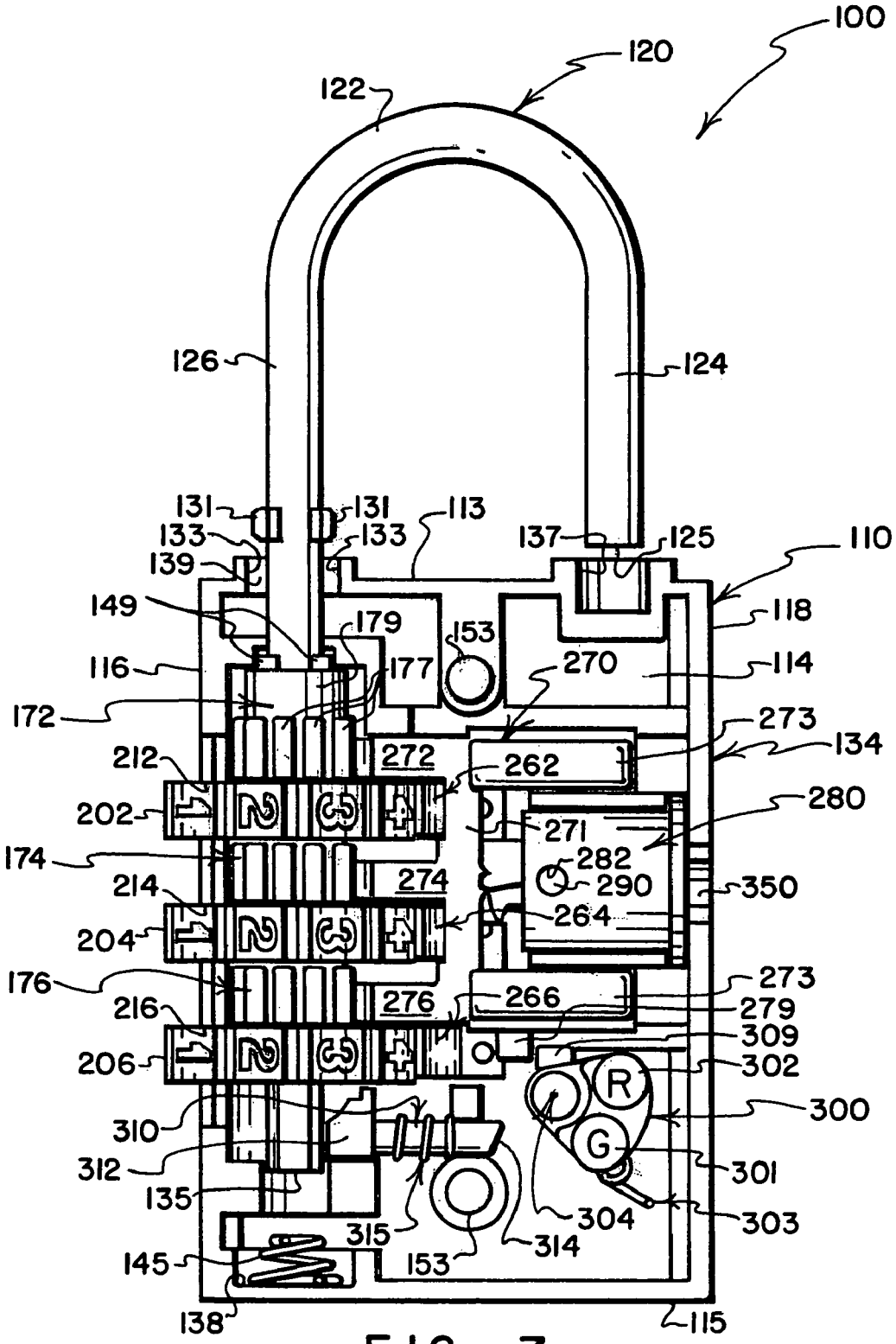
FIG. 7 is a front elevational view showing selected components of the padlock with the front shell of the housing removed, with the shackle unlocked as the result of entering a correct combination using the three dials of the padlock, and with the indicator still positioned to display a first state, namely the color green.
Figure 11:
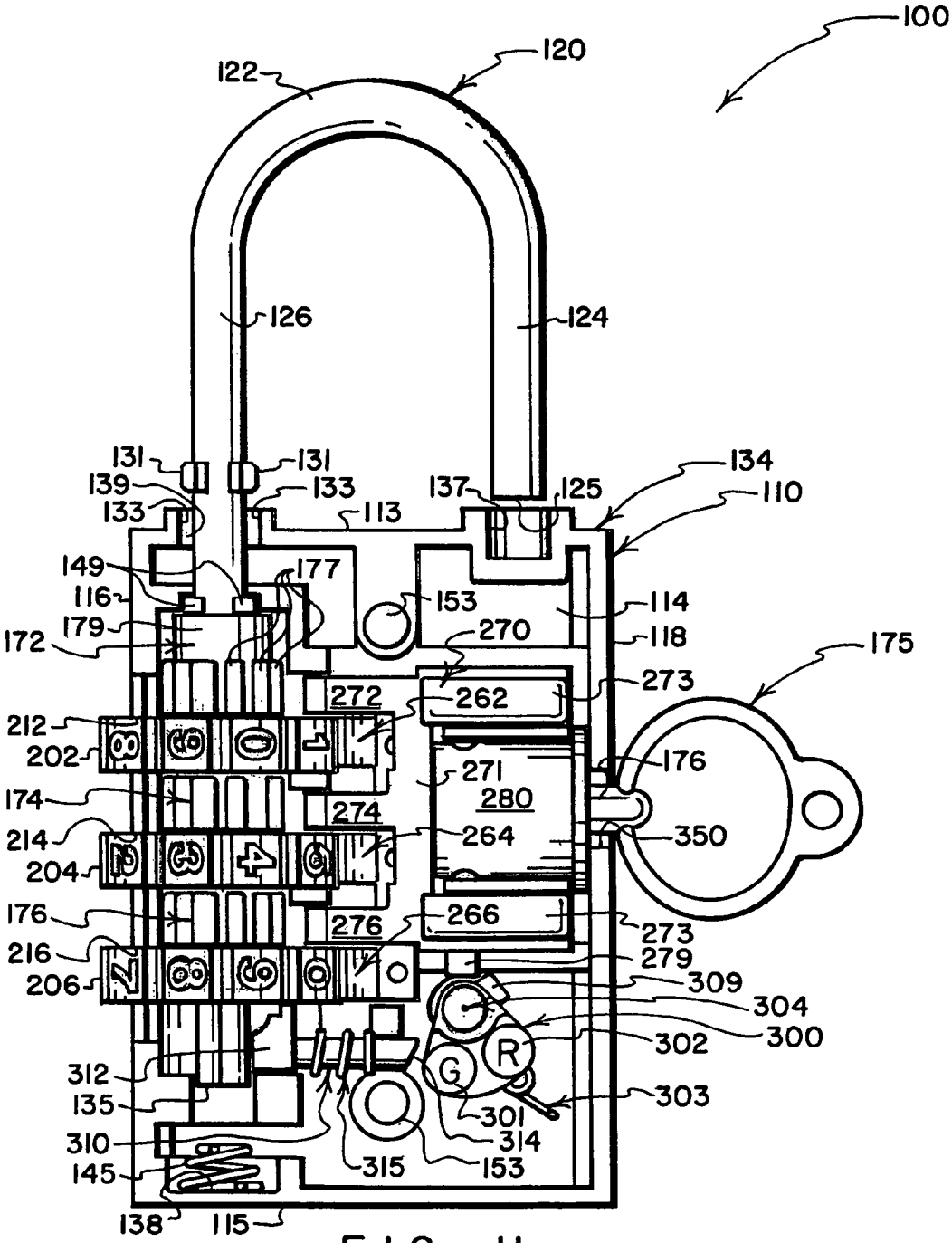
FIG. 11 is a front elevational view showing selected components of the padlock with the front shell of the housing removed, with the shackle unlocked as the result of inserting the key into the keyhole of the housing and turning the inserted key, and with the indicator moved (as the result of the key being turned) to display a second state, namely the color red.
Figure 13:
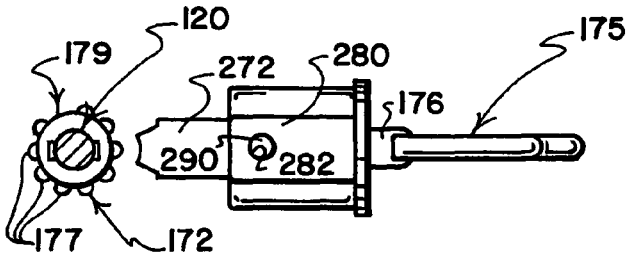
FIG. 13 is a sectional view as seen from a plane indicated by a line 13-13 in FIG. 12.
Figure 14:
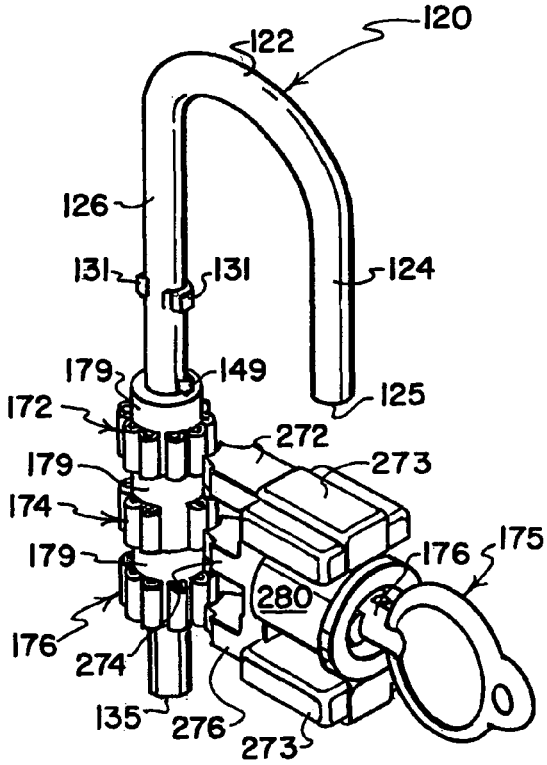
FIG. 14 is a perspective view of selected components of the padlock positioned as in FIGS. 11-13.
Figure 12:
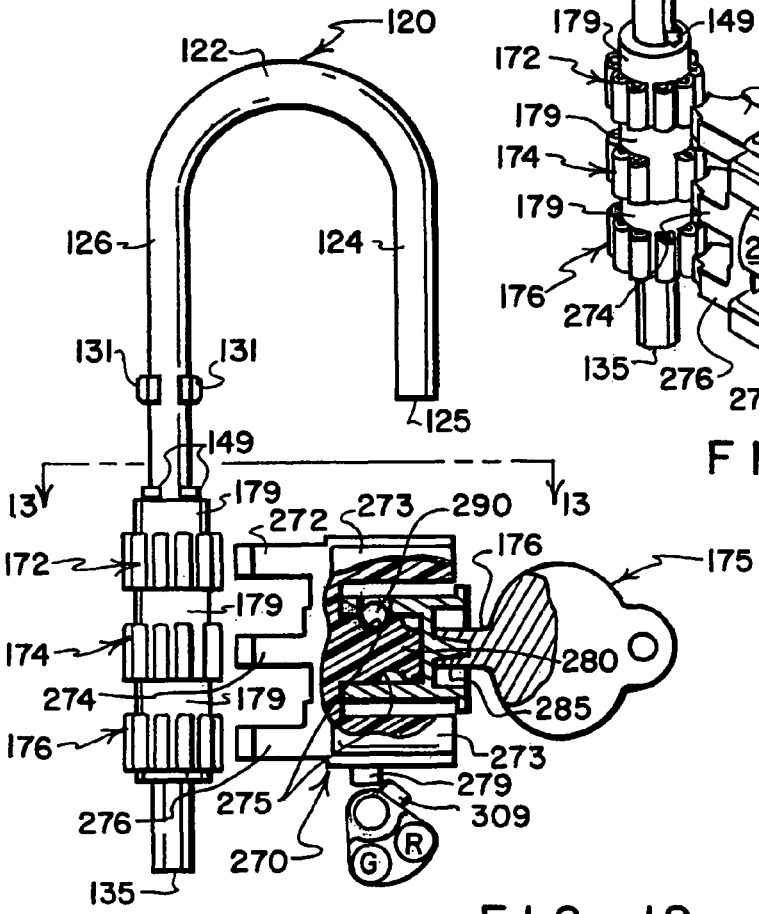
FIG. 12 is a front elevational view showing selected components of the padlock positioned as in FIG. 11, with portions of selected components broken away and shown in cross-section.

The indicator member 300 is caused to pivot from its normal state one position, depicted in FIGS. 3, 4, 7 and 8, to its state two position, depicted in FIGS. 11 and 12, by a depending tab 279 of the slide 270 which engages an upwardly projecting tab 309 of the indicator member 300. In FIGS. 3 and 7 it will be seen that the tabs 279, 309 will engage if the slide 270 is moved rightwardly if caused to do so by inserting and turning the key 175 so as to rotate the cylinder 280. In FIGS. 11 and 12 it will be seen that engagement of the tabs 279, 309 has caused the indicator member 300 to pivot about the axis 304 as the slide 270 has been moved rightwardly as the result of the key 175 being inserted and turned.

To reset the indicator member 300 from the second state position shown in FIGS. 11 and 12 to the normal first state position shown in FIGS. 3, 4, 7 and 8, the reset member 310 has a bar-shaped portion 312 with an enlarged head formation 312 at the left end of the bar-shaped portion 312, and with the head formation 312 being configured to be engaged when the shackle 120 is depressed after being half-turned (see FIGS. 15 and 16 which shows the shackle 120 before and after being depressed while in the half-turned position), which engagement causes the reset member 310 to be slided rightwardly along the axis of the bar-shaped portion 312 so that a right end region 314 of the bar-shaped portion 312 engages and pivots the indicator member 300 from the second state position depicted in FIGS. 11 and 12 to the first state position depicted in FIGS. 3, 4, 7 and 8. Depression of the shackle 120 as in FIG. 16 brings into engagement with a leftwardly facing cam surface of the enlarged head formation 312 of the reset member 310 one or more of 1) lower end portions of the shackle leg 126, 2) lower portions of the washer-like retaining clip 147, or 3) lower portions of the toothed sleeve 176—which engagement causes the indicator reset member 310 to move rightwardly in opposition to the action of the compression coil spring 315 which is interposed between the housing 110 and the enlarged head formation 312 of the reset member 310 so as to bias the reset member 310 leftwardly.

The reason why the indicator member 300 cannot be reset after the lock 100 has been opened utilizing the key 175 is because: 1) the slide 270 must be moved to the right (by keeping the turned key 175 in place in the lock housing 110) so that its fingers 272, 274, 276 will not obstruct the downward movement of the shackle 120 that is needed to cause the reset member 310 to move rightwardly to reset the indicator 300; and 2) if the slide 270 is moved to the right (as by keeping the turned key 175 in place in the lock housing 110) to permit downward movement of the shackle 120 to effect rightward movement of the reset member 310 to reset the indicator 300, the engagement of the tab 279 on the slide 270 with the tab 309 on the indicator 300 will retain the indicator 300 in its second state position thereby preventing rightward movement of the reset member 310 as the result of downward movement of the shackle 120—thus the indicator 300 cannot be reset while the key 175 remains turned in the lock 100, and the shackle 120 cannot be depressed to reset the indicator 300 after the lock 100 has been opened with the key 175 unless the slide 270 is moved rightwardly by the inserted and turned key 175. The only way the indicator 300 can be reset is by opening the lock 100 by using a correct combination so that, when the slide 270 is depressed to move the reset member 310 rightwardly, none of the downwardly moving teeth 177 of the sleeves 172, 174, 176 (that move downwardly with the shackle 120) will have their downward movement obstructed by the fingers 272, 274, 276 of the slide 270 that must be in its leftward position, otherwise the indicator 300 cannot be reset because the tabs 279, 309 of the slide 270 and the indicator 300 will engage to hold the indicator 300 in the second state position, preventing the resetting of the indicator 300 to the first state position.

In operation, starting with the shackle 120 of the padlock 100 in its closed or locked position as depicted in FIGS. 1 and 3, and starting with the indicator 300 displaying through the indicator window 250 the first state surface 301 (typically of the color "green"), the padlock 100 can be unlocked either by entering a predetermined combination (known to the owner of the lock 100) using the dials 202, 204, 206, or by inserting the key 175 into the keyhole 350 and turning the key 175.

Figure 10:
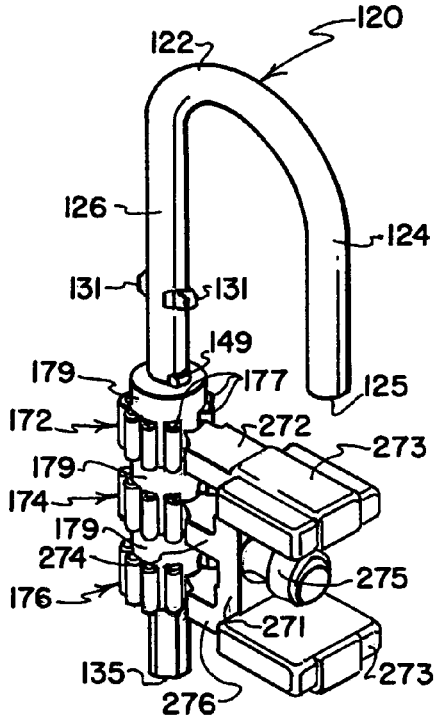
FIG. 10 is a perspective view of selected components of the padlock positioned as in FIGS. 7-9.
Figure 8:
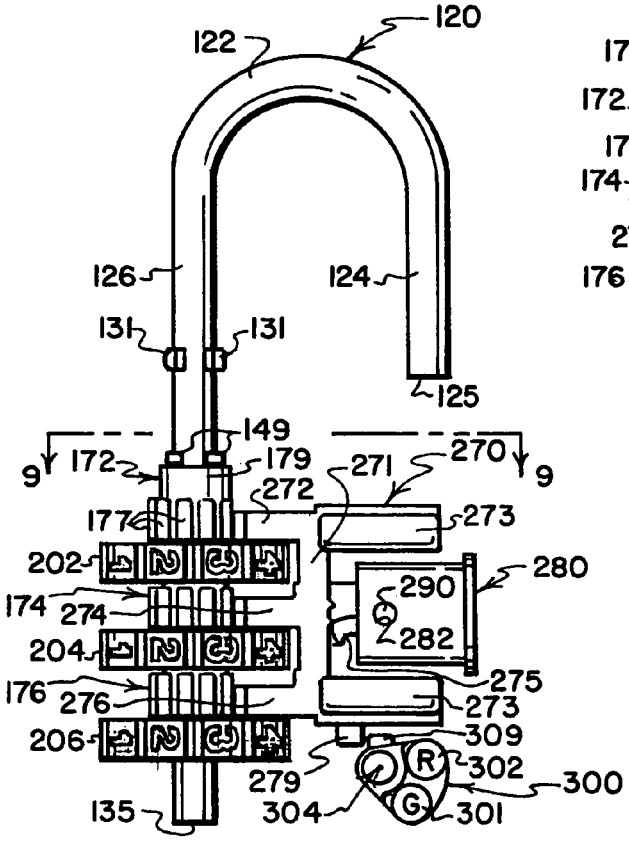
FIG. 8 is a front elevational view showing selected components of the padlock positioned as in FIG. 7.

Opening the padlock 100 by entering the combination involves nothing more than dialing in the combination using the dials 202, 204, 206—so that, when the correct numbers of the combination are aligned with an appropriate portion of the housing 110, the toothless or open-toothed positions of the externally toothed sleeves 172, 174, 176 are aligned with the fingers 272, 274, 276 of the slide 270—which permits the spring 145 to pop up the shackle 120 to the unlocked position of FIG. 7. The alignment of the toothless or open-toothed positions of the sleeves 172, 174, 176 with the fingers 272, 274, 276 is depicted in FIGS. 8-10 which also show that the shackle 120 has popped up relative to the dials 202, 204, 206

(which do not move vertically relative to the housing because the dials 202, 204, 206 are retained in slots 212, 214, 216 of the housing 110).

Once the shackle 120 of the padlock 100 has been opened as by entering a correct combination in the manner just described, any one of three actions can be taken. First, and most obviously, the shackle 120 can be relocked as by depressing the shackle 120 and rotating the dials 202, 204, 206 so that the fingers 272, 274, 276 no longer align with the toothless or open-toothed positions of the toothed sleeves 172, 174, 176. The lock 100 stays locked because the fingers 272, 274, 276 overlie at least some of the teeth 177 of the sleeves 172, 174, 176 which prevents the sleeves 172, 174, 176 (and hence the shackle 120 on which the sleeves 172, 174, 176 are mounted) from moving upwardly to an unlocked position.

A second action that can be taken when the shackle 120 has been opened by entering a correct combination using the dials 202, 204, 206, is to reset the indicator 300 (if the indicator 300 has been moved to its second state position displaying through the window 250 the second state surface 302, typically the color "red"). To reset the indicator 300, the shackle 120 is turned to the half-turned position of FIG. 15 and is depressed as shown in FIG. 16 to cause the reset member 310 to move rightwardly as has been described above to engage and pivot the indicator 300 from its second state position back to its normal first state position wherein the first state surface 301 is displayed through the window 250 (typically the color "green"). Once the indicator 300 has been reset, the shackle 120 is raised and then rotated back so the shorter leg 124 has its lower end region 125 aligned with the housing recess 137 so that the shackle 120 then can be depressed to lock the lock 100.

A third action that can be taken when the shackle 120 has been opened by entering a correct combination using the dials 202, 204, 206, is to reset the combination that is to be employed to open the lock 100 the next time the lock 100 is locked. To do this, the shackle 120 is pivoted to the half-turned position shown in FIG. 15, the shackle 120 is depressed to the position shown in FIG. 16 (which also accomplishes the second action described just above of resetting the indicator 300 if the indicator 300 was displaying the second state surface 302 when the shackle 120 was depressed to the position shown in FIG. 16), and then turning the depressed shackle 120 to the quarter-turned position depicted in FIG. 17.

When the depressed shackle 120 is turned a quarter turn from the depressed shackle position shown in FIG. 16 to the depressed shackle position shown in FIG. 17, it is safe to turn the dials 202, 204, 206 to line up a new combination for operating the padlock 100 the next time that the lock 100 is locked. Actually, the dials 202, 204, 206 could be turned to set a new combination while the shackle 120 is depressed to the position shown in FIG. 16; however, this is a relatively unsafe thing to do for, if the shackle 120 should pop up (under the influence of the spring 145 that acts on the flat bottom end region 135 of the longer leg 126 of the shackle 120), the dials 202, 204, 206 might be caused to set a combination that is unknown to the owner of the lock—a combination that might need to be discovered by endlessly turning the dials 202, 204, 206 while trying many or all of the set of combinations that includes every possible combination that can be set on the lock 100.

What permits the combination to be reset when the shackle 120 is depressed as shown in FIGS. 16 and 17 is that the teeth 177 are disengaged from the teeth 187 during such depression of the shackle 120, which means that the dials 202, 204, 206 may be turned freely without causing corresponding turning of the sleeves 172, 174, 176—thus, while the sleeves 172, 174, 176 are held in their unlocking positions (with the fingers 272, 274, 276 extending into the toothless positions of the sleeves 172, 174, 176 so that the sleeves 172, 174, 176 can not be moved out of their unlocking positions), the dials 202, 204, 206 are reoriented to reflect a combination that will operate the lock when the internal teeth 187 of the dials 202, 204, 206 are brought back into engagement with the external teeth 177 of the sleeves 172, 174, 176.

What renders the quarter-turn shackle position shown in FIG. 17 safer for resetting the combination of the lock 100 than the half-turned position shown in FIG. 17 is that, when the shackle 120 is in the quarter-turned position of FIG. 17, the projections 131 on the longer leg 126 of the shackle 120 underlie the top wall 113 of the padlock's housing 110 to prevent the shackle 120 from accidentally popping up under the influence of the spring 145 which biases the longer leg 126 upwardly relative to the housing 110. If the dials 202, 204, 206 are moved relative to the sleeves 172, 174, 176 while the shackle 120 is being manually depressed as shown in FIG. 16, the person holding the shackle 120 manually depressed in opposition to the action of the spring 145 runs the risk of letting the shackle 120 slip (or of weakening his grip on the depressed shackle 120 enough that the shackle 120 is no longer held in the fully depressed position illustrated in FIG. 16) which may cause some of the teeth 177, 187 to engage, resulting in an unwanted and unknown combination being set.

At the heart of the padlock 100 are pairs of components—relatively movable components—that latchingly engage to "lock" the lock 100, and that disengage to "unlock" the lock 100. The relatively movable components that engage and disengage to lock and unlock the lock 100 are the teeth 177 of the shackle-carried sleeves 172, 174, 176, and the fingers 272, 274, 276 of the slide member 270. If even one of the teeth 177 underlies even one of the fingers 272, 274, 276, the lock 100 is locked; however, if none of the teeth 177 underlie any of the fingers 272, 274, 276, the lock 100 is unlocked because, when this is true, nothing prevents the spring 145 from popping the shackle 120 upwardly to its unlocked position wherein the short leg 124 of the shackle 120 disengages from the housing 110.

When even one of the dials 202, 204, 206 is turned to a position that does not contribute to the setting of a proper combination, the offending dial causes at least one associated tooth 177 of an associated one of the sleeves 172, 174, 176 to underlie at least an associated one of the fingers 272, 274, 276, and, when this is true, the shackle 120 is prevented from popping up to its unlocked position. However, when a proper combination is set, all of the sleeves 172, 174, 176 are turned by the dials 202, 204, 206 to withdraw all of the teeth 177 from beneath all of the fingers 272, 274, 276, which permits the spring 145 to pop the shackle 120 up to its unlocked position.

Likewise, when the key 175 is inserted into the keyhole 350 and turned to turn the key cylinder 280, the slide member 270 moves to retract all of the fingers 272, 274, 276 from positions where the fingers 272, 274, 276 may overlie one or more of the teeth 177 of the sleeves 172, 174, 176, and the spring 145 pops the shackle 120 up to its unlocked position regardless of how the dials 202, 204, 206 are turned (i.e., regardless of the combination that may be set on the dials 202, 204, 206).

Thus, the lock 100 can be unlocked either by setting a proper combination using the dials 202, 204, 206 (which turns of the teeth 177 to positions where none of the teeth 177 underlie and engage any of the fingers 272, 274, 276 of the slide member 270), or by using the key 175 to turn the key cylinder 280 to move the slide member 270 to withdraw the fingers 272, 274, 276 from where they may overlie and engage one or more of the teeth 177. Either the teeth 177 move to disengage the fingers 272, 274, 276, or the fingers 272, 274, 276 move to disengage the teeth 177, to unlock the lock 100.

The indicator 300 responds (to change the visual signal it provides, namely by changing from displaying the color "green" to displaying the color "red" through the indicator window 250) only as the result of movement of the slide member 270 in a particular direction—only as the result of the slide member 270 moving to withdraw the fingers 272, 274, 276 from where they may overlie one or more of the teeth 177. Opposite direction movement of the slide member 270 (which occurs as the result of the key 175 turning the key cylinder 280 back to its normal position so the key 175 can be removed from the keyhole 350 after the key 175 has been inserted into the keyhole 350 and turned to turn the key cylinder 280 to unlock the lock 100 by moving the slide member 270 as just described) does not cause the indicator 300 to reset.

Indeed, movement of the slide member 270 back toward the dials 202, 204, 206 simply causes the depending tab 279 of the slide member 270 to disengage the indicator 300, which leaves the indicator 300 in the position to which it has been moved by the tab 279 when the slide member 270 moved away from the dials 202, 204, 206—a position wherein the indicator 300 displays the color "red" through the indicator window 250.

No movement of any component of the lock 100 that results from manipulation of the dials 202, 204, 206 to set a combination causes the indicator 300 to change the signal provided by the indicator 300. Key usage in the keyhole 350 (which causes the slide member 270 to retract the fingers 272, 274, 276 of the slide member 270 from positions where the fingers 272, 274, 276 may overlie and engage one or more of the teeth 177) is what causes the indicator 300 to change from displaying "green" to displaying "red." What causes the indicator 300 to change from displaying "red" to displaying "green" (i.e., what causes the indicator 300 to reset) is movement of the reset member 310 in response to depression of the shackle 120 in the manner that has been described above—shackle movement that is designed to cause the indicator 300 to reset.

Thus, the indicator 300 moves between its two signalling positions as the result of the movements of two different components of the lock 100—as the result of the slide member 270 being moved when the key 175 is turned to unlock the lock 100, or as the result of the reset member 310 being moved when the shackle 120 is depressed from an unlocked position while being turned to such positions as are depicted in FIGS. 16 and 17 (which can only take place when the key 175 is not being used to unlock the lock 100—hence the indicator 300 is prevented from being reset at times when the key 175 is being used to unlock the lock 100, as has been described above).

Figure 20:
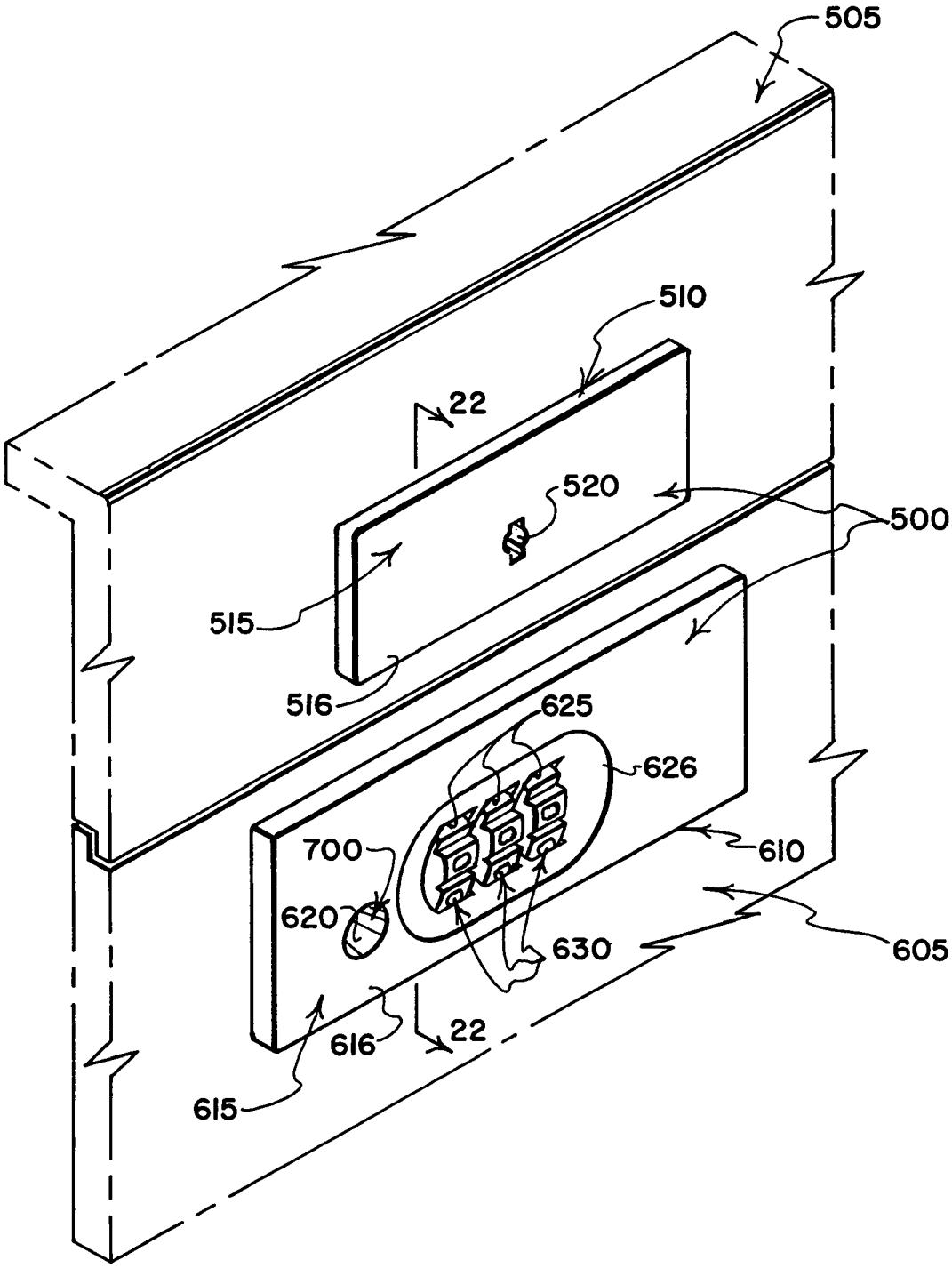
FIG. 20 is a perspective view showing engaged portions of a two relatively movable hardcase structures such as hinge connected halves of a suitcase or briefcase, and showing upper and lower assemblies of a lock that can be operated by use of a key or by setting a combination, wherein an upper frontplate cover of the lock is seen to define a keyhole of a key operated mechanism of the lock, and wherein a lower frontplate cover of the lock is seen to define both a window of an indicator and a recess into which extend dials of a combination operated mechanism of the lock.

Referring to FIG. 20, a different form of lock 500 is shown that has separable assemblies 510, 610 which can be latched and/or locked together, or released, either by setting a combination on dials 630, or by using a key in a keyhole 520. In addition to having a key operated mechanism and a combination operated mechanism, the lock 500 also has an indicator member 700 that can move (like the indicator 300 of the padlock 100) in response to key usage, and that can be reset when no key is being used.

The assemblies 510, 610 have frontplate covers 515, 615 that are shown as being generally rectangular, but can take a variety of desired shapes so long as they protectively overlie appropriate surface areas of the hardcase structures 505, 605 shown in FIG. 20. The keyhole 520 (referred to just above) opens through a front surface 516 of the frontplate cover 515 to receive one or more keys configured to operate a "key usage responsive mechanism" or "key mechanism" of the upper assembly 510 to unlock the lock 500, as will be explained. An indicator window 620 opens through a front surface 616 of the frontplate cover 615 so surface portions of the movable indicator member 700 (located behind the frontplate cover 615) can be viewed, as will be explained. A recess 626 defined by the frontplate cover 615 opens through the front surface 616, and peripheral portions of three dials 630 of a "combination responsive mechanism" or "combination mechanism" of the lower assembly 610 extend into the recess 626 where the dials 630 can be accessed and turned to set and display a combination to unlock the lock 500, as will be explained.

The upper assembly 510 has a number of components (best seen in FIG. 38) including a key cylinder 560 that can turn within a housing 524. The key cylinder 560 has a key receiving opening 559 that aligns with the keyhole 520 of the frontplate cover 515, and can be turned (by a key inserted through the keyhole 520 and received in the opening 559) a quarter turn to and from the normal position of the key cylinder 560 depicted in FIGS. 38 and 40.

Figure 38:
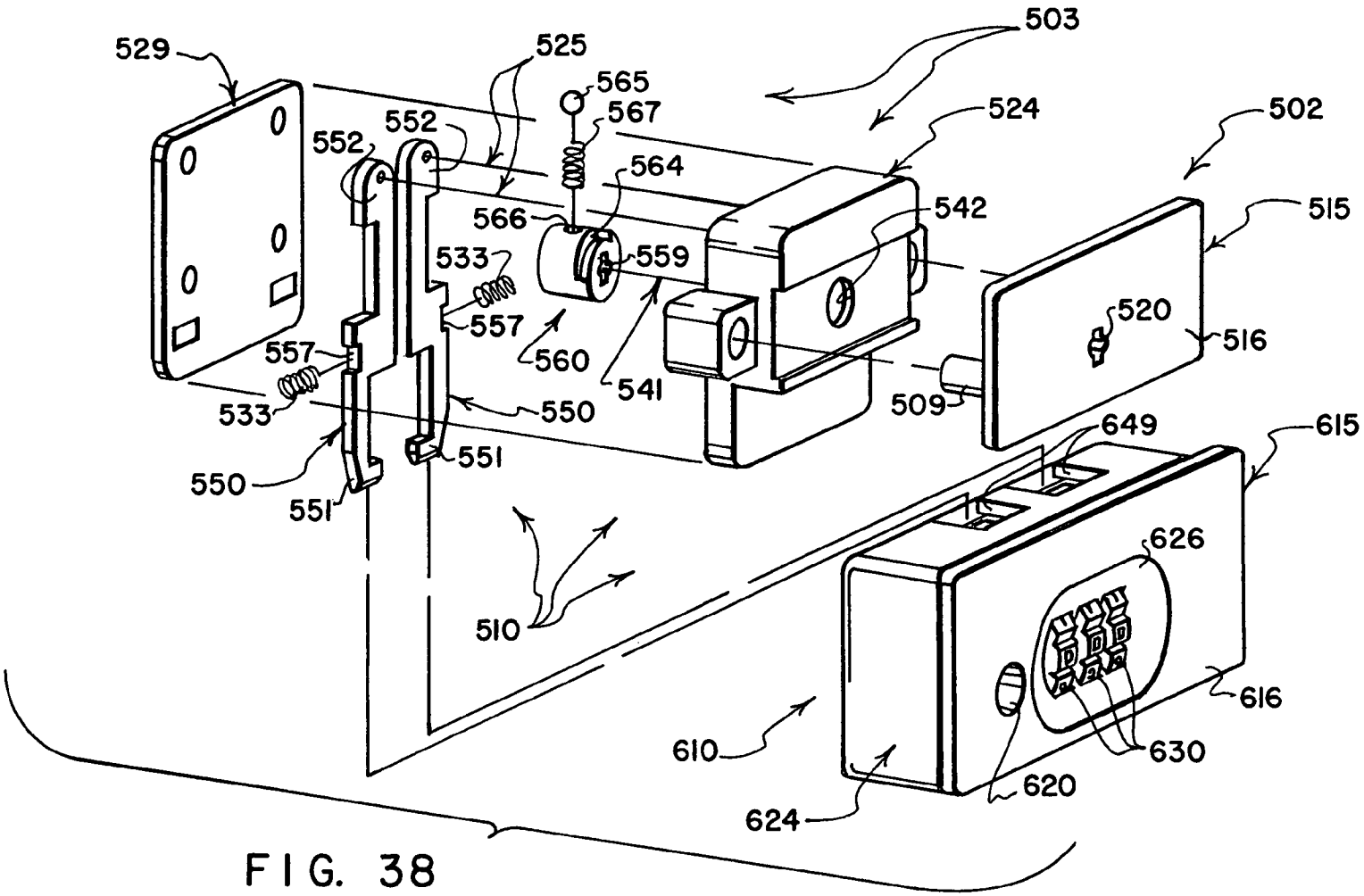
FIG. 38 is a partially exploded perspective view similar to FIG. 22 but with components of the upper assembly separated so their features can be seen.

As depicted in FIG. 38, the key receiving opening 559 is designed to receive the same key 175 that is shown in FIGS. 1, 2 and 11-14, thereby making it possible for the same key 175 to be inserted into both of the key cylinders 280, 560 to unlock both of the locks 100, 500. However, as those who are skilled in the art will readily understand, other well known types of key cylinders (not shown) can be substituted for one or both of the key cylinders 280, 560 to enable one or both of the locks 100, 500 to be unlocked by keys of various other configurations; and, if desired, the substituted key cylinders can be masterkeyed in conventional ways well known to those who are skilled in the art to enable one or both of the locks 100, 500 to operate in response to plural keys, for example, one or more keys controlled by the lock owner, and/or one or more keys controlled by government authorized inspectors.

Although the assemblies 510, 610 are referred to occasionally herein by the terms "upper" and "lower," it will be understood that neither of the assemblies 510, 610 need be installed in any particular orientation relative to the other, nor do either of the assemblies 510, 610 need to be installed above or below the other. Nonetheless, because the drawings depict the assembly 510 atop the assembly 610, the assembly 510 is occasionally referred to herein as "the upper assembly," and the assembly 610 is occasionally referred to herein as "the lower assembly."

The assemblies 510, 610 of the lock 500 can be installed on or connected to relatively movable elements of a wide variety of structures and devices that need to be latched together at selected times, and released from latched engagement at other times. In FIG. 20, for example, the assemblies 510, 610 of the lock 500 are shown installed on relatively movable hardcase structures 505, 605—structures that can move into and out of engagement with each other, such as the hinge connected halves of a hardcase, typically a briefcase, suitcase or other form of luggage, travel case, trunk, shipping container or the like.

Figure 22:
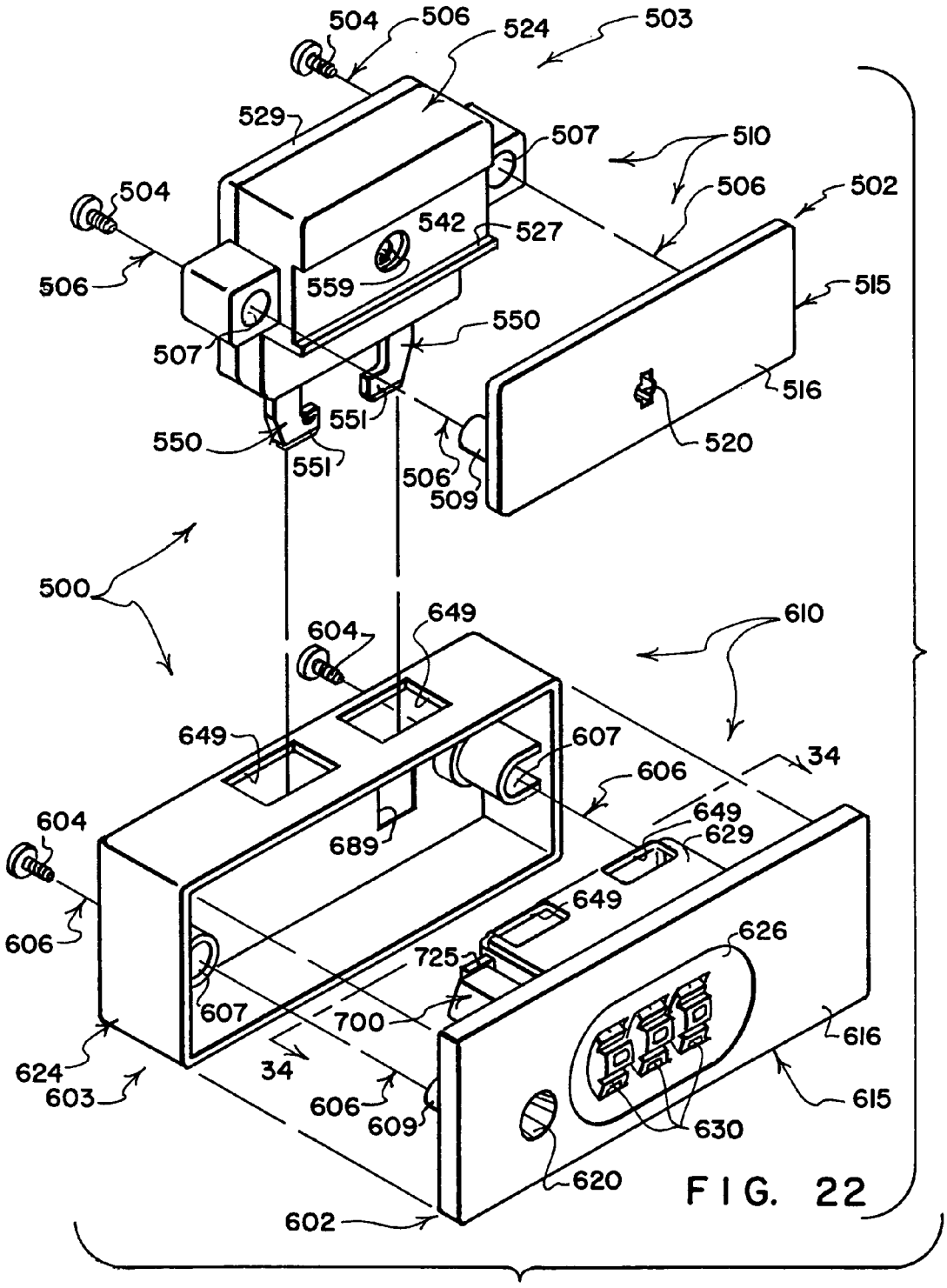
FIG. 22 is a partially exploded perspective view showing the upper and lower assemblies of the lock each separated into front and rear units that can be connected by the depicted fasteners.

Referring to FIG. 22, the upper assembly 510 consists of a front unit 502 and a rear unit 503 that can be connected by fasteners 504; and the lower assembly 610 consists of a front unit 602 and a rear unit 603 that can be connected by fasteners 604. The frontplate covers 515, 615 have tubular formations 509, 609 that extend rearwardly along axes indicated by numerals 506, 606 to receive the fasteners 504, 604 after the fasteners 504, 604 are inserted through openings 507, 607 of the rear units 503, 603, respectively. Although only one of each of the tubular formations 509, 609 is shown in FIG. 22, it will be understood that the frontplate cover 515 defines two of the formations 509 which are identical one with the other, and that the frontplate cover 615 defines two of the formations 609 which are identical one with the other.

The fasteners 504, 604 may take the form of screws that thread into the tubular formations 509, 609 of the frontplate covers 515, 615, or may take a wide variety of other commercially available forms that permit the fasteners 504, 604 to be retained in, after being inserted into, the tubular formations 509, 609 to securely connect the front units 502, 602 to the rear units 503, 603, respectively.

Figure 23:
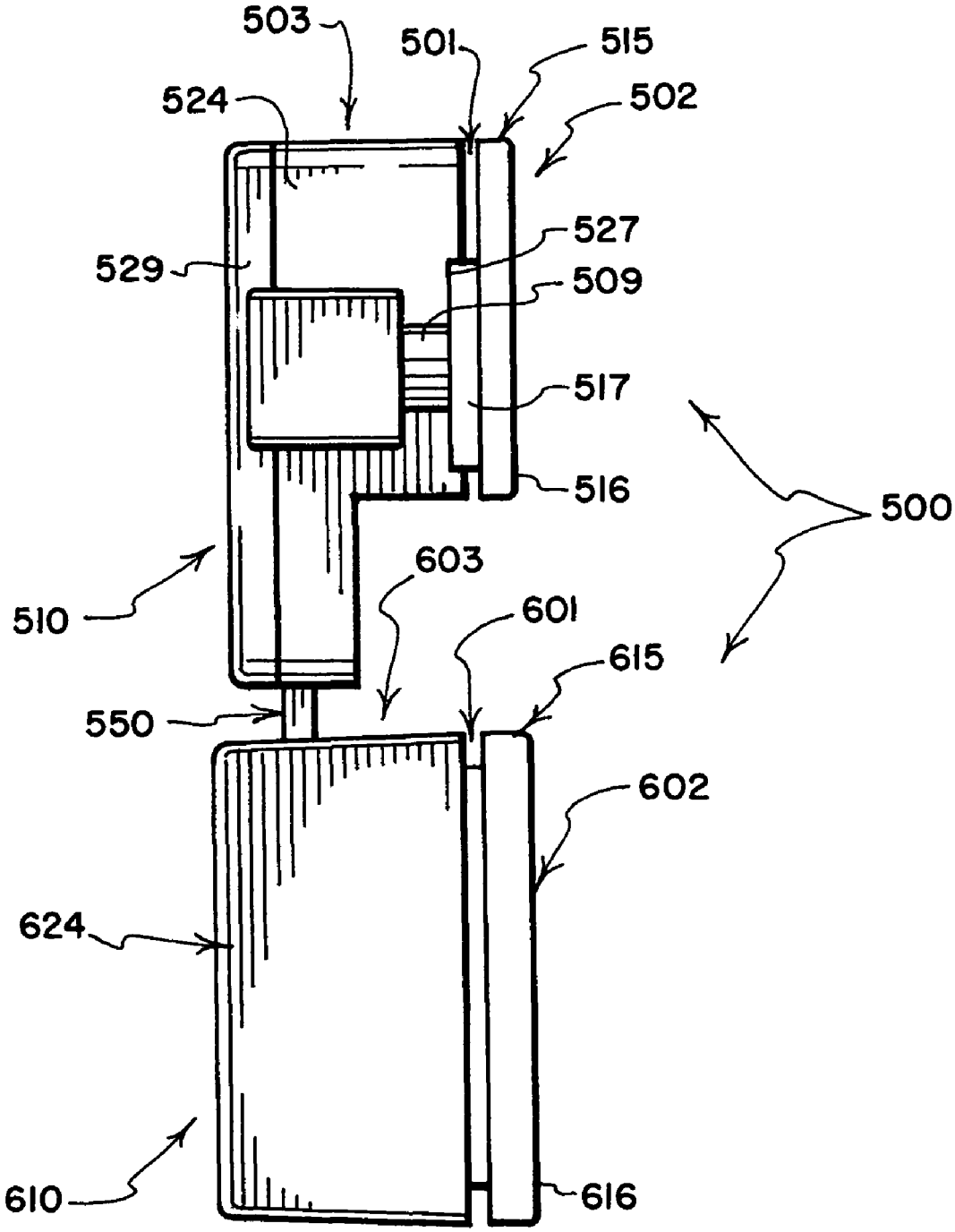
FIG. 23 is a left side view of the upper and lower assemblies latchingly engaged.

The front unit 502 of the upper assembly 510 consists of the frontplate cover 515. If desired, the front surface 516 of the frontplate cover 515 can carry trademarks, logos, identification indicia and the like (not shown). Strengthening the frontplate cover 515 to resist bending and breakage is a bar shaped formation indicated by the numeral 517 in FIGS. 23-27. The bar shaped formation 517 bridges between the tubular formations 509, and is an integrally formed feature of the one-piece frontplate cover 515. When the front and rear units 502, 503 are connected by the fasteners 504, the bar shaped formation 517 is received in a forwardly opening notch 527 of the housing 524 of the rear unit 503, as can be seen in FIGS. 23, 27 and 28.

The rear unit 503 of the upper assembly 510 includes a housing 524 and a rear cover 529 that cooperate to enclose operating components (described shortly) that can unlock the lock 500 in response to use of a key in the keyhole 520, including a pair of substantially S-shaped arms 550 (best seen in FIG. 38). The arms 550 have hook shaped lower end regions 551 that depend from the housing 524 and can latchingly engage a latch bolt 650 (best seen in FIGS. 32, 33 and 39) of the front unit 602 of the lower assembly 610, as will be explained.

Figure 39:
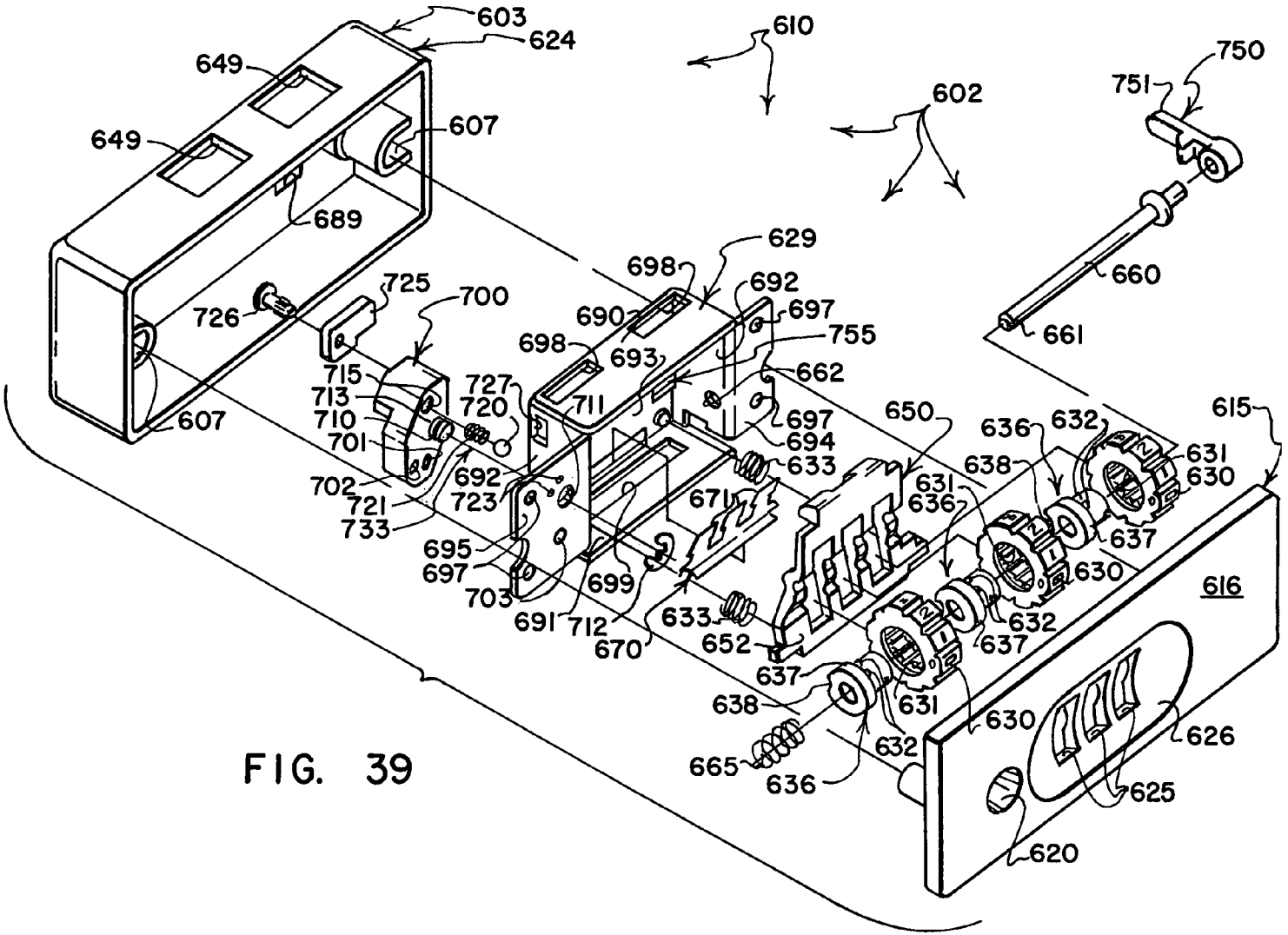
FIG. 39 is an exploded perspective view showing components of the lower assembly separated so their features can be seen.

The front unit 602 of the lower assembly 610 includes the frontplate cover 615 and a shroud 629 that cooperate to protectively enclose the latch bolt 650 and other components that are shown in FIG. 39 and described later herein. The latch bolt 650 has a complex shape that defines two identical receiving formations 651 (best seen in FIGS. 32 and 33) each of which can receive and latchingly engage a separate one of the hook shaped end regions 551 of the arms 550. If desired, the front surface 616 of the frontplate cover 615 can carry trademarks, logos, identification indicia and the like (not shown). The front unit 602 also includes the movable indicator member 700 and a rearwardly extending reset lever 750 shown in FIGS. 34-37—components that operate in a manner explained in a later portion of this description.

Figure 24:
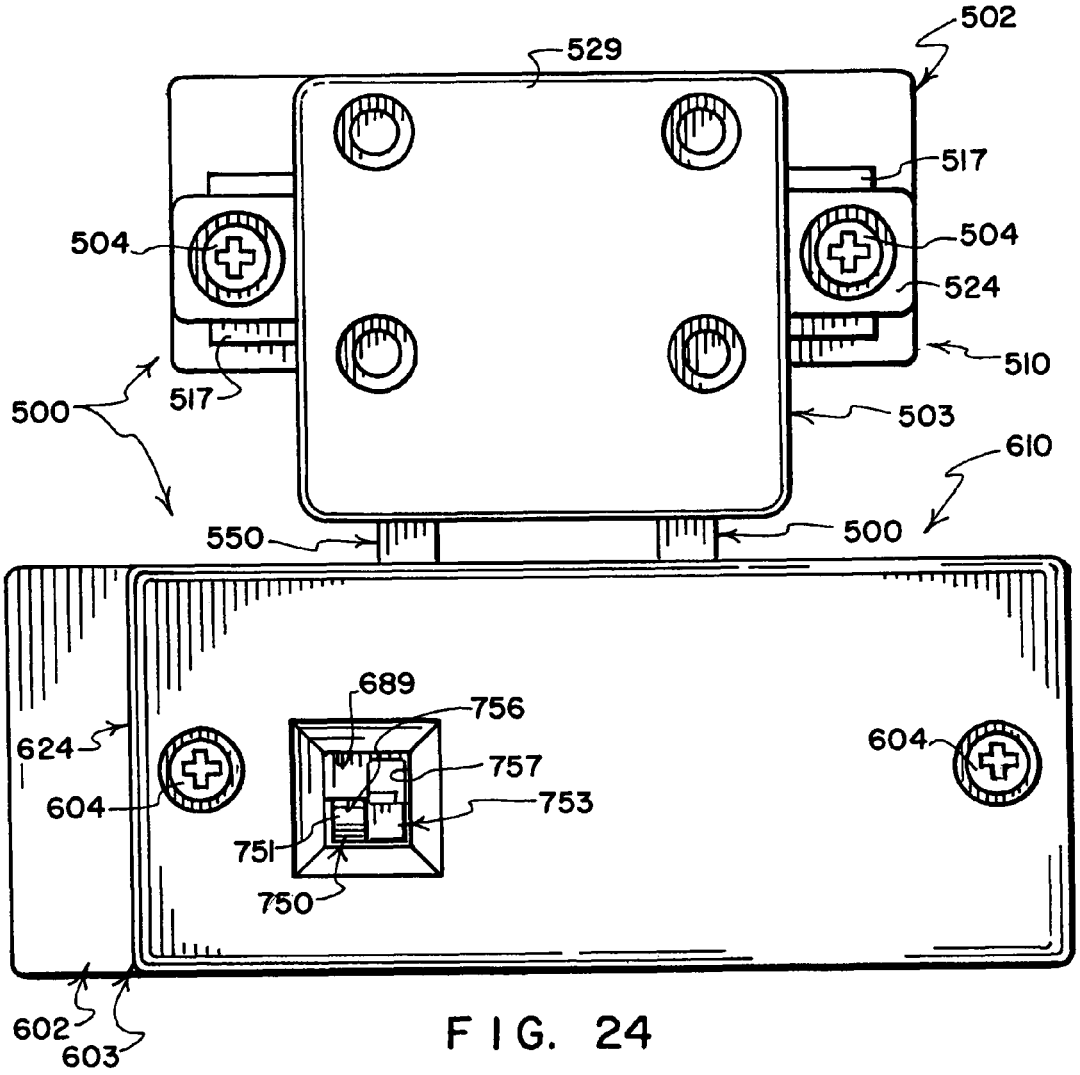
FIG. 24 is a rear view of the latchingly engaged upper and lower assemblies, and showing a reset lever in its normal position in an L-shaped opening.

Referring to FIGS. 22 and 39, the rear unit 603 of the lower assembly 610 includes a generally rectangular enclosure 624 that extends about rear portions of the front unit 602. The enclosure 624 defines not only the holes 607 through which the fasteners 604 extend, but also a pair of openings 649 through which the hook shaped lower end regions 551 of the arms 550 can extend (when the assemblies 510, 610 are latchingly engaged), and a rear opening 689 through which access can be had to the reset lever 750, as can be seen in FIG. 24.

Figure 21:
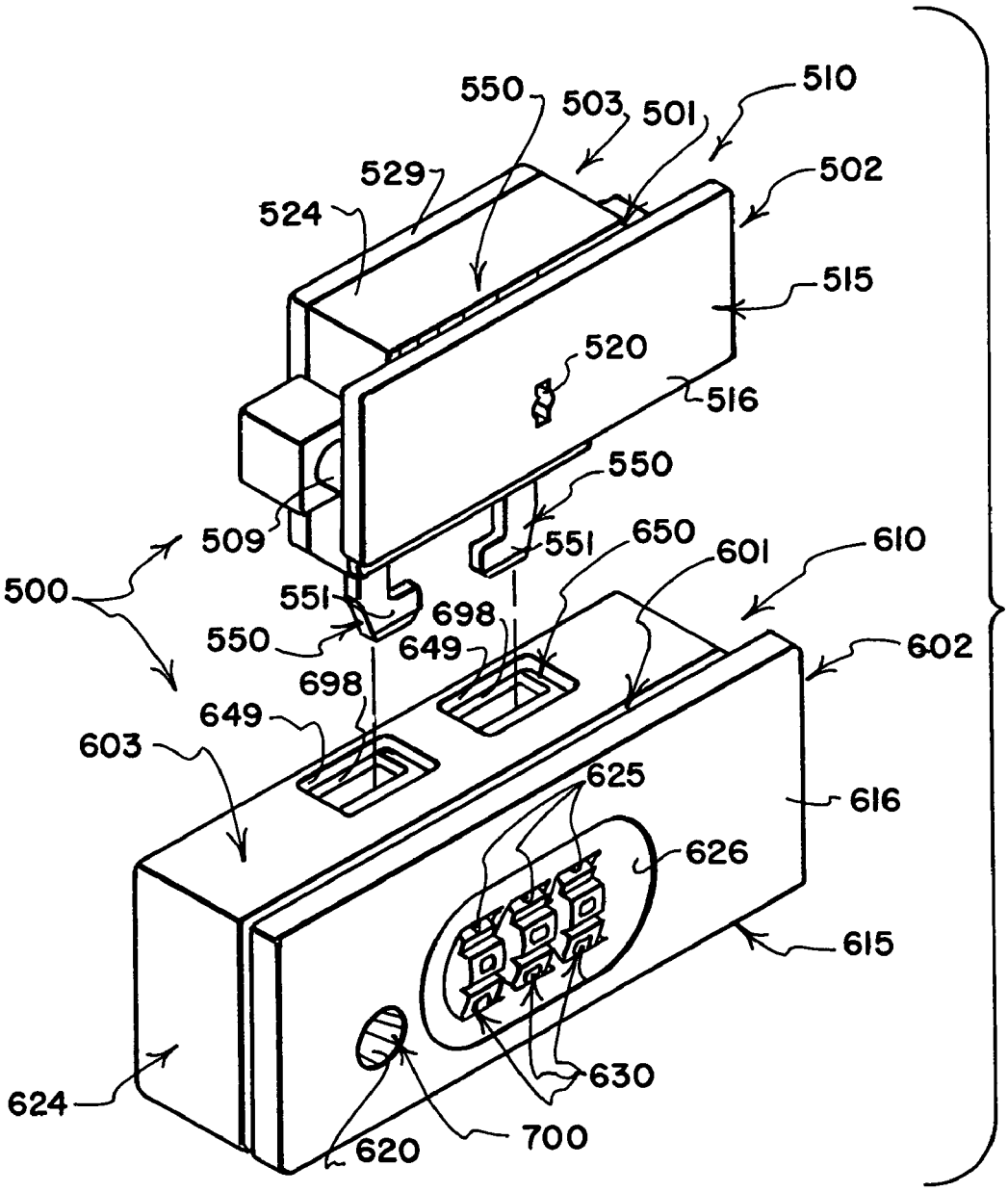
FIG. 21 is a perspective view showing the upper and lower assemblies of the lock with their frontplate covers installed.

Referring to FIGS. 21 and 23, when the front units 502, 602 are connected (by the fasteners 504, 604 of FIG. 22) to the rear units 503, 603, a space 501 (which separates portions of the front and rear units 502, 503) is provided just behind the frontplate cover 515—a space 501 that extends along the perimeter of the rear surface of the frontplate cover 515; and a similar space 601 (which separates portions of the front and rear units 602, 603) is provided just behind the frontplate cover 615 and extends along the perimeter of the rear surface of the frontplate cover 615. The spaces 501, 601 receive portions of the hardcase structures 505, 605 of FIG. 20—portions that surround mounting openings (not shown) that are formed through the hardcase structures 505, 605 at locations where the upper and lower assemblies 510, 610 of the lock 500 are to be installed on the hardcase structures 505, 605. Such mounting openings as are provided through the hardcase structures 505, 605 are closed by the frontplate covers 515, 615.

The spaces 501, 601 are of substantially uniform width, as are the hardcase portions that extend into the spaces 501, 601. Such portions of the hardcase structure 505 as extend into the space 501 are sandwiched between and clamped by the front and rear units 502, 503 of the upper assembly 510 (when the fasteners 504 are tightened into, or otherwise fully installed in the rearwardly projecting tubular formations 509 of the frontplate cover 515). In like manner, such portions of the hardcase structure 605 as extend into the space 601 are sandwiched between and clamped by the front and rear units 602, 603 of the lower assembly 610 (when the fasteners 604 are tightened into, or otherwise fully installed in the rearwardly projecting tubular formations 609 of the frontplate cover 615).

To install the front units 502, 602 and the rear units 503, 603 on the hardcase structures 505, 605 in the manner illustrated in FIG. 20, the tubular formations 509, 609 are inserted into the aforementioned mounting openings that are formed through the hardcase structures 505, 605; and the fasteners 504, 604 are installed to extend along the axes 506, 606 (as depicted in and described in conjunction with FIG. 22) to draw the front units 502, 602 and the rear units 503, 603 toward each other to sandwich and clamp such portions of the hardcase structures 505, 605 as extend into the spaces 501, 601, respectively.

Figure 25:
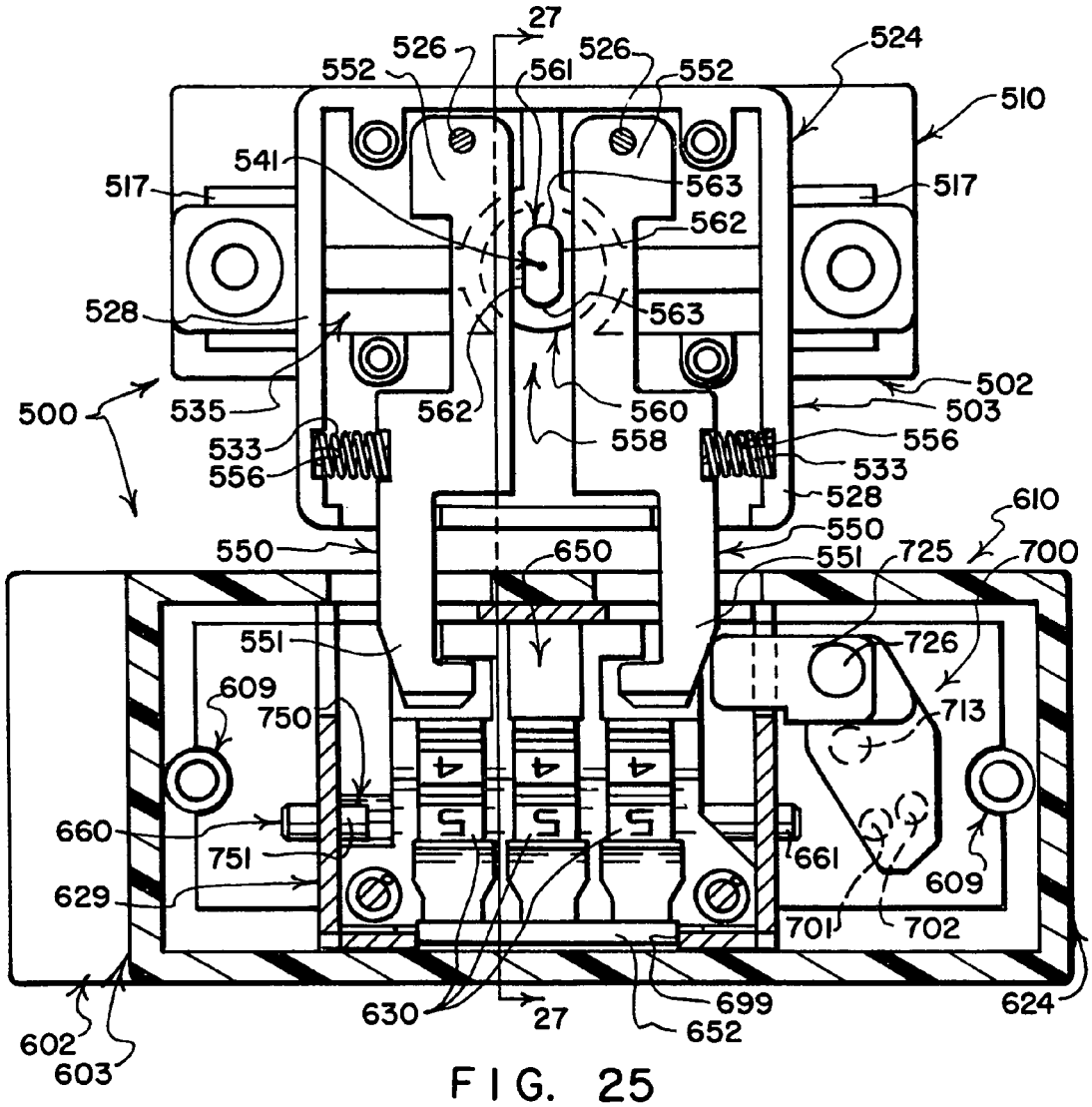
FIG. 25 is a rear view similar to FIG. 24 but with a rear cover removed from the upper assembly, and with portions of the lower assembly cut away and shown in cross-section to permit viewing of the latched engagement between arms that depend from the upper assembly and a latch bolt of the lower assembly, and showing a movable indicator member of the lock in its normal position.
Figure 32:
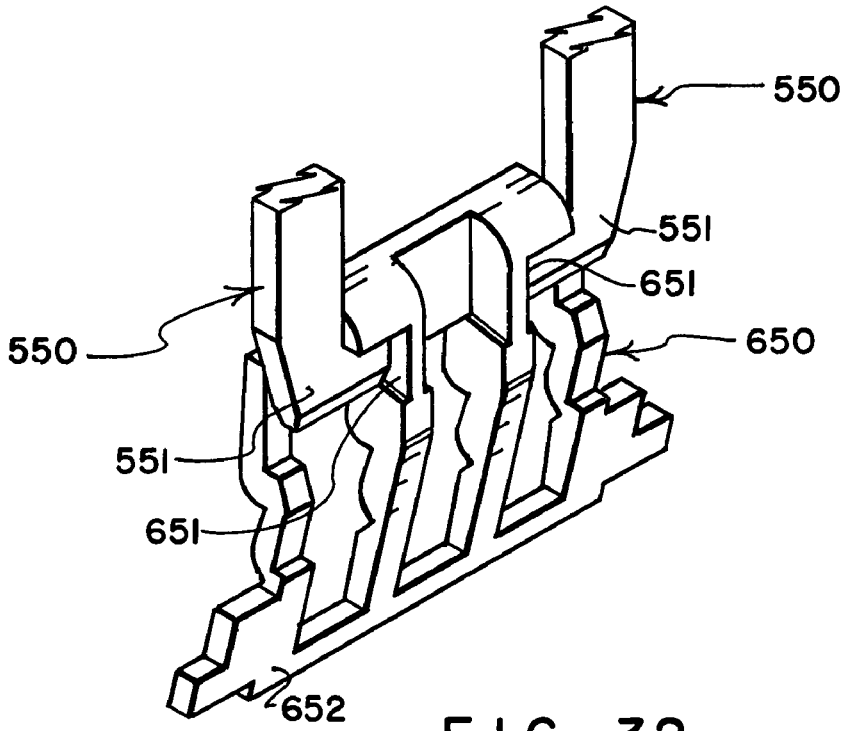
FIG. 32 is a perspective view more completely showing the complex configuration of the latch bolt, and showing hook shaped lower end regions of the latching arms of the upper assembly in latched engagement with concavely shaped receiving formations defined by upper portions of the latch bolt of the lower assembly.

What enables the assemblies 510, 610 of the lock 500 to hold the hardcase structures 505, 605 together (in a closed relationship such as is depicted in FIG. 20) are the hook shaped end regions 551 of the arms 550 that extend from the upper assembly 510 and latchingly engage the previously mentioned receiving formations 651 of the latch bolt 650 of the lower assembly 610. When the upper and lower assemblies 510, 610 are properly latchingly engaged, the hook shaped end regions 551 of the arms 550 depend from the upper assembly housing 524, extend through the openings 649 of the lower assembly enclosure 624, and are received within the concavely configured receiving formations 651 of the latch bolt 650—but this is true (i.e., a condition of proper latched engagement between the end regions 551 and the receiving formations 651 exists) 1) only if the latch bolt 650 is in its latched position as depicted in FIG. 27 (not when the latch bolt 650 is pivoted to its unlatched position as shown in FIG. 28), and 2) only if the arms 550 are in their normal positions as depicted in FIGS. 25 and 32 (not when the arms 550 are pivoted to their key-operated positions shown in FIGS. 26 and 33). Should either the condition shown in FIG. 28 or the condition shown in FIGS. 26 and 33 exist, there is no latched engagement between the arm end regions 551 and the receiving formations 651, therefore the lock 500 is not locked and the hardcase structures 505, 605 are free to separate from the engaged position shown in FIG. 20.

The lock 500 can be said to be "properly locked" (as it is intended to be locked) only when both of the S-shaped arms 550 latchingly engage the latch bolt 650—i.e., only when each of the hook shaped end regions 551 is received in a separate one of the receiving formations 651. However, as a practical matter, the lock 500 is "locked" (in the sense that it prevents the hardcase structures 505, 605 from moving out of the engaged position shown in FIG. 20) when either of the hook shaped end regions 551 is properly seated in an associated one of the concave receiving formations 651 in the manner illustrated in FIGS. 25, 27, 31 and 32. Therefore, should one of the arms 550 or a portion of the latch bolt 650 be broken or damaged in a way that permits only one of the 551/651 engagements to remain operable, the lock 500 may remain partially serviceable until it can be repaired or replaced to fully restore its desired characteristics of operation.

Because even a single latched engagement between one of the hook shaped end regions 551 and one of the receiving formations 651 prevents the hardcase structures 505, 605 from moving apart (out of the engaged position shown in FIG. 20), each of the end-region-to-receiving-formation engagements 551/651 serves to "backup" the latching action of the other, and both of these latched engagements (not just one of them) must be defeated if the action of the lock 500 in maintaining the closed engagement of the hardcase structures 505, 605 is to be defeated by attempts to pry open the lock 500, or to pry apart the hardcase structures 505, 605.

Figure 26:
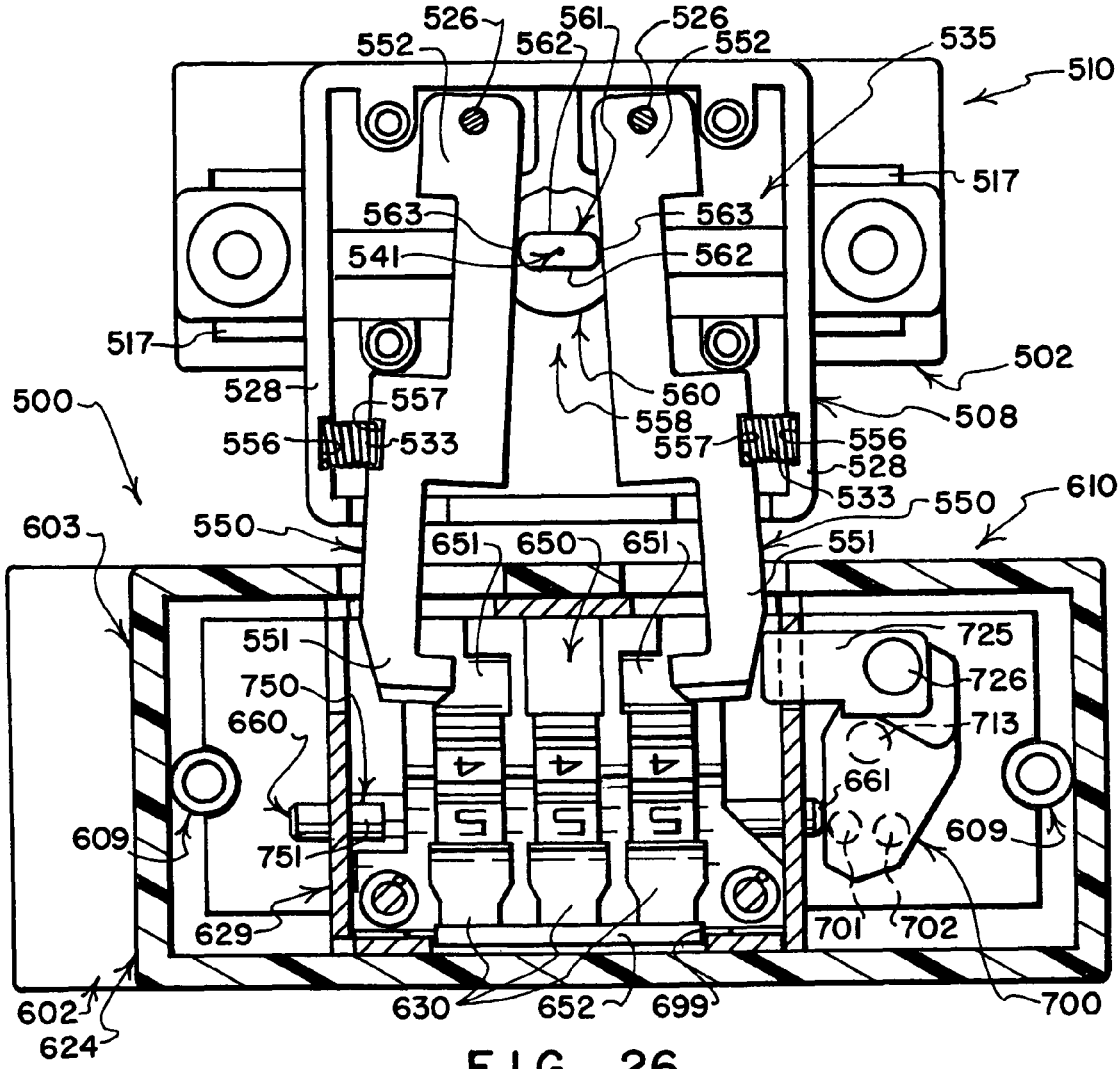
FIG. 26 is a rear view similar to FIG. 25 but with latching arms of the upper assembly pivoted away from each other to disengage the latch bolt of the lower assembly, and with the movable indicator member pivoted from its normal position to an operated position.
Figure 27:
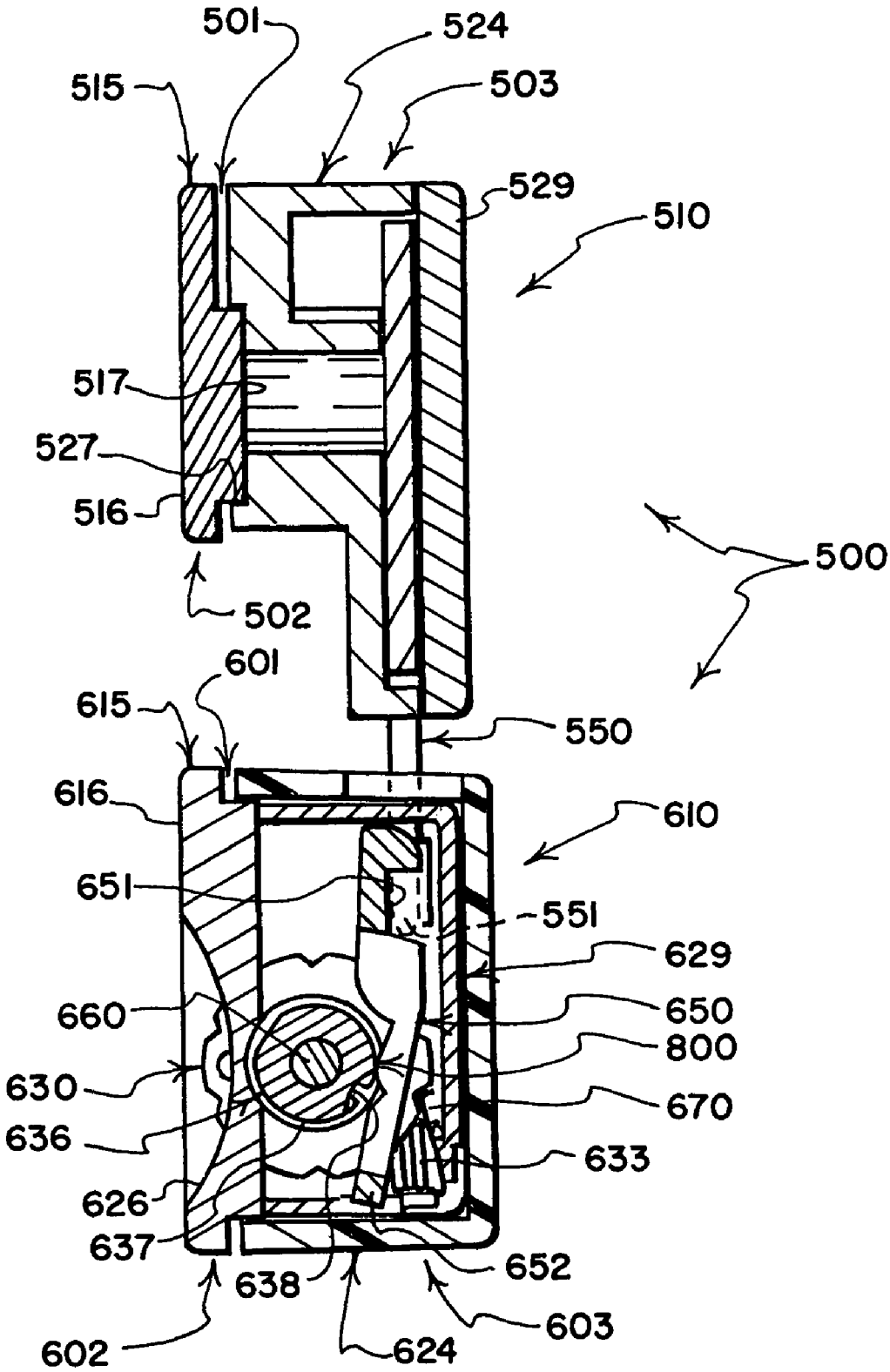
FIG. 27 is a sectional view through the latchingly engaged upper and lower assemblies of the lock, as seen from a plane indicated by a line 27-27 in FIG. 25.
Figure 28:
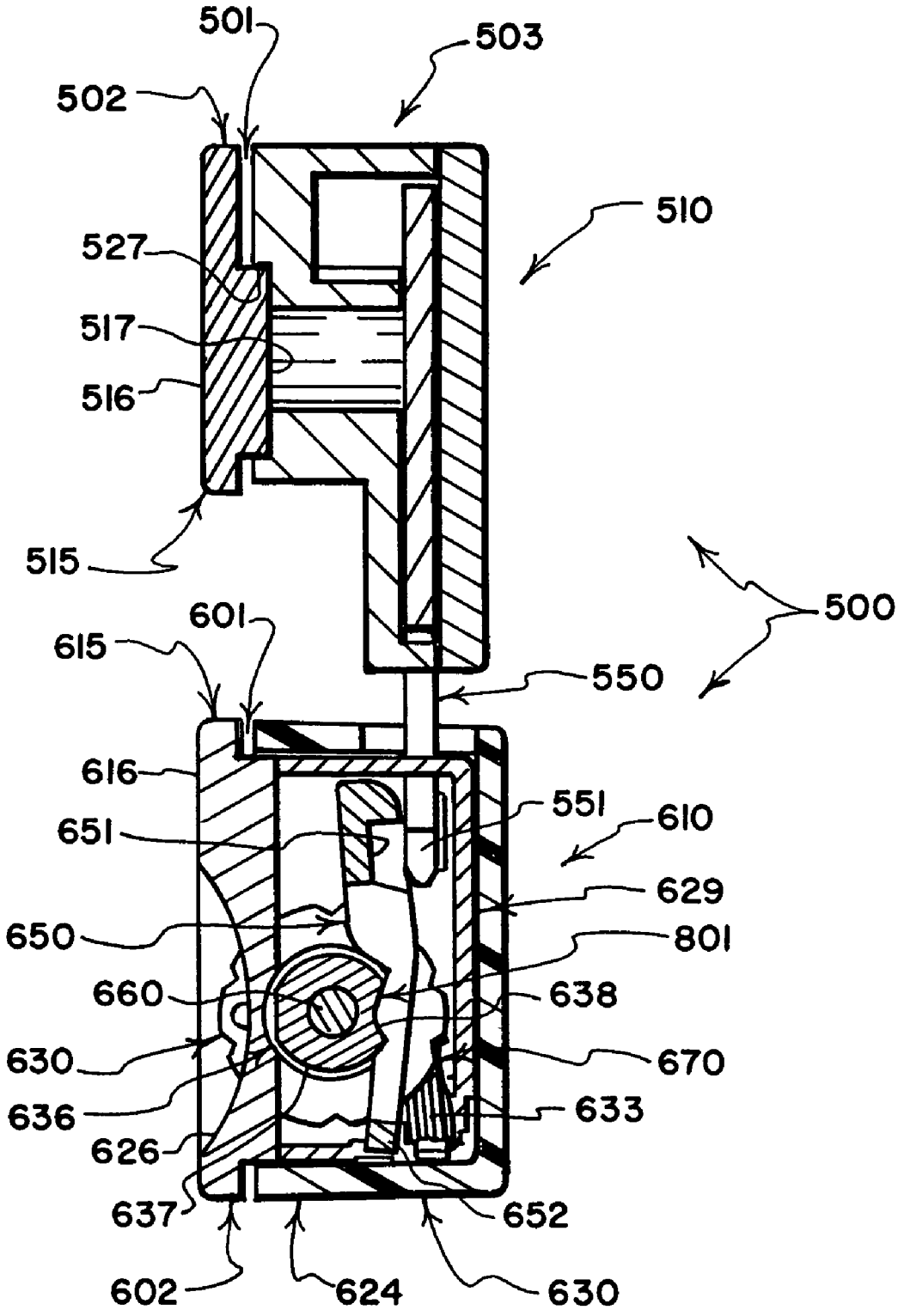
FIG. 28 is a sectional view similar to FIG. 27 but with the latch bolt of the lower assembly pivoted to disengage the latching arms of the upper assembly.
Figure 33:
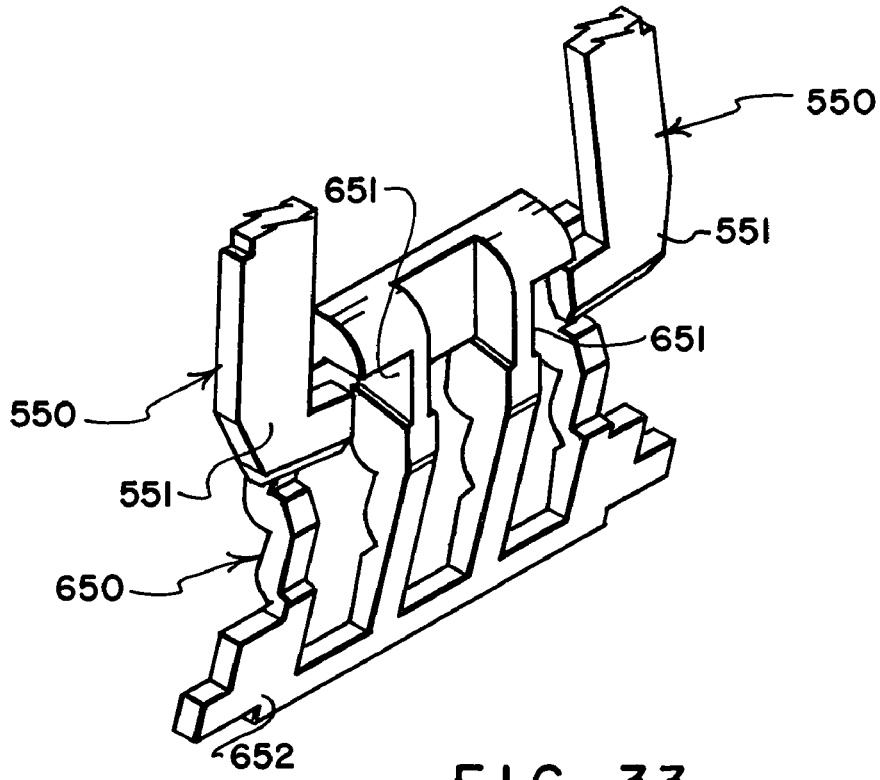
FIG. 33 is a perspective view similar to FIG. 32 but showing the hook shaped lower end regions of the latching arms pivoted out of latched engagement with the receiving formations of the latch bolt.

The lock 500 can be "unlocked" (i.e., the arms 550 and the latch bolt 650 can be caused to release from latched engagement—or, more specifically, the hook shaped end regions 551 and the receiving formations 651 can be caused to disengage) by either of two methods: 1) by using the dials 630 to set a proper combination which causes the latch bolt 650 to pivot from the latched position shown in FIG. 27 to the unlatched position shown in FIG. 28 (explained shortly), or 2) by using a key to pivot the arms 550 from the latched positions shown in FIGS. 25 and 32 to the unlatched positions shown in FIGS. 26 and 33 (also explained shortly).

Stated in another way, the lock 500 is unlocked either by moving the hook shaped end regions 551 out of engagement with the receiving formations 651, or by moving the receiving formations 651 out of engagement with the hook shaped end regions 551. Regardless of whether the arms 550 move to disengage the latch bolt 650, or whether the latch bolt 650 moves to disengage the arms 550, either of these "unlatching" kinds of movement will free the hardcase structures 505, 605 to separate as by moving away from each other so that contents can be added to or removed from a hardcase compartment (not shown) that is closed when the hardcase structures 505, 605 are moved together to the engaged position shown in FIG. 20.

The arrangement of the lock 500 just described—an arrangement whereby either the arms 550 or the latch bolt 650 can move to release the latched engagement of the arms 550 and the latch bolt 650—is similar to the arrangement described previously in conjunction with the lock 100 wherein either the teeth 177 can move to disengage the fingers 272, 274, 276, or the fingers 272, 274, 276 can move, in unison, to disengage the teeth 177. In each of these arrangements, paired components latchingly engage to "lock" the lock, and the lock can be "unlocked" by moving either of the paired components that latchingly engage when the lock is "locked."

The concave character of the identical receiving formations 651 of the latch bolt 650 can be seen in FIG. 33 (where the hook shaped end regions 551 are shown pivoted out of latched engagement with the receiving formations 651 thereby providing a better view of the receiving formations 651 than is offered by FIG. 32). How the arms 550 pivot in opposite directions in response to the key cylinder 650 being turned by a key is shown in FIG. 26—and how the oppositely pivoting arms 550 withdraw the hook shaped end regions 551 from the receiving formations 651 is shown in FIG. 33.

Figure 40:
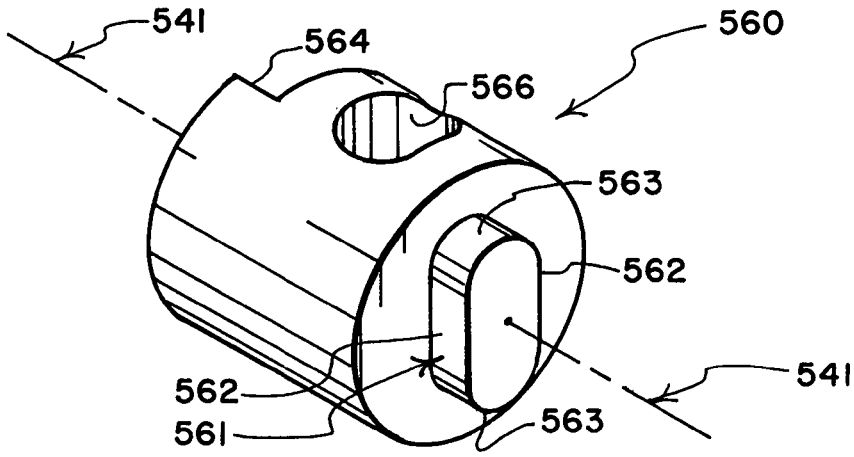
FIG. 40 is a perspective view on an enlarged scale showing some of the features of a key cylinder of the upper assembly of the lock.

Referring to FIGS. 38 and 40, the key cylinder 560 has a generally cylindrical shape that extends from a front end region which defines the previously mentioned key receiving opening 559 (FIG. 38) to a rear end region that defines a projection 561 (FIG. 40) which extends rearwardly into a space 558 (FIGS. 25 and 26) located between upper end regions 552 of the arms 550. Referring to FIGS. 25, 26 and 40, the projection 561 has an elongate shape bordered by parallel sides 562 and smoothly rounded ends 563.

When the key cylinder 560 is in its normal position, as shown in FIGS. 25, 38 and 40, the sides 562 of the projection 562 substantially parallel the upper end regions 552 of the arms 550. When the key cylinder 560 is turned a quarter turn from the normal position of FIG. 25 to the key operated position shown in FIG. 26, the rounded ends 563 of the projection 561 press against the upper end regions 552 of the arms 550, causing the arms 550 to pivot away from each other about the axes 525 (FIG. 38) of pin like formations 526 (FIGS. 25, 26 and 41) of the housing 524—pin like formations 526 that pivotally connect the arms 550 to the housing 524.

When the key cylinder 560 is turned to oppositely pivot the arms 550 as depicted in FIG. 26, the hook shaped lower end regions 551 of the arms 550 are caused to withdraw from the receiving formations 651 in the manner shown in FIGS. 26 and 33 to unlock the lock 500. The oppositely directed pivotal movement executed by the arms 550 as they move from the position of FIG. 25 to the position shown in FIG. 26 is opposed by a pair of compression coil springs 533 that are interposed between sidewalls 528 (FIGS. 25, 26 and 41) of the housing 524 and the hook shaped lower end regions 551 of the arms 550. When the key cylinder 560 is turned by a key back to its normal, non-operated position as depicted in FIG. 25, the springs 533 cause the arms 550 to return to their normal non-operated positions also shown in FIG. 25—positions wherein the hook-shaped end regions 551 can latchingly engage the receiving formations 651 of the latch bolt 650.

When the arms 550 are pivoted to their operated positions shown in FIG. 26 (which can result from use of a key by a government authorized inspector to unlock the lock 500 so the hardcase structures 505, 605 can be separated to inspect contents of an associated piece of luggage or the like), the arms 550 can be returned to their normal positions shown in FIG. 25 while the hardcase structures 505, 605 are still separated (i.e., while the associated piece of luggage still is open) by reverse turning the key cylinder 560 and withdrawing the key through the keyhole 520 from the key cylinder opening 559. In such a situation, the assemblies 510, 610 need to be able to be slammed together to relock the piece of luggage. How a typical one of the hook shaped lower end regions 551 of the arms 550 can be slammed or otherwise moved into latching engagement with the latch bolt 650 is illustrated in the sequence of views provided by FIGS. 29-31.

Figure 29:
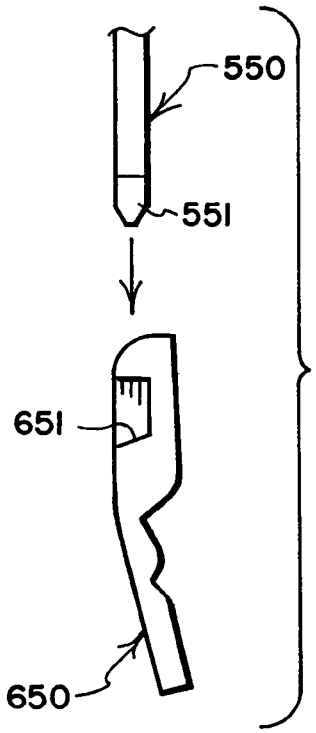
FIG. 29 is a side elevational view showing a lower portion of one of the latching arms of the upper assembly moving downwardly toward a receiving formation defined by an upper portion of the latch bolt of the lower assembly.
Figure 30:
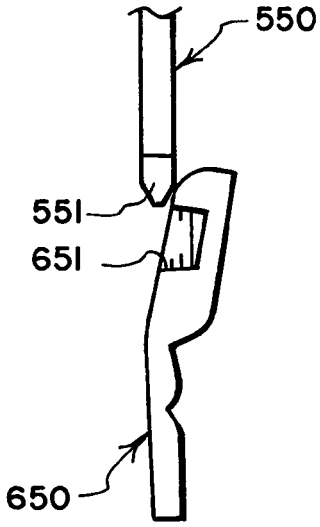
FIG. 30 is a side elevational view similar to FIG. 29 but with the lower end portion of the latching arm engaging and moving the upper portion of the latch bolt as the latching arm continues its downward movement.
Figure 31:
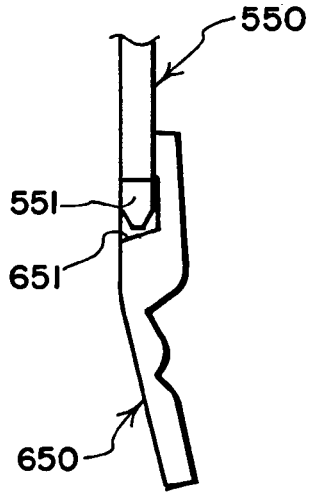
FIG. 31 is a side elevational view similar to FIGS. 29 and 30 showing a receiving formation defined by the upper end region of the latch bolt latchingly engaging the lower end region of the latching arm.

When the separated hardcase structures 505, 605 are moved toward each other (i.e., toward an engaged position as shown in FIG. 20), the hook shaped lower end regions 551 of the arms 550 move toward the latch bolt 650 in the manner illustrated in FIG. 29 (where one of the end regions 551 of one of the arms 550 is shown as it approaches one of the receiving formations 651 of the latch bolt 650). When the end regions 551 of the arms 550 engage the latch bolt 650, the end regions 551 cause the latch bolt 650 to pivot, in the manner illustrated in FIG. 30, which permits the end regions 551 to continue to move downwardly alongside upper portions of the latch bolt 650. When, at last, the end regions 551 of the arms 550 complete their downward movement (i.e., when the hardcase structures 505, 605 reach the engaged position illustrated in FIG. 20), the latch bolt 650 pivots due to the action of the springs 633 (FIG. 39) to the latched position shown not only in FIG. 27 but also in FIGS. 31 and 32.

Figure 41:
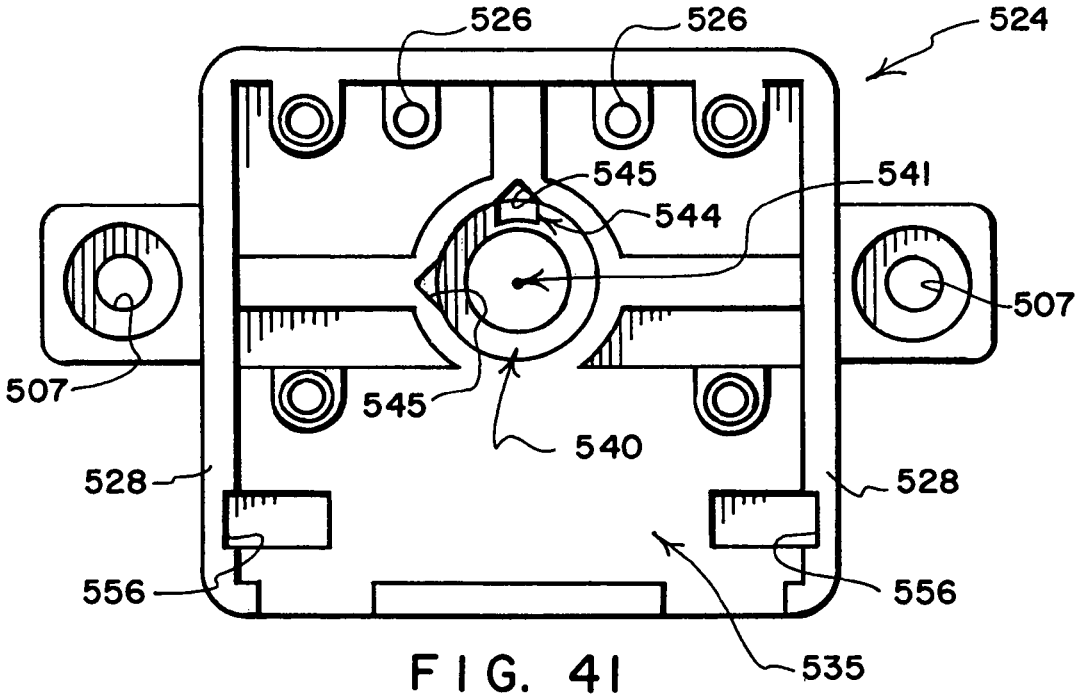
FIG. 41 is a rear view on an enlarged scale of a housing of the upper assembly, showing an interior chamber of the housing with no other components therein.

Referring to FIG. 41, the housing 524 defines a generally cylindrical cavity 540 within which the key cylinder 560 is received in a slip fit that permits the key cylinder 560 to turn about a central axis 541 (FIG. 38) that aligns with a front opening 542 (FIG. 38) of the housing 524, and with the keyhole 520 of the frontplate cover 515. The housing 524 also defines a projection 544 that extends into the cavity 540 and into a curved groove 564 (FIGS. 38 and 40) that extends slightly more than one-fourth of the way around peripheral portions of the key cylinder 560—an arrangement that limits the range of turning movement of the key cylinder 560 relative to the housing 560 to approximately a quarter turn about the axis 541.

As can also be seen in FIG. 41, the housing 524 defines a pair of shallow recesses 545 that open into the cylindrical cavity 540 at locations that are spaced approximately ninety degrees around the periphery of the cavity 540. A detent ball 565 carried in a radially extending hole 566 (FIGS. 38 and 40) formed in the key cylinder 560 is biased by a compression coil spring 567 (also installed in the hole 566 in accordance with FIG. 38) into engagement with one or the other of the shallow recesses 545 at times when the key cylinder 560 is turned to one or the other of the ends of its quarter-turn range of motion (i.e., when the key cylinder 560 is in one or the other of the positions shown in FIGS. 25 and 26). The engagement of the detent ball 565 with one or the other of the recesses 545 assists in preventing the key cylinder 560 from turning inadvertently (for example in the presence of vibration) from the positions shown in FIGS. 25 and 26.

Referring to FIGS. 25, 26 and 41, carried within a chamber 535 of the housing 524 are components of the rear unit 503 of the upper assembly 510 that receive and respond to the operation of a key inserted through the keyhole 520 of the frontplate cover 515. These key operated components include the generally S-shaped arms 550 (which are of identical configuration but arranged so their identical features extend in opposite directions), the pair of compression coil springs 533 that bias the arms 550 toward each other, and the key cylinder 560.

As previously discussed, upper end regions 552 of the arms 550 are pivotally supported in the chamber 535 by the pin like formations 526 of the housing (shown in FIG. 41 that extend through holes formed in the upper end regions 552 as shown in FIGS. 25 and 26) allowing the arms 550 to pivot between normal positions shown in FIG. 25 and the key-operated positions shown in FIG. 26. The springs 533 that bias the arms 550 toward each other (i.e., toward the normal positions of FIG. 25) have opposite end regions received in recesses 556 (FIG. 41) of the housing 524 that open into the chamber 535, and in recesses 557 (FIG. 38) of the arms 550 that face toward the recesses 556.

Referring to FIG. 39, the shroud 629 encloses several components of the front unit 602 of the lower assembly that respond to the setting of a combination on the dials 630 to cause the latch bolt 650 to move from the latched position of FIG. 27 to the unlatched position of FIG. 28. These components include the three dials 630 and three wheels 636 that are carried by a shaft 660, a spring 665 that biases the shaft 660 toward its normal position (shown in FIGS. 25, 26, 34 and 35), a leaf spring member 670 (FIG. 39) which provides arms 671 that press against the peripheries of the dials 630 (as depicted in FIGS. 27 and 28), and the reset lever 750 which is installed on the shaft 660 and has a rear end region 751 (FIGS. 24 and 34-37) that extends into and can be moved within an L-shaped opening 755 of the shroud 629.

Figure 34:
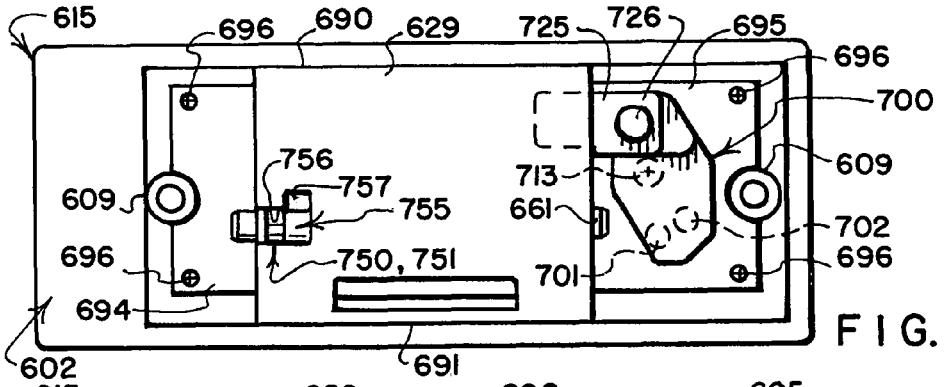
FIG. 34 is a rear view of a front unit of the upper assembly of the lock showing the reset lever and the movable indicator member of the lock in normal positions.
Figure 35:
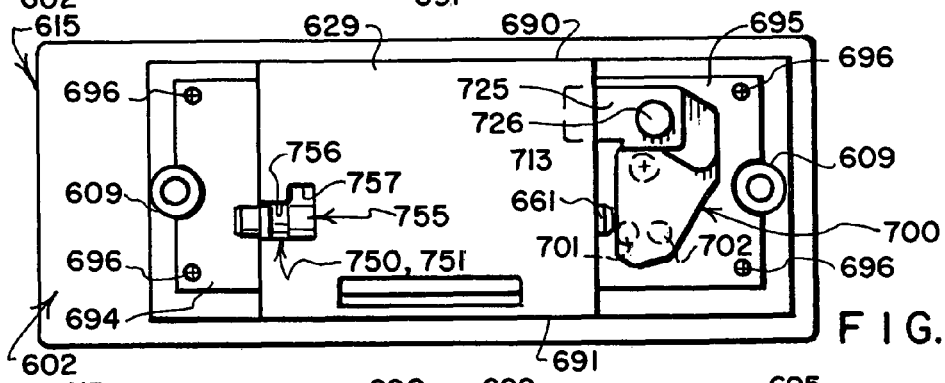
FIG. 35 is a rear view similar to FIG. 34 but with the movable indicator member pivoted from its normal or "first state" position to its operated or "second state" position.
Figure 36:
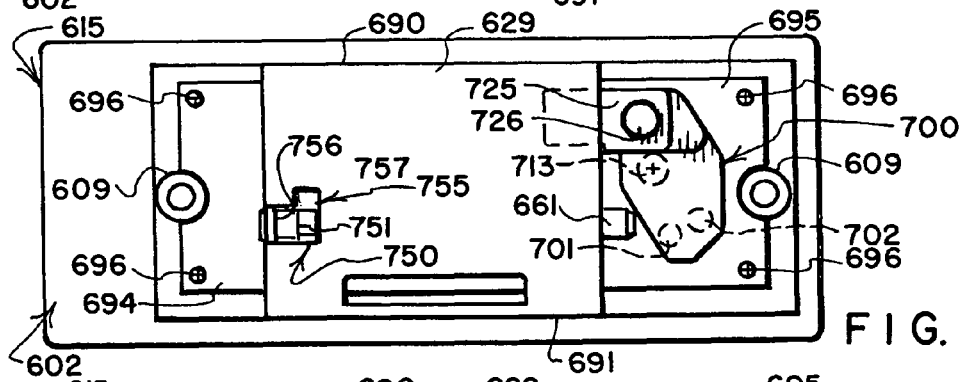
FIG. 36 is a rear view similar to FIG. 34 but with the reset lever moved rightwardly along one leg of an L-shaped opening to a first reset position which causes a shaft end region to engage and pivot the movable indicator member from the operated or "second state" position of FIG. 35 to the normal or "first state" position of FIG. 34.
Figure 37:
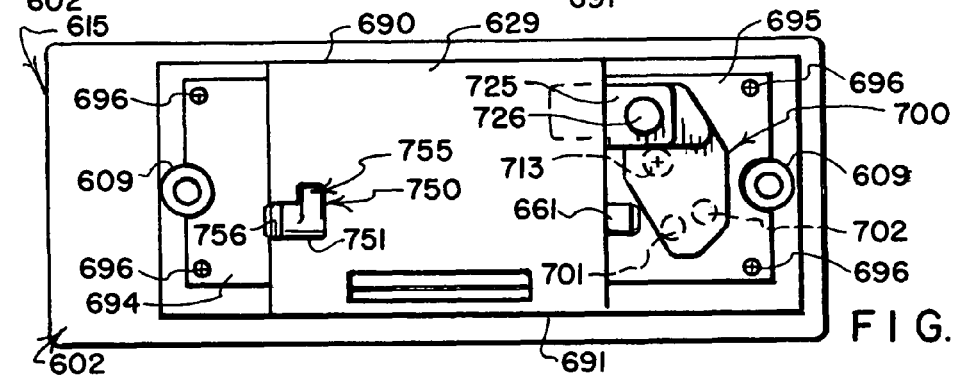
FIG. 37 is a rear view similar to FIG. 36 but with the reset lever moved along an upwardly extending leg of the L-shaped opening from the first reset position of FIG. 36 to a second reset position, which movement does not change the position of the shaft end region or the position of the movable indicator member from the positions shown in FIG. 36.

From a normal position of the reset lever shown in FIGS. 24, 34 and 35, the rear end region 751 of the reset lever 750 can be moved along a first leg 756 of the L-shaped opening 755 to a first reset position shown in FIG. 36, and from the first reset position along a second leg 757 of the L-shaped opening 755 to a second reset position shown in FIG. 37; or, the rear end region 751 of the reset lever 750 can be moved oppositely in the first and second legs 756, 757. Movement of the rear end region 751 of the reset lever 750 along the first leg 756 of the L-shaped opening 755 causes the shaft 660 to move along its length (i.e., axially along the shaft 660) inasmuch as the first leg 756 parallels the length of the shaft 660. Movement of the reset lever 750 along the second leg 757 does not axially move the shaft 660—but movement of the reset lever 750 along the second leg 757 to the second reset position of FIG. 37 will utilize the narrow nature of the second leg 757 to engage the rear end region 751 of the reset lever 750 and prevent the shaft 660 from snapping back to its normal position under the influence of the spring 665.

The shroud 629 provides an open-box-like enclosure that, as viewed in FIG. 39, has a top wall 690, a bottom wall 691, and a pair of opposed end walls 692 that extend about the periphery of a generally rectangular rear wall 693. Mounting flanges 694, 695 join with the end walls 692 and are connected to rear portions of the frontplate cover 615 by fastening formations 696 (FIGS. 34-37) of the frontplate cover 615 that extend through holes 697 (FIG. 39) formed through the mounting flanges 694, 695. Openings 698 are formed through the top wall 690 that align with the openings 649 of the enclosure 624 to permit the hook shaped lower end regions 551 of the arms 550 to extend into the interior of the lower assembly 610 to latchingly engage the receiving formations 651 of the latch bolt 650. A slot 699 formed through the bottom wall 691 receives a bottom formation 652 of the latch bolt 650. Opposite end regions of the shaft 660 extend through aligned holes 662 formed through the end walls 692 of the shroud 629 (only one of the holes 662 can be seen in FIG. 39). A shaft end region 661 located opposite the shaft end region that carries the reset lever 750 extends through one of the holes 662 to a location outside the shroud 629 where the shaft end region 661 can engage and pivot the movable indicator member 700, for example as is shown in FIGS. 36 and 37.

Except when the reset lever 750 is moved to one or the other of the first and second reset positions shown in FIGS. 36 and 37, respectively, each of the dials 630 drivingly engages an adjacent one of the wheels 636, and toothed inner formations 631 (FIG. 39) of the dials 630 drivingly engage toothed outer formations 632 (FIG. 39) of the wheels 636 to ensure that none of the wheels 636 turn about the axis of the shaft 660 unless and until the adjacent associated dial 630 is turned while the toothed formations 631, 632 are drivingly engaged.

Movement of the reset lever 750 rightwardly (as viewed in FIGS. 24 and 34-37) from the normal position shown in FIGS. 24, 34 and 35 to the first reset position shown in FIG. 36, causes the shaft 660 (on which the reset lever 750 is installed) to move rightwardly with the reset lever 750 in opposition to the biasing action of the spring 665. As the shaft 660 moves rightwardly, the wheels 636 (that also are mounted on the shaft 660) move rightwardly, which causes the driving engagement of the toothed formations 631 and 632 of the dials 630 and the wheels 636, respectively, to disengage. When the toothed formations 631, 632 disengage, the dials 630 can then be turned freely relative to the wheels 636—which is what permits a new combination to be set on the wheels 636 that will unlock the lock 500.

Once a new combination has been set (which can only occur when the reset lever 750 have moved in opposition to the action of the spring 665), the reset lever 750 can be returned to the normal position shown in FIGS. 24, 34 and 35 to thereby re-establish driving connections between the toothed formations 631, 632 to thereby "lock in" the new operating combination which will remain effective until it is once again reset by the owner of the lock who follows the combination setting procedure just described.

Axially moving the shaft 660 to release the dials 630 from their driving connection with the wheels 636 so a new combination can be set is essentially the same type of action that is utilized in the lock 100 when the shackle leg 126 is moved axially to release the dials 202, 204, 206 from the sleeves 172, 174, 176 so a new combination can be set to operate the lock 100 (as has been described in detail previously herein, and as is well known to those who are skilled in the art inasmuch as this same technique is widely used in other dial type, combination operated locks to reset their operating combinations).

The rotational positions of the wheels 636 is what normally determines whether the latch bolt 650 is in the latched position of FIG. 27, or the unlatched position shown in FIG. 28. Referring to FIGS. 27, 28 and 39, the latch bolt 650 is pressed toward and into engagement with the wheels 636 of the lock 500 by a pair of compression coil springs 633 (one being seen in FIGS. 27 and 28, and both being seen in FIG. 39). How the latch bolt 650 is caused to assume the different positions shown in FIGS. 27 and 28 as a result of how the wheels 636 are turned has to do with the fact that each of the wheels 636 has a periphery 637 that is generally round except where each wheel's round periphery 637 is interrupted by a recess region 638 (FIG. 39).

When even one of the wheels 636 is turned so that the round portion of its periphery 637 engages the latch bolt 650 in the manner shown in FIG. 27, this engagement (at a location indicated by an arrow 800 in FIG. 27) moves the latch bolt 650 in opposition to the action of the springs 633 to the latched position of the latch bolt 650 shown in FIG. 27 (which is true except when the latch bolt 650 is briefly moved in the manner shown in FIG. 30 due to the latch bolt 650 being engaged by the hook shaped lower end regions 551 of the arms 550—which occurs when the hardcase structures 505, 605 are being moved toward each other from spaced apart positions into engaged positions such as are shown in FIG. 20—and described above in conjunction with FIGS. 29-31).

When, on the other hand, the wheels 636 all are turned so that all of the recess regions 638 engage the latch bolt 650 in the manner shown in FIG. 28, this engagement (at a location indicated by an arrow 801 in FIG. 28) permits the springs 633 to pivot the latch bolt 650 to the unlatched position shown in FIG. 28 (which occurs only when a proper combination is set on the dials 630 to unlock the lock 500). Before the combination used to open the lock 500 is reset as described above, the wheels 636 are first turned to the positions shown in FIG. 28 by setting the proper existing combination on the dials to unlock the lock 500, and when this is done, the engagement of the recess regions 638 with the latch bolt 650, as maintained by the springs 633, will retain the wheels 636 in the position illustrated in FIG. 28 while the dials 630 are turned relative to the wheels 636 to set a new combination (at a time when the reset lever 750 is in one of the reset positions shown in FIG. 36 or 37, as discussed above).

During normal operation of the lock 500, once the latch bolt 650 is in the unlatched position shown in FIG. 28, the latch bolt 650 will remain in this position until one or more of the dials 630 is/are turned, causing one or more of the wheels 636 to assume a position such as is shown in FIG. 27 wherein at least one of the round peripheries 637 engages the latch bolt 650 (as at the location indicated by the arrow 800 in FIG. 27) forcing movement of the latch bolt 650 to the latched position shown in FIG. 27.

In order to move the shaft 660 lengthwise to release the driving engagement that normally obtains between the dials 630 and adjacent ones of the wheels 636, the reset lever 750 (which is carried on the shaft 660) is moved along the leg 756 of the L-shaped opening 755 that extends parallel to the length of the shaft 660—the leg 756 that extends horizontally, as viewed in FIGS. 24 and 34-37—from the normal position of the reset lever 750 shown in FIGS. 24, 34 and 35 to the first reset position shown in FIG. 36. To ensure that the driving engagement that normally obtains between the dials 630 and the wheels 636 continues to be released during a time while the dials 630 are being turned relative to the wheels 636 to reset the combination used to open the lock 500, the reset lever 750 preferably is slided along the other leg 757 of the L-shaped opening—the leg 757 that extends vertically, as viewed in FIGS. 24 and 34-37—so the slot leg 757 can prevent the reset lever 750 and the shaft 660 from snapping back to their normal positions due to the biasing action of the spring 665.

Movement of the reset lever 750 in either direction along either of the legs 756, 757 of the L-shaped opening 755 is accomplished by grasping or applying force to the reset lever 750 at a location where a rear end region 751 of the reset lever extends through the L-shaped opening 755 and can be accessed within the space provided by the rear opening 689 of the enclosure 624, as shown in FIG. 24. Although movement of the reset lever along the first leg 756 in a rightward direction as viewed in FIGS. 34-37 is opposed by the action of the spring 665 which biases the shaft 660 leftwardly, leftward movement of the reset lever 750 along the first leg 756 is assisted by the action of the spring 665.

The dials 630, the wheels 636, and the manner in which a driving connection can be interrupted therebetween to reset a combination of a combination operated lock are not novel, but rather are well known to those skilled in the art. Likewise, causing a latch bolt of a combination operated lock to pivot in response to setting or unsetting a proper combination on dials also is known. Locks that employ these basic types of features are disclosed in a number of patents of Presto Lock (e.g., U.S. Pat. Nos. 4,308,731, 4,341,101, 4,343,164, 4,343,165, 4,354,366, 4,355,524 and 4,450,698, the disclosures of which are incorporated herein by reference in case the reader desire additional details of the operation and construction of combination operated mechanisms of this general type).

Referring to FIG. 39, the movable indicator member 700 is provided with signal surfaces 701, 702 that can present different colors, such as the colors "red" and "green" (as is the case with the indicator 300 of the lock 100) that can be viewed through a hole 703 formed through the mounting flange 695 of the shroud 629, and through the indicator window 620 defined by the frontplate cover 615. Alternatively, the signal surfaces 701, 702 can take a wide variety of other forms and can, for example, be defined by illuminated surfaces of electrically operated signalling devices such as "red" and "green" bulbs or LED devices that are powered in a conventional manner by a battery (not shown) of the lock 500 that can be carried by whichever one of the assemblies 510, 610 of the lock 500 that is used to support an indicator member that can move to change in some notable manner the visual appearance or some other characteristic of the lock 500 in response to use of a key (typically by a government authorized inspector to examine contents of an associated travel bag).

Numbers, letters, colors and a wide variety of other signalling media can be carried by the movable indicator member 700 and displayed through the window 620; or movable components of other types can be substituted for the movable indicator member 700 to provide a suitable indication in response to use of a key.

Referring still to FIG. 39, it will be seen that the movable indicator member 700 is pivotally connected to the shroud 629 by a generally cylindrical, forwardly extending projection 710 that pivots in a mounting hole 711 formed through the mounting flange 695 of the shroud 629, and that a retaining clip 712 of conventional form is provided to extend into a groove 713 of the projection 710 to prevent the projection 710 from withdrawing from the mounting hole 711. The cylindrical projection 710 extends along an axis 733 through the hole 711, and the indicator 700 pivots about the axis 733 relative to the shroud 629.

Figure 42:
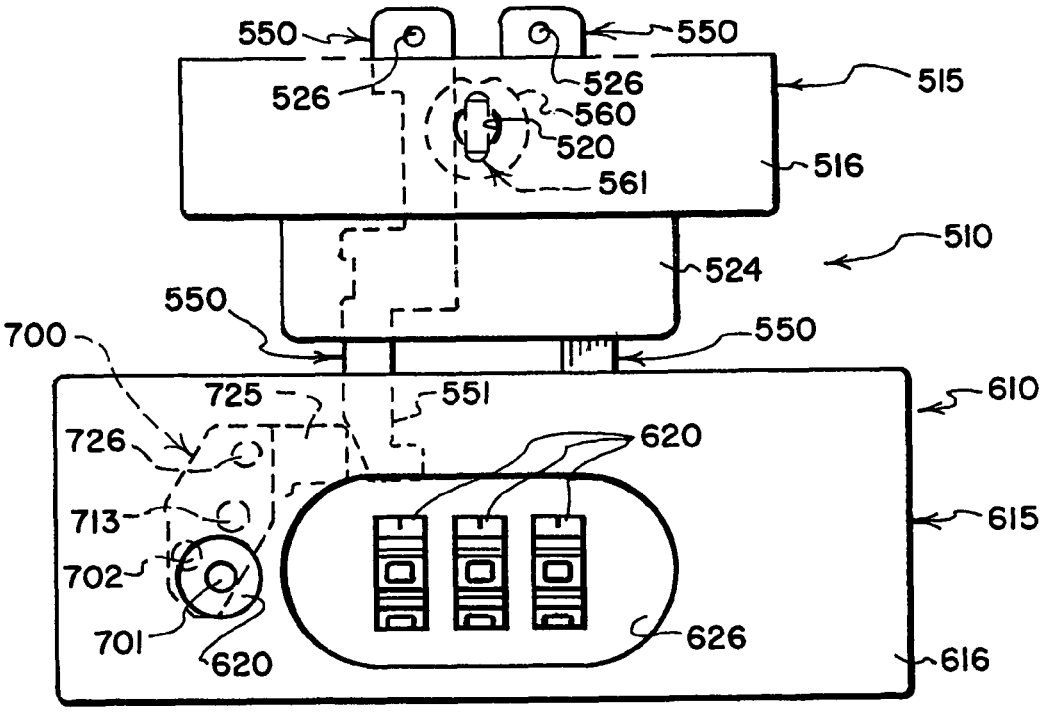
FIG. 42 is a front view showing selected components of the lock including arms of the upper assembly in their normal positions, and indicator components of the lower assembly in their normal or "first state" positions, with selected portions thereof depicted by broken lines; and, FIG. 43 is a front view similar to FIG. 42 but with the arms of the upper assembly pivoted to release their latched engagement with components of the lower assembly, with the indicator component portions in their operated or "second state" positions, and with selected portions thereof depicted by broken lines.
Figure 43:
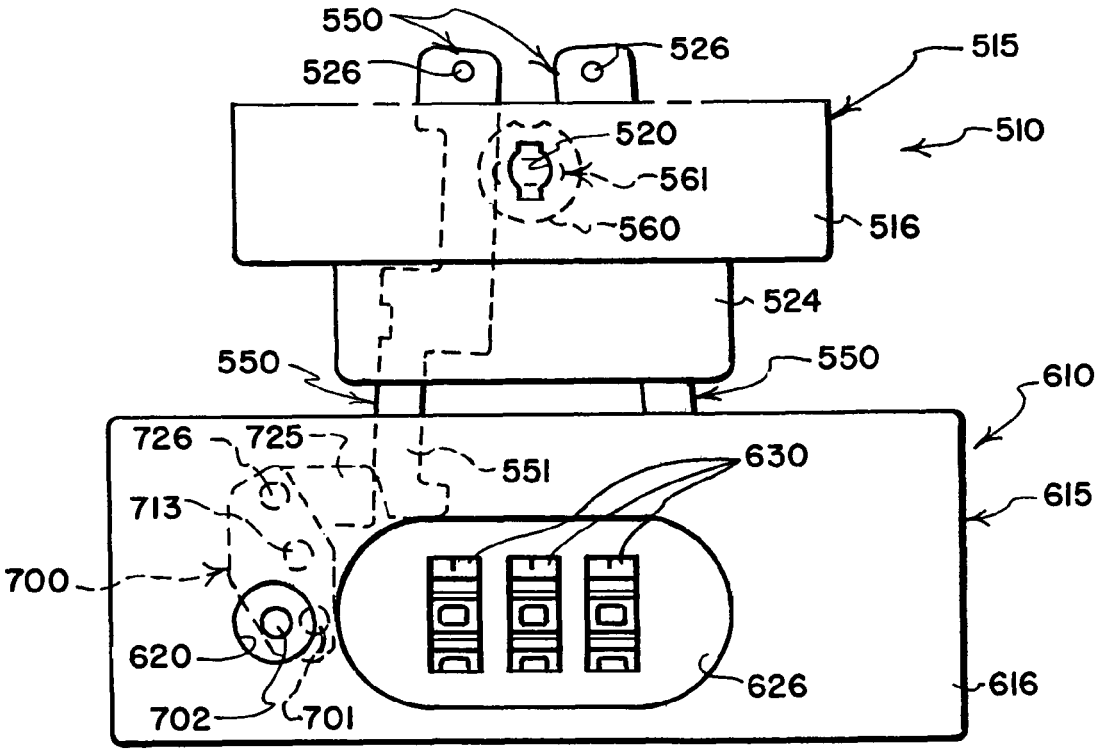

A forwardly opening hole 715 defined by the movable indicator member 700 carries a detent ball 720 that is biased outwardly of the hole 715 by a spring 721 installed in the hole 715 beneath the ball 720. The mounting flange 695 of the shroud 629 is provided with small holes 723, one or the other of which is engaged by the detent ball 720 when the movable indicator member 700 is in one or the other of its normal and operated positions wherein one or the other of the signal surfaces 701, 702 are displayed through the indicator window 620 as depicted in FIGS. 42 and 43, respectively. When the detent ball 720 is received in one or the other of the holes 723, the movable indicator member 700, it is detented in one or the other of the normal position (FIG. 42) and operated position (FIG. 43) to which the movable indicator member 700 has been turned, as just described.

Referring still to FIG. 39, an operating arm 725 is pivotally connected to the indicator member 700 by a knurled pivot pin 726 that is pressed into a rearwardly facing hole (not shown) of the indicator member 700. The operating arm 725 extends through an opening 727 defined by one of the end walls 692 of the shroud 629, and can slide back and forth through the opening 727 as the indicator 700 pivots between its ball-detented positions (i.e., one or the other of the two signalling positions of the indicator 700, a "first state" one of which is shown in FIGS. 34, 36, 37 and 42, and a "second state" one of which is shown in FIGS. 35 and 43).

The indicator 700 can be moved from its normal position shown in FIGS. 25, 34, 36, 37 and 42 to its operated position shown in FIGS. 35 and 43 as the result of the operating arm 725 being moved by one of the hook shaped end regions 551 of one of the arms 550, and can be reset from the operated position to the normal position by the shaft 660 being moved by the reset lever 750. Movement of the operating arm 725 by one of the arms 550 is caused, as shown in FIG. 43, when one of the arms 550 engages and moves the operating arm 725 as depicted in FIG. 43 as the result of a key being used to pivot the arms 550 away from each other as shown in FIGS. 26 and 43. Movement of the shaft 660 (which causes a shaft end 661 to engage and pivot the indicator member 700 as shown in FIG. 36) is caused when the shaft 660 is moved by the reset lever 750 being moved to the first reset position shown in FIG. 36. When the operating arm 725 moves the indicator 700 as shown in FIG. 43, this may cause the movable indicator member 700 to display the color "red" by aligning the signal surface 702 with the window 620 as shown in FIG. 43. When the shaft end 661 moves the indicator member 700 as shown in FIG. 36, the indicator member 700 is caused to reset to its normal position and may display the color "green" by aligning the signal surface 701 with the window 620 as shown in FIG. 42.

While in the normal position shown in FIGS. 34 and 42, the indicator is not caused to move to any other position as the result of the lock 500 being unlocked by entering a combination that causes the latch bolt 650 to move from the latched position of FIG. 27 to the unlatched position of FIG. 28. This is because no movement of the latch bolt 650 causes any movement of either the shaft 660 or the operating arm 725—which are the only two components that cause the indicator 700 to move from one signalling position to another.

Unlocking the lock 500 by using a key inserted into the keyhole 520 and into the front opening 559 of the key cylinder 560—an action that causes the key cylinder 650 to a quarter turn to reorient the projection 651 to extend crosswise between the upper end regions 552 of the arms 550 as shown in FIG. 26, is what causes the arms 550 to pivot away from each other to release the latch bolt 650—and this method of unlocking the lock 500 is what causes the indicator 700 to provide a signal that indicates key usage has occurred, such as displaying the color "red," or providing some other visual signal indicative of key use.

Once the movable indicator member 700 has been moved to the operated position shown in FIGS. 35 and 43, the movable indicator member 700 is retained in this position by the detent ball 720 engaging one of the holes 723 provided by the shroud flange 695. The indicator member 700 remains in the operated position even when, and even after, the key is removed from the keyhole 520—because when the arms 550 return to their normal positions shown in FIG. 25, this does nothing to cause the indicator 700 to change its operated position. Only use of the reset lever 750 to move the shaft 660 will cause the indicator 700 to reset.

Instead of including the movable indicator member 700 and its operating arm 725 as components of the lower assembly 610 of the lock 500, an identical or similar movable indicator member (not shown) accompanied, if desired, by a similar or identical operating arm (not shown) could be included as components of the upper assembly 510; and, instead of causing the indicator 700 to move in response to movement of one of the lower end regions 551 of one of the arms 550, a substituted indicator carried by the housing 524 could respond to movement of one of the upper end regions 552 of one of the arms 550 when the arms 550 are oppositely pivoted by key usage, as has been described in conjunction with the movement of the arms 550 from their normal position shown in FIG. 25 to their operated position shown in FIG. 26 where the lower end regions 551 of the arms 550 disengage the latch member 650 of the lower assembly 610.

However, including the movable indicator member 700 as a component of the lower assembly 610 permits the shaft 660 that also is carried by the lower assembly 610 to be utilized (when its end region 661 is moved by the reset lever 750 to reset positions such as are shown in FIGS. 36 and 37) to reset the indicator member 700 to its normal position (FIGS. 25, 34, 36, 37 and 42)—a feature that would not obtain if the movable indicator member 700 were to be carried by the upper assembly 510 where no component moves in response to the shaft 660 being moved axially due to reset movement of the reset lever 750.

Although the description presented above draws attention to a number of significant similarities between the mechanisms and operational characteristics of the locks 100 and 500, a number of other similarities exist and merit mention.

In both of the locks 100, 500, pairs of relatively movable members latchingly engage to establish a "locked" condition, and disengage to "unlock" the lock—and, in fact, in each of the locks 100, 500, at least two pairs of relatively movable members can, and typically do, latchingly engage at spaced locations within the protected confines of an associated lock housing. In the lock 100, the housing 110 protectively encloses the sleeve-carried teeth 177 that latchingly engage the slide-carried finger formations 272, 274, 276 to "lock" the lock 100; and, in the lock 500, the housing 624 and the shroud 629 protectively enclose the hook shaped lower end regions 551 of the arms 550 that latchingly engage the latch-bolt-carried receiving formations 651 to "lock" the lock 500.

Moreover, in each of the locks 100, 500, only one of the latched engagements (of one of the teeth 177 with one of the fingers 272, 274, 276—or of one of the end regions 551 with one of the formations 651) actually is needed to establish a "locked" condition; and, when more than one of these latched engagements is established (as often is the case), the locks 100, 500 are even more securely maintained in their "locked" conditions.

Furthermore, in each of the locks 100, 500, the latched engagements of paired components (just described) can be released by moving either of the two components of each latched pair: for example, in the lock 100, the slide-carried fingers 272, 274, 276 can be moved out of latched engagement with the teeth 177 by use of a key, or the teeth 177 can be moved out of latched engagement with the fingers 272, 274, 276 by turning the dials 202, 204, 206; and, in the lock 500, the latch-bolt-carried formations 651 can be moved out of latched engagement with the hook shaped end regions 551 of the arms by setting a combination on the dials 630 to pivot the latch bolt 650, or by using a key to withdraw the hook shaped end regions 551 from engagement with the formations 651.

In each of the locks 100, 500, a shaft that carries combination dials (namely the shackle leg 126 that carries the dials 202, 204, 206 in the lock 100, and the shaft 660 that carries the dials 630 in the lock 500) moves axially along its length to perform a resetting function, and, in fact, axial shaft movement is used by both of the locks 100, 500 not only to reset their indicators 300, 700, but also to disconnect their dials 202, 204, 206 and 630 from other components so the combinations that operate the locks 100, 500 can be reset.

Although it might appear that the lock 100 differs significantly from the lock 500 because the lock 100 appears to have no component that is functionally equivalent to the reset lever 750 of the lock 500 that extends through an opening 689 of the housing 624, a more careful examination quickly discloses that, in actuality, the lock 100 has reset components that are very similar, indeed, to the reset components of the lock 500. Referring to FIG. 16, the shackle 120 of the lock 100, when turned and depressed as shown, performs in much the same way as do the reset lever 750 and the shaft 660 in the lock 500—because, when the shackle leg 126 is depressed, it carries with it the toothed sleeve 176 which engages and causes movement of the reset element 314 which, in turn, engages and pivots the indicator 300 back to its normal position—which accomplishes a reset function that is equivalent to what happens when the reset lever 750 of the lock 500 moves the shaft 660 to engage and reset the indicator 700.

Moreover, as can be seen in FIG. 16, the shackle leg 126 extends through an upper opening 139 of the housing 110 to a position where a transversely extending upper end region 122 of the shackle 120 can be grasped and manipulated in much the same way that the outer end region 751 of the transversely extending reset lever 750 of the lock 500 can be grasped and manipulated—and, as a result the shackle 120 functions as a reset component that causes the indicator 300 of the lock 100 to pivot back to its normal position in much the same way that the reset lever 750 and the shaft 660 cooperate to function as a reset component that causes the indicator 700 of the lock 500 to pivot back to its normal position. Thus, the locks 100, 500 can be said to have reset members 120, 750 that extend through housing openings 139, 689 to enable the associated indicators 300, 700 to be manually reset, respectively.

In the locks 100, 500, the indicators 300, 700 move at locations shielded from access by other components, and the signal surfaces 301, 302 and 701, 702 of the indicators 300, 700 are visible through window openings 250, 620, respectively—arrangements that are intended to protect the indicators 300, 700 from being manipulated in unauthorized ways to provide false signals.

In each of the locks 100, 500, the dials of the combination mechanisms move relative to a first axis (i.e., they turn about a first axis); the key cylinders of the key mechanisms move relative to a second axis (i.e., they turn about an axis different from the axis about which the dials turn); and, the indicators move relative to a third axis (i.e., they turn about axes that differ from the axes about which the dials and the key cylinders turn). The mechanisms of the locks 100, 500 could be rearranged so that some of the components mentioned here move about common axes—but the mechanisms of the locks 100, 500 achieve an advantageous degree of simplicity when their components are arranged in the manner described.

Differences also exist between the locks 100, 500—it being noted that the lock 100 utilizes a housing 110 and a shackle 120 as its major relatively movable elements, whereas the lock 500 utilizes entirely separate upper and lower assemblies 510, 610 as its major relatively movable elements. Whereas all of the relatively movable members of the lock 100 are connected to one housing 110, the relatively movable members of the lock 500 are divided into two entirely separate assemblies 510, 610 that utilize a more complex set of housings, enclosures, shrouds and frontplate covers that are designated by the numerals 524, 624, 629, 515 and 615.

Whereas the lock 100 has a single housing 110 that carries not only a key mechanism but also a combination mechanism and a key usage responsive indicator, the lock 500 employs two separate assemblies 510, 610, one of which carries a key mechanism, and the other of which carries the combination mechanism and the key usage responsive indicator—it being somewhat unexpected to see that the indicator of the lock 500 which responds to the key mechanism of the upper assembly 510 is, in fact, not carried by the upper assembly 510, but rather is more advantageously carried by the lower assembly 610 where it can be reset by the same reset lever 750 as is used to reset the combination of the lock 500.

As will be apparent from the foregoing, features that are described herein can bring to combination and key operated locks of many types a resettable, key usage responsive indicator that is well suited to warn lock owners that associated travel bags may have been key opened, perhaps for inspection of their contents.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty that exist in the invention disclosed.

What is claimed is:

1. A visual signal indicator movable on a padlock to provide a visual signal in response to a key being used in a key opening of the padlock and being resettable only after a combination has been set on the padlock, wherein relatively movable portions of the padlock are released from a condition of locked engagement by setting the combination, and, alternatively, by using the key in the key opening.

2. A padlock having a combination mechanism and a key mechanism each being independently capable of unlocking the padlock, and having a member that moves in response to the use of the key mechanism to alter the visual appearance of the padlock, with the member being resettable to restore the appearance of the padlock after use of the combination mechanism.

3. An indicator on a padlock to signal visually in response to the use of a key in a key opening of the padlock, and being resettable once a combination is set on the padlock, wherein the padlock is adapted to release from a locked condition in response to the use of the key and, alternatively, in response to the setting of the combination.

4. A padlock lockable by first and second components that can be released from latched engagement in a first way by use of a key with a key mechanism and in a second way by setting a combination with a combination mechanism, wherein the use of the key causes a visual signal to be set that can be reset by moving a component of the combination mechanism.

5. A padlock having a housing that shields from access a location within the housing where first and second components can latchingly engage to lock relatively movable members of the padlock, wherein the first component can be moved from the location by use of a key to unlock the lock, wherein the second component can be moved from the location by setting a combination to unlock the lock, and wherein the housing also protectively encloses a movable indicator that changes position to provide a signal through an opening of the housing in response to the movement of the first component by the use of the key.

6. The padlock of claim 5 wherein the first and second components are capable of establishing a plurality of latched engagements at the location, and all of the established latched engagements are released when the key is used and when the combination is set.

7. A lock having a combination mechanism extending along a first axis that can be used to open the lock by turning at least one dial of the combination mechanism about the first axis to set a combination, a key mechanism extending along a second axis that can be used to open the lock by turning at least one member of the key mechanism about the second axis, and an indicator extending along a third axis that can turn relative to the third axis to provide a visual signal in response to use of the key.

8. A lock having a plurality of relatively movable latching components movable relative to a housing of the lock into and out of latched engagement, a key operated mechanism and a combination operated mechanism each being usable to move different ones of the latching components to release the latched engagement, and a resettable indicator that provides a visual signal in response to use of the key operated mechanism.

9. A lock having a first locking member and a second locking member capable of latchingly engaging at a location within a housing of the lock, wherein the latching engagement can be released by using a key to move the first locking member and alternatively by setting a combination to move the second locking member, and the lock provides a visual signal in response to using the key.

10. A lock operable by setting a combination and having a signal surface that becomes visible once a key is used to release a locked condition of the lock, and having a reset member movable to reset the signal surface once a combination is set.

11. The lock of claim 10 wherein the reset member extends through a housing opening of the lock and can be manually moved to reset the signal surface.

12. A combination operable lock having a pair of components that latchingly engage when the lock is locked, one of which can be moved by the use of the key to unlock the lock, and the other of which can be moved by setting a combination to unlock the lock, and having a reset member that can be grasped and moved to reset an indicator that provides a signal in response to the use of the key.

13. The lock of claim 12 wherein the reset member also can be moved to change the combination.

14. A lock having a combination mechanism and a key mechanism each capable of moving different components of the lock to unlock the lock, and providing a signal in response to use of a key in the key mechanism, wherein the signal can be reset by moving a reset element of the lock relative to a housing of the lock at a time when the lock is unlocked.

15. The lock of claim 14 wherein the different components are movable toward each other in one manner to establish latched engagement therebetween, and are movable in a different manner to release the latched engagement.

16. A lock having first and second latchingly engageable members releasable from latched engagement by using a key to move the first member in a first manner and, alternatively, by setting a combination to move the second member in a second manner, and providing a visual signal in response to the first manner of movement of the first member.

17. The lock of claim 16 wherein an indicator is movable between first position to provide a specific visual signal and a second position to cease providing the specific visual signal.

18. The lock of claim 17 wherein the indicator is biased toward at least a selected one of the first and second positions when near the selected one of the first and second positions.

19. The lock of claim 17 wherein the indicator is biased toward the first position when near the first position, and toward the second position when near the second position.

20. A lock having a key mechanism and a combination mechanism each usable separately from the other to unlock the lock, and having a key use responsive indicator that alters the appearance of the lock in a way that can be reversed by moving a reset element of the lock relative to a housing of the lock.

21. The lock of claim 20 wherein a graspable portion of the reset element extends through an opening of a housing of the lock.

* * * * *